US007647883B2

(12) United States Patent
Maruyama et al.

(10) Patent No.: US 7,647,883 B2
(45) Date of Patent: Jan. 19, 2010

(54) FLUID INJECTION METHOD AND APPARATUS AND DISPLAY PANEL

(75) Inventors: Teruo Maruyama, Hirakata (JP); Takashi Inoue, Higashiosaka (JP); Ryoji Hyuga, Kadoma (JP)

(73) Assignee: Panasonic Corporation, Osaka (JP)

( * ) Notice: Subject to any disclaimer, the term of this patent is extended or adjusted under 35 U.S.C. 154(b) by 721 days.

(21) Appl. No.: 11/105,516

(22) Filed: Apr. 14, 2005

(65) Prior Publication Data

US 2006/0093493 A1 May 4, 2006

(30) Foreign Application Priority Data

Apr. 16, 2004 (JP) ..... 2004-121596

(51) Int. Cl.

| | |
|---|---|
| ***B05C 5/00*** | (2006.01) |
| ***B05C 11/00*** | (2006.01) |
| ***F04B 9/14*** | (2006.01) |
| ***F04B 49/06*** | (2006.01) |

(52) U.S. Cl. ..... 118/300; 118/688; 118/692; 417/44.1; 417/374; 222/333; 239/537; 239/584; 239/581.2

(58) Field of Classification Search ..... 118/300, 118/688, 692, 693, 313–315, 683; 427/64, 427/67, 427.1, 427.2, 427.6; 417/44.1, 374, 417/205; 239/537, 584, 581.2, 585.5, 586.5
See application file for complete search history.

(56) References Cited

U.S. PATENT DOCUMENTS

| | | | | |
|---|---|---|---|---|
| 6,558,127 | B2 | 5/2003 | Maruyama et al. | |
| 6,679,685 | B2 | 1/2004 | Maruyama et al. | |
| 2002/0025260 | A1 * | 2/2002 | Maruyama | 417/322 |
| 2004/0081759 | A1 * | 4/2004 | Maruyama et al. | 427/256 |
| 2004/0118865 | A1 | 6/2004 | Maruyama et al. | |
| 2004/0228970 | A1 | 11/2004 | Maruyama et al. | |

FOREIGN PATENT DOCUMENTS

| | | |
|---|---|---|
| JP | 2002-1192 | 1/2002 |
| JP | 2002-301414 | 10/2002 |
| JP | 2004-84592 | 3/2004 |
| JP | 2004-141866 | 5/2004 |
| JP | 2004-261803 | 9/2004 |

* cited by examiner

*Primary Examiner*—Yewebdar T Tadesse
(74) *Attorney, Agent, or Firm*—Wenderoth, Lind & Ponack, L.L.P.

(57) ABSTRACT

A fluid supply apparatus is provided for feeding a fluid to two faces relatively moving in a clearance direction, a continuous flow supplied from the fluid supply apparatus is converted to an intermittent flow by utilizing pressure change caused by a fluctuation of a clearance space of the relative moving faces, and an intermittent discharge quantity per dot is adjusted by the number of revolutions of the fluid supply apparatus.

11 Claims, 43 Drawing Sheets

FLOW RATE v OF FLUID PASSING THROUGH DISCHARGE NOZZLE (mm/s)

FLUID INJECTION METHOD AND APPARATUS AND DISPLAY PANEL

BACKGROUND OF THE INVENTION

The present invention relates to an apparatus and a method for injecting a very small quantity of fluids necessary in such fields as information/precision equipment, machine tools, FA (Factory Automation) or in various manufacturing steps for semiconductors, liquid-crystals, displays, and surface mounting, and is particularly suitable for fluid injection apparatus and method for injecting fluids continuously or intermittently.

Fluid dispensing apparatuses (dispensers), which have conventionally been used in various fields, are now required to have a technology for feeding and controlling a very small quantity of fluid materials at high accuracy and with stability in response to the needs of electronic components smaller in size, and higher in recording density in recent years. For example, in the field of displays such as plasma displays, CRTs (Cathode Ray Tubes), organic ELs (Electro-Luminescences), there is a large demand for direct patterning of phosphors or electrode materials on panel faces without any mask, instead of conventional techniques such as screen printing and photo lithography. The dispensers have difficulties to be overcome for satisfying the demand as outlined below:

(i) miniaturization of a dispensing quantity (ii) achievement of high accuracy in dispensing quantity (iii) reduction in dispensing time Conventionally, shown in FIG. 36 is a dispenser of air pulse method which has been widely used as a liquid dispensing apparatus, and the technology thereof has been introduced for example in "Automation Technology '93, Vol. 25 No. 7".

The dispenser of this method is structured such that a constant flow of air fed from a constant pressure source is applied as a pulse to an inside 601 of a container 600 (cylinder) and liquid of a specific quantity corresponding to an increased portion of pressure in the cylinder 600 is discharged from a nozzle 602.

In the field of circuit formation which are achieving higher accuracy and more ultra miniaturization in recent years or in the field of manufacturing steps for electrodes and ribs of image tubes such as PDPs and CRTs, phosphor screen formation, liquid-crystals, and optical discs, most of fluids which need to be discharged in very small quantity are high-viscosity powder and granular materials.

The largest difficulty is how to discharge powder and granular materials including fine particles onto target substrates at high speed and high accuracy and with high reliability without causing clogging of flow passages.

For the purpose of high-speed intermittent discharge, a dispenser (hereinbelow referred to as a jet-type for the sake of convenience) as shown in FIG. 37 has been put into practical use. Reference numeral 550 denotes a micrometer, 551 a spring, 552 a piston seal member, 553 a piston chamber, 554 a heater, 555 a needle, 556 a discharge material flowing toward a seat portion, and 557 a dot-like discharge material flying from the dispenser. FIG. 38A and FIG. 38B are model views showing a discharge portion area 558 in FIG. 37, in which FIG. 38A shows a suction step while FIG. 38B shows a discharge step. Reference numeral 559 denotes a spherically-shaped convex portion formed on the discharge-side end portion of the needle 555, 560 a discharge tip portion, 561 a spherically-shaped concave portion formed on the discharge tip portion, and 562 a discharge nozzle. Reference numeral 563 denotes a pump chamber formed by the spherically-shaped convex portion 559 and concave portion 561.

In FIG. 38A showing the suction step, when a supply air pulse of the piston chamber 553 is ON, the needle 555 goes up against the spring 551. At this time, the suction portion 564 formed in between the spherically-shaped convex portion 559 and concave portion 561 is put in an open state, so that the discharge material 556 is filled in the pump chamber 563 from the suction portion 564. In FIG. 38B showing the discharge step, when the air pulse is OFF, that is, when an air pressure is not applied to the piston chamber 553, the needle 555 goes down by the force of the spring 551. At this time, the suction portion 564 is put in a closed state and so the fluid in the pump chamber 563 is compressed in an enclosed space except the discharge nozzle 562, by which high pressure is generated and the fluid flies and flows away.

Hereinbelow, a step for forming phosphor layers for plasma display panels will be taken as an example to state the issues of the prior art.

[1] Issue in screen printing method and photo lithography method

[2] Issue in the case where the phosphor layers are subjected to direct patterning with use of the conventional dispenser technology First, description will be given of the issue [1].

(1) Structure of Plasma Display Panels

FIG. 39 shows one example of the structure of a plasma display panel (hereinbelow referred to as PDP). The PDP is mainly composed of a front plate 800 and a rear plate 801. A plurality of pairs of linear transparent electrodes 803 are formed in a first substrate 802 which is a transparent substrate constituting the front plate 800. A plurality of pairs of linear electrodes 805 orthogonal to the linear transparent electrodes are disposed in parallel in a second substrate 804 constituting the rear plate 801. These two substrates are opposed to each other with a barrier rib 806 in which a phosphor layer is formed being interposed therebetween, and discharge gas is encapsulated in the barrier rib 806. When a voltage equal to or larger than a threshold is applied to between the electrodes of both the substrates, electricity is discharged at positions where the electrodes are orthogonal to each other and the discharge gas emits light, so that the emitted light can be observed through the transparent first substrate 802. Then, by controlling the electric discharge positions (electric discharge points), images may be displayed on the side of the first substrate. For achieving color display by the PDP, phosphors which develop desired colors by ultraviolet rays emitted at each electric discharge point during electric discharge are formed at positions (partition walls of the barrier rib) corresponding to respective electric discharge points For achieving full color display, phosphors of RGB (Red, Green, Blue) are formed.

More detailed description will be given of the structure of the front plate 800 and the rear plate 801.

In the front plate 800, a plurality of pairs of linear transparent electrodes 803, one pair being composed of two electrodes, are formed in parallel by ITO or other techniques on the inner face side of the first substrate 802 which is made of a transparent substrate such as glass substrates. A bus electrode 807 is formed on the inner face side-surface of the linear transparent electrodes 803 for decreasing a line resistance value. A dielectric layer 808 for covering these transparent electrodes 803 and the bus electrode 807 is structured to be formed over the entire inner face region of the front plate, and an MgO layer 809 that is a protective layer is structured to be formed on the entire surface region of the dielectric layer 808.

On the inner face side of the second substrate 804 of the rear plate 801, a plurality of linear address electrodes 805 orthogonal to the linear transparent electrodes 803 of the front plate 800 are formed in parallel from silver and other materials. Moreover, a dielectric layer 810 covering the address electrodes 805 is formed on the entire inner face region of the rear plate. On the dielectric layer 810, barrier ribs (partition wall) 806 of a specified height are formed in the state of protruding between the respective address electrodes for separating the respective address electrodes 805 and maintaining a gap interval between the front plate 800 and the rear plate 801 constant. With the barrier ribs 806, cells 811 are formed along the respective address electrodes, and phosphors 812 of each color of RGB are formed in sequence on its inner face. PDPs of cell structure include those having electric discharge points one in an independent cell as shown in FIG. 39 and those having a cell structure (unshown) partitioned by partition walls per line. In recent years, the "independent cell method" is drawing attention as a method allowing enhanced performance of PDP. This is because encircling the four sides of the cell by barrier ribs in a waffle-like state makes it possible to prevent light leakage between adjacent cells and to increase areas of emitters. As a result, it becomes possible to enhance luminous efficacy and luminous quantity (luminance), thereby making it possible to realize images of high contrast. These are considered as characteristics of the "independent cell method". The phosphor layers formed on cell wall faces are generally formed to be as thick as about 10 to 40 μm for better color development. For forming the RGB phosphor layers, each cell is filled with a phosphor coating liquid and then is dried to remove volatile components, by which a thick phosphor is formed on the cell inner face and at the same time a space to be filled with discharge gas is created. For forming such a thick-film phosphors pattern, coating materials containing phosphors are prepared to be high-viscosity fluid pastes (phosphor pastes) of a few thousand mPa·s to tens of thousands mPa·s with a reduced quantity of solvent, and are conventionally discharged to substrates by screen printing or photo lithography.

(2) Issue in Conventional Screen Printing Method

Conventionally, in the case of employing the screen printing method, upsizing of screens caused extensive elongation of screen plates due to tension and this brought difficulty to high-accuracy alignment of the screen printing plate across the entire screen. Moreover, an attempt to fill phosphor materials caused the materials to be extensively put on top portions of the partition walls, which became an issue leading to cross talk between the barrier ribs in the case of the "independent cell method". Eventually, it has became necessary to take actions such as introducing surface treatment or processing by mechanical means such as a polishing step for removing materials attached to the top portions of the partition walls. Further, a difference in squeegee pressure changes a fill of phosphor materials, and its pressure adjustment requires extreme delicacy and mostly depends on a level of skill of operators. Therefore, it is not easy to provide a constant fill to all the independent cells across the entire region of the rear plate.

(3) Issue in Conventional Photo Lithography

Conventionally, the photo lithography has a following issue. In this method, after a photosensitive phosphor paste is injected into the cells between the ribs, only photosensitive compositions injected into specified cells remain through exposing and developing steps. After that, through a burning step, organic substances in the photosensitive compositions are eliminated to form phosphor layer patterns. In this method, the paste for use contains phosphor powders and therefore its sensitivity to ultraviolet rays is low, which makes it difficult to form the phosphor layers to have a film thickness of 10 μm or larger. This has caused such an issue that sufficient luminance is unavailable.

Further, in the case of employing the photo lithography, the exposing and developing steps are essential for each color, and since phosphors are contained at high concentration in the coating layer of the paste, a loss of the phosphors due to removal through development is large and an effective utility of the phosphors is at best less than 30%, causing a serious issue costwise.

[2] Issue in the Case of Direct Patterning of Phosphor Layers With Use of the Conventional Dispenser Technique Discharging a fluid to image tubes has conventionally been attempted with use of a dispenser of air nozzle type (FIG. 36) widely used in the filed such as circuit mounting. In the case of the air nozzle type, it is difficult to continuously discharge a high-viscosity fluid at high speed, and therefore fine particles are discharged in the state of being diluted by a low-viscosity fluid. In the case of discharging phosphors for image tubes such as PDPs and CRTs, diameters of fine particles are 3 to 9 μm and their specific gravities are about 4 to 5. In this case, there has been such an issue that a particle itself is heavy and therefore the moment the flow of a fluid stops, fine particles accumulate in flow passages. Further, dispensers of air method have a drawback of poor responsibility. This drawback is attributed to compressibility of air encapsulated by a cylinder and nozzle resistance generated when the air passes through a narrow space. More particularly, in the case of the air method, a time constant determined by the volume of the cylinder and the nozzle resistance is large, which makes it necessary to allow delay of about 0.07 to 0.1 sec. till a fluid is transferred onto a substrate after an input pulse is applied and discharge of the fluid is started.

Development has been made for applying the inkjet method widely used in commercial printers to industrial dispensing apparatuses. In the case of the inkjet method, the viscosity of a fluid is limited to 10 to 50 mPa·s due to constraints of its driving method and structure, and this makes it impossible to support a high-viscosity fluid.

In order to draw fine patterns by using the inkjet method, a low-viscosity nano-paste in which particles with an average diameter of about 5 nm are covered with dispersants and are independently dispersed has been developed. Assumed is a case in which phosphor layers are formed on inner walls of the barrier ribs (partition walls) of the above-described "independent cells" of the PDPs with use of the nano-paste. In the drying process after each cell is filled with a phosphor coating liquid, since the phosphor layers are basically given a thickness of about 10 to 40 μm as described before, a high-viscosity fluid paste with a reduced quantity of solvent is used as the coating material containing phosphors. In the low-viscosity nano-paste in which phosphor content can only be decreased, absolute content of the phosphors falls short, leading to failure in formation of the phosphor layers with a specified thickness. Further, while phosphor particles each with a diameter of several micron orders are generally considered optimum for the displays to have high intensity, it is not easy to change the phosphor diameter at the present stage, and this is one of the serious issues of the inkjet method.

The jet-type dispenser shown in FIG. 37 is sufficiently high in discharge speed compared to the conventional dispensers of air-type, thread groove-type, or other types and is also capable of supporting a high-viscosity fluid. Moreover, this method enables the fluid to fly from a nozzle for intermittent discharge in the state that the nozzle is sufficiently away from an opposed face. Thus, a discharging method involving the fluid flying from the nozzle is difficult to apply to the air-type or thread groove-type dispensers which cannot develop steep and pulsed pressure.

This method as described before is the method in which a spherically-shaped convex portion formed on the end portion of the needle 555 and a spherically-shaped concave portion formed on the discharge side are engaged to create an enclosed (hermetic) space 563 except the discharge nozzle 562, and the enclosed space is compressed to generate high pressure which allows a fluid to fly and flow away.

In this case, in the compressing step, a clearance between relatively moving members (convex portion and concave portion) in the suction portion 564 is zero, and phosphor particles with an average diameter of 3 to 9 μm are subjected to the action of mechanical compression and are destroyed. It's often the case that various failures caused as a result, such as clogging in flow passages and degradation of sealing performance of the suction portion 564 due to ware of the members make it difficult to apply this method to discharge of powder and granular materials such as phosphors.

Another issue in this method is difficulty in ensuring accuracy of an absolute discharge quantity per dot in the assumption of long time continuous use. In the assumption that phosphors are intermittently discharged into the above-described "independent cells" of the PDP, the necessary number of heads is several dozen in consideration of production process time in mass production. In the aforementioned dispenser, a discharge quantity per dot is determined by a volume of the enclosed space, i.e., a stroke of the needle 555 and sealing performance of the suction portion 564. However, it is expected to be extremely difficult from a practical standpoint to maintain the stroke and the absolute position of each needle 555 of several dozen of dispensers as well as the sealing performance of the suction portion 564 subject to wear in a constant state over a long period of time without dispersion.

In summary of these considerations, a method having a potential to substitute the screen printing method, e.g., a direct patterning method realizing formation of independent cell phosphor layers for PDPs, is not available at the present stage.

In order to satisfy various demands of recent years regarding fluid discharge in a very small flow quantity, the inventor of the present invention has proposed a discharge method for controlling a discharge quantity by applying relative linear motion and rotational motion to between a piston and a cylinder, providing a means to transport a fluid by the rotational motion, and changing a relative gap between a fixed side and a rotation side by using the linear motion, and a patent application thereof has been filed as "Fluid Feed Device and Fluid Feed Method) (Japanese Patent Application No. 2000-188899 (U.S. Pat. No. 6,558,127 and U.S. Pat. No. 6,679,685)).

Further, after theoretical analysis was applied to the dispenser structure disclosed in the proposal, the inventor has already proposed a method and a device for intermittent discharge (Japanese Patent Application No. 2001-110945 (U.S. Pat. No. 6,679,685)) to utilize squeeze effect produced by steep change of a clearance between an end face of the piston and its relative movement face.

As a result of performing strict theoretical analysis, the inventor of the present invention has found out that by adjusting the combination of pump characteristics and pistons, a developed pressure (secondary squeeze pressure) equal to or larger than the squeeze effect can be obtained even in the case where a clearance between the end face of the piston and the relative movement face is sufficiently wide. Since this effect allows simple management of the clearance between the end faces of the piston and makes it possible to set a total discharge quantity per dot by a number of revolutions of the pump, it becomes possible to realize a very-high-speed intermittent discharge device which is easily handled in a practical use, has high flow quantity accuracy, and has high reliability with respect to powder and granular materials, and the device has already proposed (Japanese Patent Application No. 2002-286741 (U.S. patent application Ser. No. 10/673,495)).

In Japanese Patent Application No. 2003-036434 (U.S. patent application Ser. No. 10/776,278) following the above proposal, the inventor of the present invention has found out that compressibility possessed by fluid exerts a large influence on development of squeeze pressure, and has proposed a head structure which realizes high-speed intermittent discharge and high-speed continuous discharge based on the knowledge obtained from the analysis result concluded in consideration of the compressibility.

As a result of advanced research with strict comparison between the theoretical analysis and experimental results on the basis of these proposals, it is an object of the present invention to provide fluid injection method and apparatus and a display panel, which are capable of offering high responsibility even in the case where a volume of flow passages increases due to adoption of multi-head structure or the like.

SUMMARY OF THE INVENTION

In order to accomplish the object, the present invention is structured as shown below.

Fluid injection method and apparatus of the present invention may be realized by fluid injection method and apparatus for feeding a fluid from a fluid supply apparatus to between two members which relatively move in a clearance direction, converting a continuous flow fed from the fluid supply apparatus to an intermittent flow by utilizing pressure change caused by fluctuation of a distance of the clearance, and adjusting an intermittent discharge quantity per dot by setting pressure and flow quantity characteristics of the fluid supply apparatus for intermittent injection so as to realize intermittent injection or continuous injection from a discharge port, wherein the fluid is fed to a clearance between the two members through a fluid resistance portion disposed in a flow passage connecting the fluid supply apparatus and the two members.

According to a first aspect of the present invention, there is provided a fluid injection method comprising: feeding a fluid from a fluid supply apparatus to a clearance formed between relative movement faces of two members opposed to each other through a fluid resistance portion disposed in a flow passage connecting the two members which relatively move in clearance direction of the clearance and the fluid supply apparatus in a state that a discharge quantity of a fluid per dot is adjusted by setting pressure and flow quantity characteristics of the fluid supply apparatus; and intermittently injecting or continuously injecting the fluid fed from the fluid supply apparatus from an discharge port to a discharge target by utilizing pressure change caused by fluctuation of a space of the clearance based on relative movement of the two members.

According to a second aspect of the present invention, there is provided a fluid injection method as defined in the first aspect, comprising: feeding the fluid from the fluid supply apparatus to the clearance through the fluid resistance portion in a state that an intermittent discharge quantity of the fluid per dot is adjusted by setting the pressure and the flow quantity characteristics of the fluid supply apparatus; and converting a continuous flow of the fluid fed from the fluid supply apparatus to an intermittent flow by utilizing the pressure change caused by the fluctuation of the space of the clearance based on the relative movement of the two members for intermittently injecting the fluid from the discharge port to the discharge target.

According to a third aspect of the present invention, there is provided a fluid injection method as defined in the second aspect, wherein in a state that a distance between a substrate that is the discharge target disposed on an opposite face of the discharge port and a top end of a discharge nozzle having the discharge port at its top end is maintained 0.5 mm or longer, the fluid is intermittently injected to the substrate while flying from the discharge port of the discharge nozzle while the substrate and the discharge nozzle are relatively and continuously moved.

According to a fourth aspect of the invention, there is provided a fluid injection method as defined in the second aspect, wherein in a state that the fluid resistance portion is formed in the clearance between the two members, the fluid is fed through the fluid resistance portion to the clearance between the two members so as to be injected.

According to a fifth aspect of the invention, there is provided a fluid injection method as defined in the second aspect, wherein the fluid is injected in a state of 5 m/s<$V_{max}$<30 m/s when the following is defined:

$$T_1 = \frac{R_r R_n}{R_n + R_r}\frac{V_{s1}}{K}$$

$$V_{max} = \frac{R_r}{R_n + R_r}\frac{S_p}{S_n}\frac{|h_{st}|}{T_{st}}\left(1 - e^{-\frac{T_{st}}{T_1}}\right)$$

wherein a fluid resistance in the fluid resistance portion is $R_r$(kgs/mm$^5$), a fluid resistance in the discharge port is $R_n$(kgs/mm$^5$), a volume of a clearance portion in a portion enclosed by the fluid resistance portion to the two members is $V_{s1}$(mm$^3$), a bulk modulus of the fluid is K(kg/mm$^2$), a time necessary for stroke $h_{st}$ movement by the relative movement faces of the two members is $T_{st}$(s), an effective area of the relative movement faces of the two members is $S_p$(mm$^2$), an area of an opening portion of the discharge port is $S_n$, and a maximum flow quantity of the fluid passing an inner passage of the discharge port is $V_{max}$.

According to a sixth aspect of the present invention, there is provided a fluid injection method as defined in the first aspect, wherein the fluid is continuously injected from the discharge port in a state of $P_{st}/P_c$>1 when the following is defined:

$$T_1 = \frac{R_r R_n}{R_n + R_r}\frac{V_{s1}}{K}$$

$$P_c = \frac{R_r + R_n}{R_S + R_r + R_n}P_{S0}$$

$$P_{st} = \frac{R_n R_r}{R_n + R_r}S_p\frac{|h_{st}|}{T_{st}}\left(1 - e^{-\frac{T_{st}}{T_1}}\right)$$

wherein an internal resistance in the fluid supply apparatus is $R_s$(kgs/mm$^5$), a fluid resistance in the fluid resistance portion is $R_r$(kgs/mm$^5$), a fluid resistance in the discharge port is $R_n$(kgs/mm$^5$), a volume of a clearance portion in a portion enclosed by the fluid resistance portion to the two members is $V_{s1}$(mm$^3$), a bulk modulus of the fluid is K(kg/mm$^2$), a sum of a maximum pressure and an supplementary pressure of the fluid supply apparatus is $P_{s0}$(kgf/mm$^2$), a time necessary for stroke $h_{st}$ movement by the relative movement faces of the two members at a terminal end of continuous injection of the fluid is $T_{st}$(s), and an effective area of the relative movement faces of the two members is $S_p$(mm$^2$)

According to a seventh aspect of the present invention, there is provided a fluid injection method as defined in the first aspect, wherein the relatively moving two members are provided in a plurality of units, and the fluid is continuously injected or intermittently injected from the discharge port in a state of $T_1$<$T_2$ when the following is satisfied:

$$T_1 = \frac{R_r(R_n + R_p)}{R_n + R_p + R_r}\frac{V_{s1}}{K}$$

$$T_2 = \frac{R_s R_r}{R_s + R_r}\frac{V_{s2}}{K}$$

wherein an internal resistance in the fluid supply apparatus is $R_s$(kgs/mm$^5$), a fluid resistance in the fluid resistance portion is $R_r$(kgs/mm$^5$), a fluid resistance in a radius direction flow passage connecting the discharge port and peripheral portions of the relative movement faces is $R_p$(kgs/mm$^5$), a fluid resistance in the discharge port is $R_n$(kgs/mm$^5$), a volume of a clearance portion in a portion enclosed by the fluid resistance portion to the two members is $V_{s1}$(mm$^3$), a total volume that is a sum of a volume of a portion of the fluid supply apparatus filled with the fluid and a volume of the flow passage extending from the fluid supply apparatus to the fluid resistance portion is $V_{s2}$(mm$^3$), and a bulk modulus of the fluid is K(kg/mm$^2$).

According to an eighth aspect of the present invention, there is provided a fluid injection method as defined in the second aspect, wherein the fluid is intermittently flown and injected onto the substrate at a period in a range of $T_P$=0.1 to 30 msec when a viscosity of the fluid is μ>100 mPa·s, a diameter of powders contained in the fluid is ϕd<50 μm, the flow passage between the relatively moving two members is mechanically kept in a complete non-contact state, and a gap between the discharge nozzle that is the discharge port and the substrate that is the discharge target is kept in a state of H≧0.5 mm, during an injection process.

According to a ninth aspect of the present invention, there is provided a fluid injection method as defined in the first aspect, wherein the fluid is injected in a state of $T_1$≦30 msec when a volume of a clearance portion in a portion enclosed by the fluid resistance portion to the two members is $V_{s1}$(mm$^3$), a fluid resistance in the fluid resistance portion is $R_r$(kgs/mm$^5$), a fluid resistance in the discharge port is $R_n$(kgs/mm$^5$), a fluid resistance in a radius direction flow passage connecting the discharge port and peripheral portions of the relative movement faces of the two members is $R_p$(kgs/mm$^5$), a bulk modulus of the fluid is K(kg/mm$^2$), and a time constant $T_1$ is defined as:

$$T_1 = \frac{R_r(R_n + R_p)}{R_n + R_p + R_r}\frac{V_{s1}}{K}$$

According to a 10th aspect of the present invention, there is provided a fluid injection method as defined in the second aspect, wherein time intervals of each intermittent injection are different and the fluid is injected by setting pressure and flow quantity characteristics of the fluid supply apparatus corresponding to the time intervals of each intermittent injection.

According to an 11th aspect of the present invention, there is provided a fluid injection apparatus comprising:

a casing;

two members disposed in the casing, for relatively moving in a clearance direction of a clearance formed between relative movement faces so as to change a space of the clearance; and a fluid supply apparatus capable of adjusting a discharge quantity per dot by setting pressure and flow quantity characteristics for feeding a fluid to the clearance, the casing having a flow passage connecting the fluid supply apparatus and the two members and a fluid resistance portion disposed in the flow passage; wherein the fluid is fed to the clearance between the two members from the fluid supply apparatus through the fluid resistance portion and the fed fluid is intermittently injected or continuously injected from a discharge port to a discharge target by utilizing pressure change caused by fluctuation of the space of the clearance based on relative movement of the two members.

According to a 12th aspect of the present invention, there is provided a fluid injection apparatus as defined in the 11th aspect, wherein $V_{s1}<V_{s2}$ is satisfied wherein a volume of a clearance portion between the fluid resistance portion and a portion enclosed by the fluid resistance portion to the two members is $V_{s1}$, and a total volume that is a sum of a volume of a portion of the fluid supply apparatus filled with the fluid and a volume of the flow passage extending from the fluid supply apparatus to the fluid resistance portion is $V_{s2}$, and the fluid is continuously injected from the discharge port to the discharge target while beginning and terminal ends of a discharge line of the fluid injected from the discharge port are controlled by utilizing the pressure change caused by the fluctuation of the space of the clearance during continuous injection.

According to a 13th aspect of the present invention, there is provided a fluid injection apparatus as defined in the 11th aspect, wherein the fluid supply apparatus is a grooved pump portion for feeding the fluid to the clearance between the two members relatively moving in the clearance direction, axes of the relatively moving two members and an axis of the grooved pump portion are disposed at a slant, a continuous flow fed from the grooved pump portion is converted to an intermittent flow by utilizing the pressure change caused by the fluctuation of the space of the clearance, and an intermittent discharge quantity per dot is adjusted by setting a number of revolutions of the grooved pump portion for intermittent injection from the discharge port.

According to a 14th aspect of the present invention, there is provided a fluid injection apparatus as defined in the 11th aspect, wherein among the two members relatively moving in the clearance direction, the member on a moving side is a piston while the member on a fixed side is a cylinder, and a discharge-side top end of the piston is in a protruding taper shape while an inner face of the cylinder for housing the piston is in a recessed taper shape.

According to a 15th aspect of the present invention, there is provided a fluid injection apparatus as defined in the 11th aspect, wherein among the two members relatively moving in the clearance direction, the member on a moving side is a piston while the member on a fixed side is a cylinder, an outer surface of the piston and an inner face of the cylinder are a part of the flow passage, and the fluid resistance portion is disposed in the part of the flow passage.

According to a 16th aspect of the present invention, there is provided a fluid injection apparatus as defined in the 11th aspect, wherein among the two members relatively moving in the clearance direction, the member on a moving side is a piston while the member on a fixed side is a cylinder, the clearance is formed between the cylinder and the piston, the flow passage is disposed so as to connect the clearance and the fluid supply apparatus, and the fluid resistance portion is disposed in the flow passage in a vicinity of the clearance.

According to a 17th aspect of the present invention, there is provided a display panel comprising:

a first substrate that is a transparent substrate constituting a front plate;

a plurality of pairs of first linear transparent electrodes formed on the first substrate;

a second substrate constituting a rear plate;

a plurality of pairs of second linear electrodes formed on the second substrate so as to be orthogonal to the first linear transparent electrodes;

a plurality of pairs of barrier ribs formed on the second substrate so as to protrude in a state of holding the second linear electrodes; and independent cells formed by a plurality of pairs of the barrier ribs on the second substrate, wherein phosphor layers of R color, G color, and B color are each independently formed on inner faces of the respective independent cells, and top areas of ⅔ or more barrier ribs among a plurality of pairs of the barrier ribs are in a state without application of phosphor removal treatment for removing attached phosphors, and wherein specified images are displayed by disposing the two substrates so as to face each other with the barrier ribs interposed therein, the barrier ribs having the phosphor layers formed thereon, encapsulating an electric discharge gas in the barrier ribs, and applying a voltage to between the first linear electrodes and the second linear electrodes so as to cause plasma emission of the electric discharge gas at positions where the first linear electrodes and the second linear electrodes are orthogonal to each other.

According to an 18th aspect of the present invention, there is provided a display panel as defined in the 17th aspect, wherein top areas of ⅘ or more barrier ribs among a plurality of pairs of the barrier ribs are in a state without application of phosphor removal treatment for removing attached phosphors.

According to a 19th aspect of the present invention, there is provided a fluid injection apparatus as defined in the 11th aspect, wherein $\delta_r>5\times\phi d_{max}$ is satisfied when a maximum value of a diameter of particles contained in the fluid is $\phi d_{max}$, and a minimum clearance of the fluid resistance portion is $\delta_r$.

According to a 20th aspect of the present invention, there is provided a fluid injection apparatus as defined in the 14th aspect, wherein the discharge port is formed on a cylinder side which is an opposite face of an end face of the piston, and the end face of the piston and the cylinder for housing the piston are both in a taper shape.

Further, the present invention may be embodied in the following aspects.

According to another aspect of the present invention, there may be provided a fluid injection method and apparatus as defined in any one of the aspects, wherein the two members composed of the fixed side and the moving side are both in a taper shape, and the fluid is injected from the discharge port through the clearance portion formed by the two taper faces.

According to another aspect of the present invention, there may be provided fluid injection method and apparatus as defined in any one of the aspects, wherein a volume $V_{s1}$ of the clearance portion of a portion encircled by the fluid resistance portion to the two members is $0.35\ mm^3 < V_{s1} < 40\ mm^3$.

According to another aspect of the present invention, there may be provided fluid injection method and apparatus as defined in any one of the aspects, wherein the fluid supply apparatus is a pump with a flow quantity variable by a number of revolutions.

According to another aspect of the present invention, there may be provided fluid injection method and apparatus as defined in any one of the aspects, wherein the fluid supply apparatus is constituted of a grooved pump portion.

According to another aspect of the present invention, there may be provided fluid injection method and apparatus as defined in any one of the aspects, wherein a flow quantity per shot is set by changing a number of revolutions of the fluid supply apparatus.

According to another aspect of the present invention, there may be provided fluid injection method and apparatus as defined in any one of the aspects, wherein by utilizing the fact that a discharge target face is geometrically symmetric, a constant discharge quantity per dot is intermittently injected on a periodic basis while the discharge nozzle that is the discharge port and the substrate that is the discharge target travel relatively to each other.

According to another aspect of the present invention, there may be provided fluid injection method and apparatus as defined in any one of the aspects, wherein a discharge target face is a display panel.

According to another aspect of the present invention, there may be provided fluid injection method and apparatus as defined in any one of the aspects, which is applicable as a phosphor layer formation method for a plasma display panel in which while a dispenser having a discharge nozzle that is the discharge port is moved relatively to a substrate that is a discharge target having independent ribs encircled by barrier ribs and formed in a geometrically symmetric way, a phosphor paste as the fluid is intermittently injected from the discharge nozzle so that the phosphor paste is injected to an inside of the independent cells in sequence to form the phosphor layers.

According to another aspect of the present invention, there may be provided fluid injection method and apparatus as defined in any one of the aspects, wherein a fluid pressure produced by fluctuation of a space of a clearance between relative movement faces depending on the size of the space of the clearance is a primary squeeze pressure, while a fluid pressure produced by fluctuation of the space of the clearance not by depending on the size of the clearance but depending on the fluid resistance of the fluid resistance portion and the internal resistance of the fluid supply apparatus is a secondary squeeze pressure, and when a setting range of a minimum value or an average value $h_0$ of the clearance, in which a discharge quantity per dot $Q_s$ is largely influenced by the primary squeeze pressure, is $0<h_0<h_x$, and a setting range of the clearance $h_0$ in which the discharge quantity $Q_s$ is insensitive to change in the clearance $h_0$ is $h_0>h_x$, the clearance is set in the range of $h_0>h_x$ for intermittent injection.

According to another aspect of the present invention, there may be provided fluid injection method and apparatus as defined in any one of the aspects, wherein $h_0>0.05$ mm is satisfied wherein the minimum value or the average value of the clearance between the relative movement faces is $h_0$.

According to another aspect of the present invention, there may be provided fluid injection method and apparatus as defined in any one of the aspects, wherein a plurality pairs of time intervals of intermittent discharge are set by specified time ranges, and an identical number of pairs of numbers of revolutions of the fluid supply apparatus corresponding to the time intervals are set in advance for intermittent injection.

According to another aspect of the present invention, there may be provided fluid injection method and apparatus as defined in any one of the aspects, wherein the clearance between the two members is controlled so that the clearances before start of intermittent injection and after intermittent injection are almost identical, and that a rise time taken for the clearance to decrease for intermittent injection and a fall time taken for the clearance to increase after intermittent injection are almost identical.

BRIEF DESCRIPTION OF THE DRAWINGS

These and other aspects and features of the present invention will become clear from the following description taken in conjunction with the preferred embodiments thereof with reference to the accompanying drawings, in which:

FIG. 11A is a partially cross sectional front view showing a fluid injection apparatus according to a second embodiment of the present invention;

FIG. 11B is a partially cross sectional front view showing a fluid injection apparatus according to a modified example of the second embodiment of the present invention;

FIG. 36 is a view showing a conventional air pulse-type dispenser;

DETAILED DESCRIPTION OF THE PREFERRED EMBODIMENTS

Figure 1:
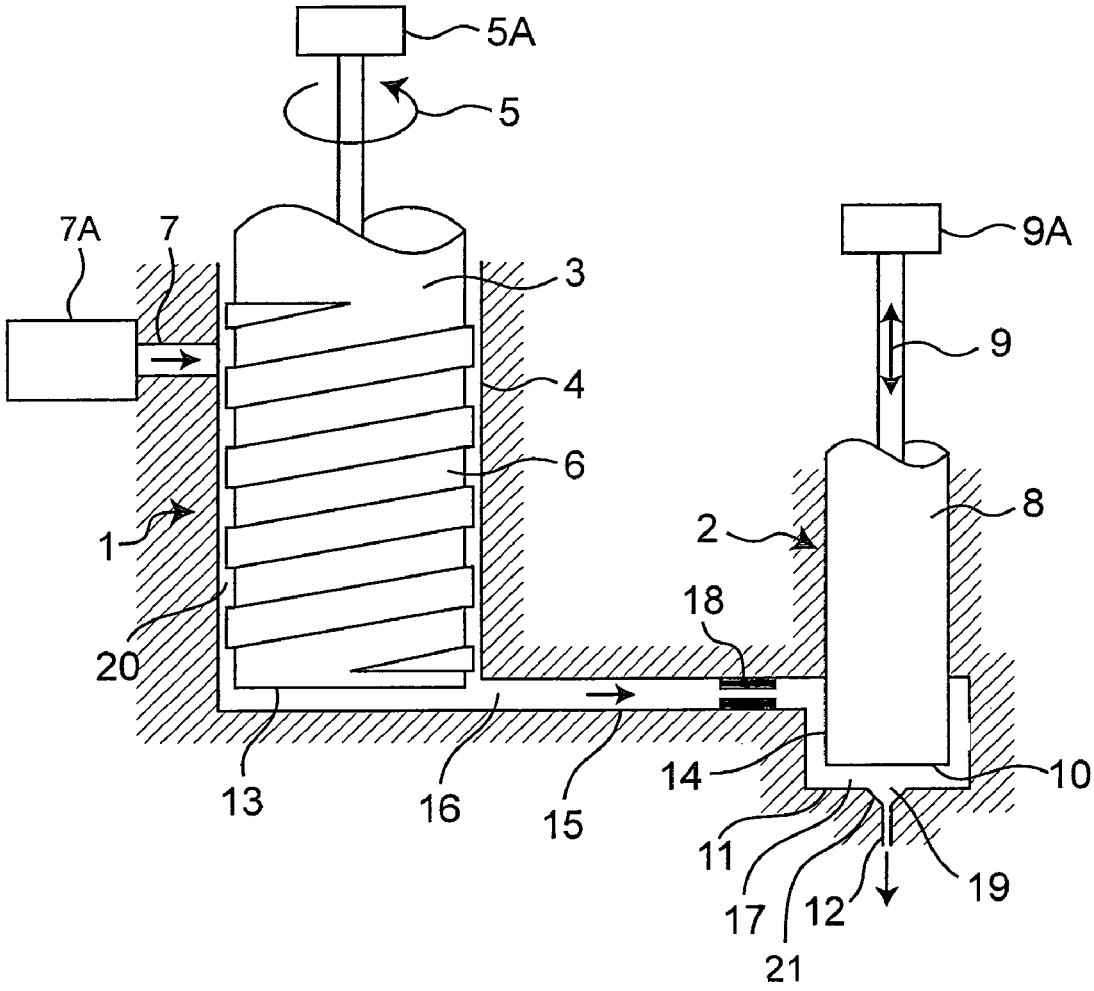
FIG. 1 is a partially cross sectional front view showing a model of an application example of a fluid injection apparatus for implementing a fluid injection method according to a first embodiment of the present invention.

Before the description of the present invention proceeds, it is to be noted that like parts are designated by like reference numerals throughout the accompanying drawings.

Hereinbelow, the embodiments of the present invention will be described in detail with reference to the drawings.

FIG. 1 is a model view showing a fluid injection apparatus according to a first embodiment of the present invention.

Reference numeral 1 denotes a thread grooved pump portion serving as one example of a fluid supply apparatus, and 2 a piston portion for generating squeeze pressure. Reference numeral 3 denotes a thread grooved shaft having a thread groove 6 on the outer peripheral face and housed in a housing 4, which serves as one example of a casing, movably in its rotational direction. The thread grooved shaft 3 is rotationally driven by a rotation transmission unit 5A such as motors as shown by an arrow 5. Reference numeral 6 denotes a thread groove formed on a relative movement face between the thread grooved shaft 3 and the housing 4, and 7 denotes a suction port of a compressible fluid for introducing the compressible fluid to the grooved pump portion 1 with an air pressure (supplementary pressure) $P_{sup}$ generated in a supplementary pressure generator 7A. Reference numeral 8 denotes a piston, which is moved by an axial driving unit 9A such as piezoelectric actuators in an axial direction as shown by an arrow 9. Reference numeral 10 denotes an end face of the piston 8, 11 a fixed-side opposite face thereof, and 12 a discharge nozzle serving as one example of the discharge port mounted on the housing 4. The piston end face 10 and the fixed-side opposite face 11 constitute two faces relatively moving in a clearance direction. A space formed by these two faces 10, 11 and the housing 4 is a discharge chamber.

Reference numeral 13 denotes a thread grooved shaft end portion, 14 a piston outer peripheral portion, and 15 a flow passage connecting the grooved shaft end portion 13 and the piston outer peripheral portion 14. A discharged fluid 16 is always fed to the piston portion 2 through the flow passage 15 from the grooved pump portion 1 serving as one example of the fluid supply apparatus.

The axial driving unit 9A is provided on the housing 4 along the axial direction of the piston 8 for giving changes to relative axial positions of both the members 8 and 4. The axial driving unit 9A enables a clearance h between the piston end face 10 and the opposite face 11 to change. When a minimum value of the clearance h of the piston end face 10 is $h=h_{min}$, a value of $h_{min}$ is set to be sufficiently large, e.g., $h_{min}$=245 μm in one working example of the first embodiment.

When the clearance h is changed at a high frequency, a fluctuating pressure is generated in a discharge chamber 17 that is a clearance portion between the piston end face 10 and the opposite face 11 due to later-described secondary squeeze effect found in the proposal (Japanese Patent Application No. 2002-286741 (U.S. patent application Ser. No. 10/673,495)). Reference numeral 18 denotes a throttle serving as one example of the fluid resistance portion formed in the flow passage 15 on the side of the piston portion 2. Further, a portion at a middle portion of the discharge chamber 17 and at a position of reference numeral 19 is referred to as an upstream side of the discharge nozzle 12 (opening portion of the suction nozzle), and a clearance portion formed by the thread groove 6 on the thread grooved shaft 3 and the housing 4 is referred to as a thread groove chamber 20. A constant quantity of fluid is continuously fed to the discharge chamber 17 by the grooved pump portion 1. An application example according to the first embodiment of the present invention is based on the idea that a fluid can be intermittently injected at high speed by analog-to-digital conversion of a continuous flow fed from the pump (analog flow) to an intermittent flow (digital flow) with use of the secondary squeeze effect while the clearance h between the piston end face 10 and the fixed-side opposite face 11 is kept to be sufficiently large.

[1] Theoretical Analysis

(1-1) Derivation of Basic Formula

In the present invention, extensive knowledge can be obtained from a basic formula for a squeeze pump (provisional name), i.e., a principle of the present invention. First, description will be given of the case where a fluid is incompressible.

Although the derivation method of the basic formula has already proposed by the inventor of the present invention in Japanese Patent Application No. 2002-286741 (U.S. patent application Ser. No. 10/673,495), the contents thereof will be restated herein.

Figure 2A:
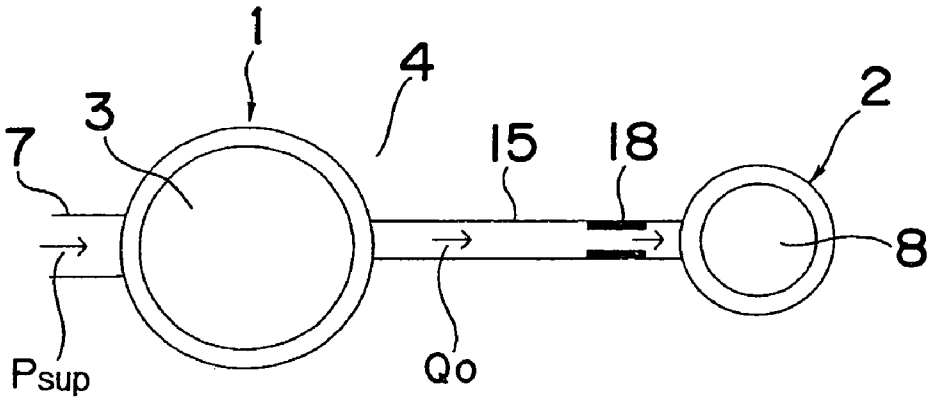
FIG. 2A is a top view showing the fluid injection.
Figure 2B:
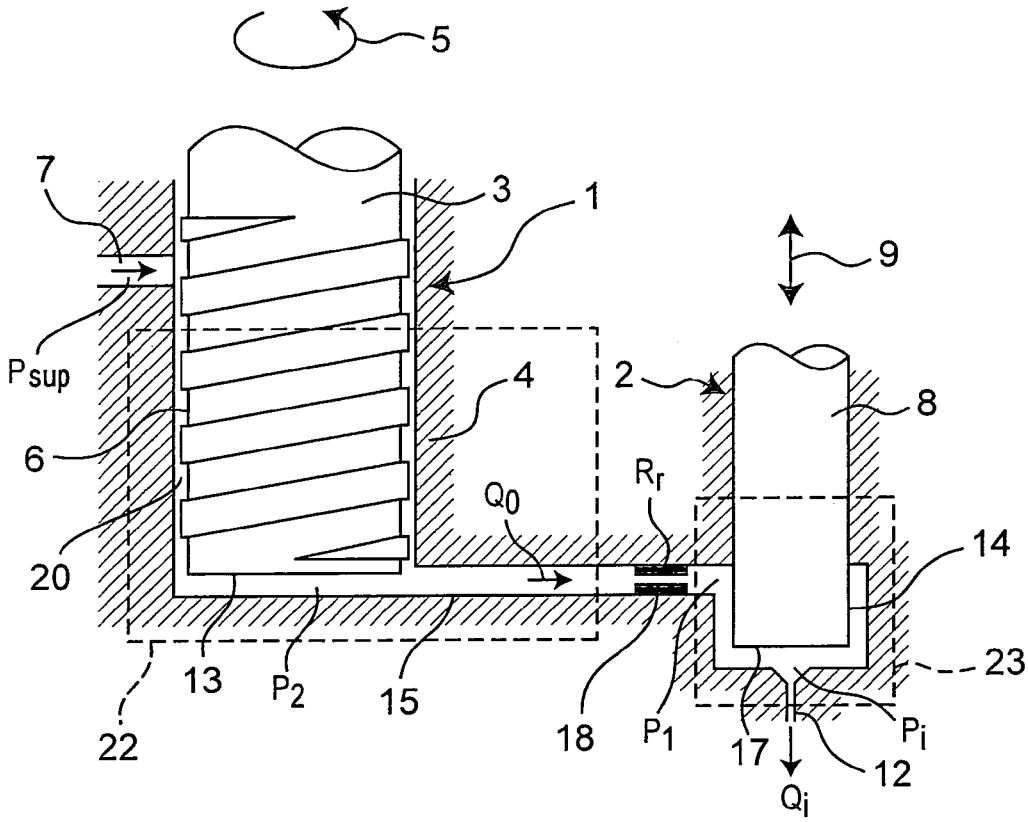
FIG. 2B is a partially cross sectional front view showing the fluid injection apparatus with symbols of pressure and flow quantity at each location.

A fluid pressure in the case where a viscous fluid is present in a narrow clearance between flat faces disposed facing each other and that the distance of the clearance changes as time advances is obtained by solving Reynolds equation in the following polar coordinates having a term of Squeeze action:

$$\frac{1}{r}\frac{d}{dr}\left(r\frac{h^3}{12\mu}\frac{dP}{dr}\right)=\frac{dh}{dt} \tag{1}$$

wherein p is a pressure, μ is a viscosity coefficient of fluid, h is a clearance between opposite faces, r is a position of radius direction, and t is time. Moreover, a right-hand side is a term which brings about the squeeze action effect generated when the clearance changes. FIG. 2A is a top view showing the apparatus, FIG. 2B is a view showing symbols of pressure and flow quantity at each location in a dispenser serving as one example of the fluid injection apparatus, and FIG. 2C is an enlarged view showing a piston portion 2 of FIG. 2B.

Figure 2C:
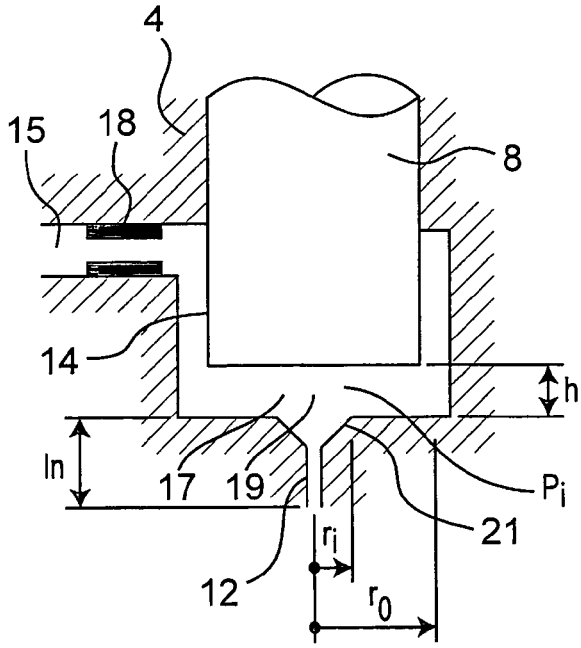
FIG. 2C is an enlarged cross sectional front view showing a piston portion.

It is to be noted that a suffix "i" in each symbol indicates that those represented by the symbol are values at a position of an opening portion 21 in the discharge nozzle 12 in FIG. 2C and a suffix "o" indicates that those represented by the symbol are values at a portion inside the discharge chamber 17 and at the lower end of the piston outer peripheral portion 14.

The following is obtained when both the sides of Equation (1) are integrated under the condition of $\dot{h}=dh/dt$:

$$\frac{dP}{dr}=\frac{12\mu}{h^3}\left(\frac{1}{2}\dot{h}r+\frac{c_1}{r}\right) \tag{2}$$

One more integration provides the following:

$$P=\frac{12\mu}{h^3}\left(\frac{1}{4}\dot{h}r^2+c_1\ln r\right)+c_2 \tag{3}$$

Now, undetermined constants $c_1$, $c_2$ will be obtained. $r=r_i$ indicates the position of an opening end of the discharge nozzle 12 on the side of the discharge chamber. Since the opening portion 21 is deeply hollowed out in a cone shape, the pressure can be considered to be constant in the range of $r<r_i$. The relation between a pressure gradient dP/dr and a flow quantity $Q_i$ in the case of $r=r_i$ (herein $Q_i$ refers to a flow quantity of a fluid at the position of the opening portion 21 in the discharge nozzle 12) is shown below:

$$Q_i=\frac{h^3\pi r_i}{6\mu}\left(\frac{dP}{dr}\right)_{r=ri} \tag{4}$$

By substituting Equation (4) into Equation (2), the undetermined constant $c_1$ is obtained:

$$c_1 = \frac{Q_i}{2\pi} - \frac{\dot{h}}{2} r_i^2 \tag{5}$$

By substituting Equation (5) into Equation (3), the undetermined constant $c_2$ is obtained from a boundary pressure condition $P=P_1$ in the case of $r=r_0$ ($P_1$ refers to a pressure $P_1$ on the side of the piston portion in the following equation). Herein, $r_0$ refers to a radius of the piston at a position inside the discharge chamber 17 and on the lower end of the piston outer peripheral portion 14 in FIG. 2C.

$$c_2 = p_1 - \frac{6\mu}{h^3}\left\{\frac{1}{2}\dot{h}r_0^2 + \left(\frac{Q_i}{\pi} - \dot{h}r_i^2\right)\ln r_0\right\} \tag{6}$$

By substituting Equations (5) and (6) into Equation (3), a pressure $P=P(r)$ at an arbitrary position in radial direction is obtained:

$$P(r) = \frac{12\mu}{h^3}\left\{\frac{1}{4}\dot{h}r^2 + \left(\frac{Q_i}{2\pi} - \frac{\dot{h}r_i^2}{2}\right)\ln r\right\} + p_1 - \frac{6\mu}{h^3}\left\{\frac{1}{2}\dot{h}r_0^2 + \left(\frac{Q_i}{\pi} - \dot{h}r_i^2\right)\ln r_0\right\} \tag{7}$$

The following is obtained when a pressure in the case of $r=r_i$ is set at $P=P(r_i)$ (herein $r_i$ refers to a radius of the piston at the position of the opening portion 21 in the discharge nozzle 12 in FIG. 2C):

$$P_i = p_1 - \frac{3\mu\dot{h}}{h^3}\left\{(r_0^2 - r_i^2) + 2r_i\ln\frac{r_i}{r_0}\right\} + \left(\frac{6\mu}{\pi h^3}\ln\frac{r_i}{r_0}\right)Q_i \tag{8}$$

The following is obtained by substituting $Q_i=P_i/R_n$ into Equation (8) for arrangement:

$$P_i = \frac{R_n}{R_n + R_p}\left[P_1 - \frac{3\mu\dot{h}}{h^3}\left\{(r_0^2 - r_i^2) + 2r_i^2\ln\frac{r_i}{r_0}\right\}\right] \tag{9}$$

Herein, when a nozzle radius of the discharge nozzle 12 is $r_n$, and a nozzle length thereof is $l_n$, the discharge nozzle resistance $R_n$ is obtained as follows:

$$R_n = \frac{8\mu l_n}{\pi r_n^4} \tag{10}$$

Further, $R_P$ is a fluid resistance (in a radial direction-flow passage connecting the discharge port and an outer peripheral portion of the piston serving as one example of the relative movement face) between an opening portion (21 in FIG. 2C) of the discharge nozzle 12 and a piston outer peripheral portion (piston outer peripheral portion 14 in FIG. 2C).

$$R_p = \frac{6\mu}{h^3\pi}\ln\frac{r_0}{r_i} \tag{11}$$

When a discharge-side pressure of the grooved pump portion 1 is $P_2$ and a fluid resistance of the throttle 18 formed in the flow passage 15 connecting the grooved pump portion 1 and the piston outer peripheral portion 14 is $R_r$, a flow quantity $Q_0$ flowing through the flow passage 15 is as shown below:

$$Q_0 = \frac{P_2 - P_1}{R_r} \tag{12}$$

Further, the following is obtained from the relation between a pressure gradient dP/dr of the piston end face 10 and a flow quantity $Q=Q_i$ in the case of $r=r_0$:

$$\begin{aligned} Q_0 &= \frac{h^3\pi r_0}{6\mu}\left(\frac{dp}{dr}\right)_{r=r0} \\ &= \pi\dot{h}r_0^2 + 2\pi c_1 \\ &= \pi\dot{h}(r_0^2 - r_i^2) + Q_i \end{aligned} \tag{13}$$

When the internal resistance of the grooved pump portion 1 is $R_s$, the discharge-side pressure $P_2$ in the grooved pump portion 1 is as shown below:

$$P_2 = P_{s0} - R_s Q_0 \tag{14}$$

wherein $P_{S0}$ is a pressure of the fluid supply apparatus and is equivalent to a sum ($P_{S0}=P_{sup}+P_{max}$) of a maximum developed pressure $P_{max}$ in the grooved pump portion 1 and an air supplementary pressure $P_{sup}$ for feeding a fluid or a material to be discharged to the thread groove 6.

From Equation (12) to Equation (14), the following is obtained:

$$P_1 = P_{s0} - (R_s + R_r)\{\pi\dot{h}(r_0^2 - r_i^2) + Q_i\} \tag{15}$$

By substituting the pressure $P_1$ on the side of the piston portion in Equation (15) into Equation (9) for arrangement, an opening portion pressure (discharge pressure) $P_i$ in the discharge nozzle 12 without consideration of compressibility of the fluid is obtained:

$$P_i = \frac{R_n}{R_n + R_p + R_S + R_r}(P_{S0} + P_{squ1} + P_{squ2}) \tag{16}$$

Herein, a primary squeeze pressure $P_{squ1}$ and a secondary squeeze pressure $P_{squ2}$ are defined as shown below:

$$P_{squ1} = -\frac{3\mu\dot{h}}{h^3}\left\{(r_0^2 - r_i^2) + 2r_i^2 \ln\frac{r_i}{r_0}\right\} \quad (17)$$

$$P_{squ2} = -(R_S + R_r)\pi\dot{h}(r_0^2 - r_i^2)$$

The primary squeeze pressure $P_{squ1}$, which is a pressure generated in between the piston end face 10 and its relative movement face or the fixed-side opposite face 11 by steeply changing a clearance h between the piston end face 10 and the fixed-side opposite face 11, is obtained by a known squeeze effect and is proportional to a piston velocity dh/dt while being in inverse proportion to the cube of the clearance h. The secondary squeeze pressure does not depend on an absolute value of the clearance h, and is in proportion to the piston velocity dh/dt and proportional to a sum of an internal resistance $R_s$ of a screw pump (grooved pump portion 1) and a resistance $R_r$ of the throttle 18.

(1-2) Derivation of Basic Formula in Consideration of Compressibility of Fluid

As described before, the derivation method of the basic formula for deriving the discharge pressure $P_i$ is similar to those already disclosed in the specification in Japanese Patent Application No. 2002-286741 (U.S. Pat. application Ser. No. 10/673,495). The later research conducted in strict comparison between theoretical values and actual measurement values of the discharge pressure (Japanese Patent Application No. 2003-036434 (U.S. patent application Ser. No. 10/776,278)) has proved that the compressibility possessed by the discharge fluid exerts a large influence on the "sharpness" of high-speed intermittent discharge in the following cases:

(i) Higher frequency of intermittent discharge (ii) Use of multi-head structure (iii) unignorable influence of bubbles entrapped in the discharge fluid (iv) Use of high elastic materials In the case where injection apparatuses adopt multi-head structure having a plurality of independent pistons, a total volume of the flow passages connecting the respective piston portions and a grooved pump portion serving as one example of the fluid supply apparatus cannot but become larger compared to an apparatus of standalone type (1 piston+1 nozzle type). In this case, if the fluid has a little quantity of compressibility, the influence thereof becomes unignorable. An influence of fluid capacitance, which is determined by the compressibility of the fluid and the total volume of the flow passages, exerted on the "sharpness" of the fluid discharge becomes significant as the frequency of intermittent discharge becomes higher. The compressibility of the fluid is largely influenced by, for example, entrapment of bubbles. In the case of high viscosity fluid in particular, bubbles once entrapped in the fluid are hard to remove therefrom. Moreover, some kinds of adhesive agents, such as rubber solutions, plastics, and latexes have low elastic modulus, and therefore their compressibility requires consideration.

The inventor of the present invention has conducted theoretical analysis in consideration of the compressibility of fluid materials in the proposal (Japanese Patent Application No. 2003-036434 (U.S. patent application Ser. No. 10/776,278)), and has found out that the following (i) and (ii) can be satisfied by selecting parameters and operation conditions of component parts of the dispenser:

(i) Conditions to achieve high-speed intermittent discharge (ii) Conditions to cut off the terminal end of a continuous discharge line with good sharpness The analysis result has proved that a size of the volume $V_s$ of the flow passage connecting the grooved pump portion serving as one example of the fluid supply apparatus and the piston portion exerts a large influence on response of discharge. When the dispenser of the proposal (Japanese Patent Application No. 2003-036434 (U.S. patent application Ser. No. 10/776,278)) is structured with, for example, a multi-head and the number of the multi-head is increased, the flow passage volume increases, thereby causing degradation of the discharge response. The solution for this issue is not stated in previously proposed Japanese Patent Application No. 2002-286741 (U.S. patent application Ser. No. 10/673,495) and Japanese Patent Application No. 2003-036434 (U.S. patent application Ser. No. 10/776,278).

The present invention is to provide the solution for this issue by forming a "throttle" serving as one example of the fluid resistance portion in the flow passage connecting the grooved pump portion serving as one example of the fluid supply apparatus and the piston portion, the throttle being positioned in the vicinity of the piston portion and having an opening portion sufficiently narrower than other parts of the flow passage. The presence of the "throttle" dissolves the delay of response caused by the volume on the side of the fluid supply apparatus.

Hereinbelow, the theoretical analysis will be conducted for describing the principle and the effect of the present invention.

Figure 3:
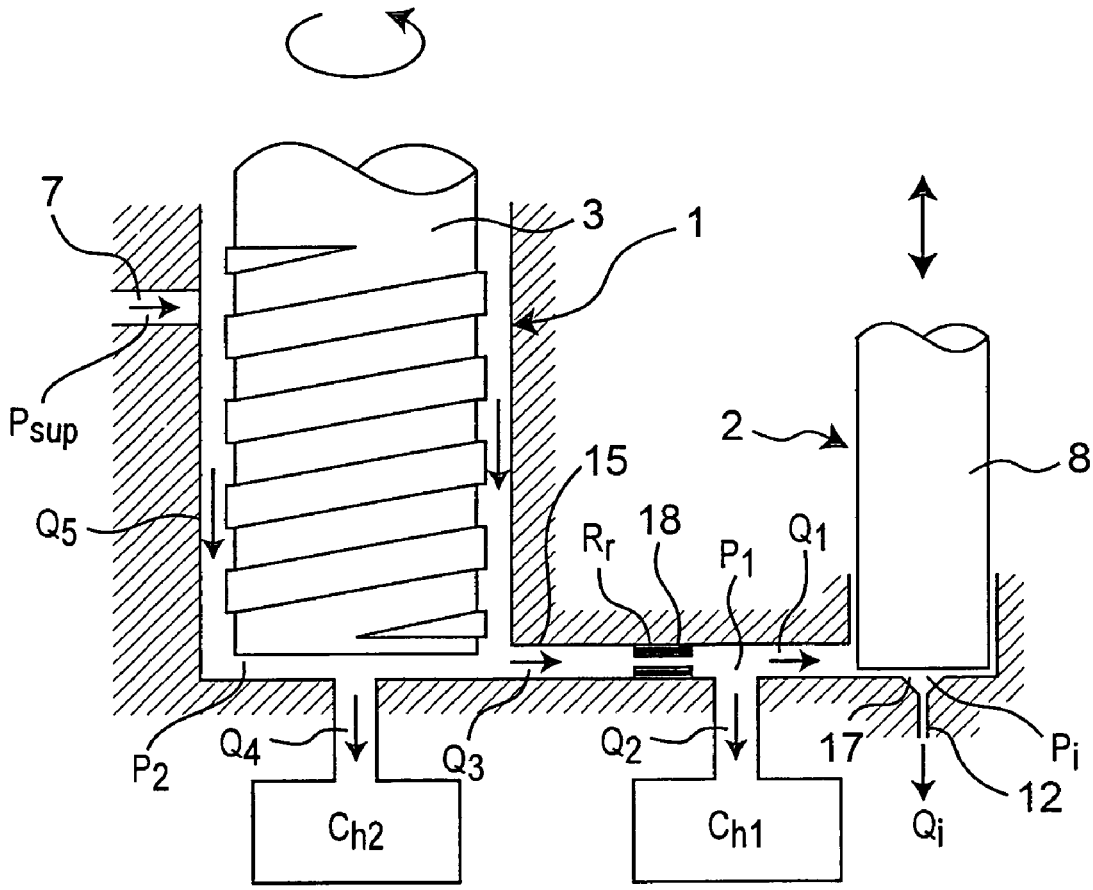
FIG. 3 is a partially cross sectional front view showing an analysis model in a case where compressibility of a fluid is taken into consideration.

There are assumed two fluid capacitances $C_{h1}(=V_{s1}/K)$ $C_{h2}(=V_{s2}/K)$ having volumes $V_{s1}$, $V_{s2}$ with the throttle 18 interposed therebetween. K represents a bulk modulus of fluid. In FIG. 2B, the volume $V_{s2}$ is a sum of a volume $V_{s11}$ of a portion of the grooved pump portion 1 filled with a fluid and a volume $V_{s22}$ of the flow passage 15 from the grooved shaft end portion 13 to the throttle 18 ($V_{S2}=V_{S11}+V_{S22}$), and represents the volume of a clearance portion encircled by a broken line 22. The volume $V_{s1}$ is the volume of a clearance portion from the throttle 18 to the discharge chamber 17 and represents the volume of the clearance portion encircled by a broken line 23. FIG. 3 shows a compressibility analysis model in consideration of these two fluid capacitances. A fluid with a flow quantity $Q_3$ flowing out from the throttle 18 diverges and flows into the fluid capacitance $C_{h1}$ side and the piston portion side.

$$Q_3 = Q_1 + Q_2 \quad (18)$$

A flow quantity $Q_1$ of a fluid flowing into the piston portion side is as shown below:

$$Q_1 = \pi\dot{h}(r_0^2 - r_i^2) + Q_i \quad (19)$$

A flow quantity $Q_2$ of a fluid flowing into the fluid capacitance $C_{h1}$ side is as shown below:

$$Q_2 = C_{h1}\frac{dP_1}{dt} \quad (20)$$

Therefore, the flow quantity $Q_3$ of the fluid flowing out from the throttle 18 is as shown below:

$$Q_3 = C_{h1}\frac{dP_1}{dt} + \pi\dot{h}(r_0^2 - r_i^2) + Q_i \tag{21}$$

The following is obtained from the relation between the flow quantity $Q_3$ of the fluid passing through the throttle 18 and a pressure difference $P_2-P_1$ between the discharge-side pressure $P_2$ in the grooved pump portion 1 and the piston portion-side pressure $P_1$:

$$Q_3 = \frac{P_2 - P_1}{R_r} \tag{22}$$

Further, the following is obtained from the relation between the piston portion-side pressure $P_1$ and the opening portion pressure (discharge pressure) $P_1$ in the discharge nozzle 12:

$$P_i = P_1 + P_{squ1} - R_p Q_i \tag{23}$$

By substituting $Q_i=P_i/R_n$ into Equation (23), the following is obtained:

$$P_i = \frac{R_n}{R_n + R_p}(P_1 + P_{squ1}) \tag{24}$$

$$Q_i = \frac{1}{R_n + R_p}(P_1 + P_{squ1}) \tag{25}$$

Equation (22) and Equation (25) are substituted into Equation (21) for arrangement so that a first order differential equation about the piston portion-side pressure $P_1$ is obtained as follows:

$$P_1 + T_1\frac{dP_1}{dt} = \frac{R_n + R_p}{R_n + R_p + R_r}(P_2 + P^*_{squ2}) - \frac{R_r P_{squ1}}{R_n + R_p + R_r} \tag{26}$$

wherein $T_1$ represents a time constant on the discharge side and $Q_{squ2}$ represents change in volume of the discharge chamber.

$$T_1 = \frac{c_{h1} R_r (R_n + R_p)}{R_n + R_p + R_r} \tag{27}$$

$P_{squ2}$ is equivalent to a secondary squeeze pressure in the case where consideration is given to the compressibility of fluid and a throttle $R_r$ is provided in the vicinity of the discharge chamber.

$$\begin{aligned} P^*_{squ2} &= R_r Q^*_{squ2} \\ &= -R_r \pi (r_0^2 - r_i^2)\dot{h} \end{aligned} \tag{28}$$

The pressure $P_2$ on the grooved pump portion side is as follows:

$$\begin{aligned} P_2 &= P_{s0} - R_s Q_5 \\ &= P_{s0} - R_s(Q_3 + Q_4) \\ &= P_{s0} - R_s\left(\frac{P_2 - P_1}{R_r} + c_{h2}\frac{dP_2}{dt}\right) \end{aligned} \tag{29}$$

From this equation, a first order differential equation about the pressure $P_2$ is obtained as follows:

$$P_2 + T_2\frac{dP_2}{dt} = \frac{R_r}{R_s + R_r}\left(P_{s0} + \frac{R_s}{R_r}P_1\right) \tag{30}$$

wherein $T_2$ represents a time constant on the side of the grooved pump portion 1.

$$T_2 = \frac{c_{h2} R_s R_r}{R_s + R_r} \tag{31}$$

By solving Equation (26) and Equation (30) as a system of differential equations, the pressures $P_1$, $P_2$ can be obtained. Moreover, by substituting the pressure $P_1$ into Equation (24), the discharge pressure $P_i$ can be obtained.

(1-3) Equivalent Circuit Model

Figure 4:
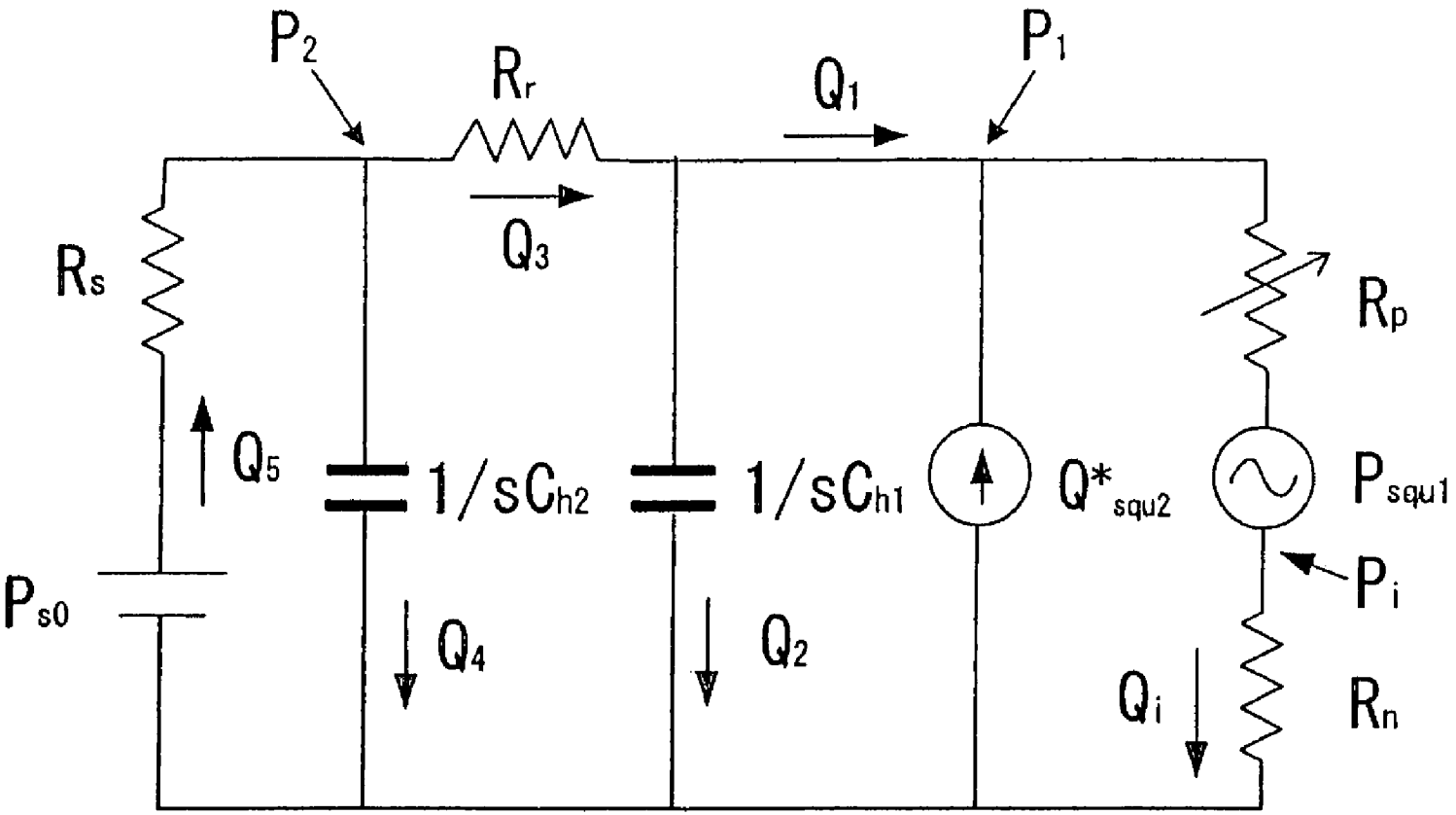
FIG. 4 is a view showing an equivalent electric circuit model in the application example of the present invention.

Based on the aforementioned analysis results, the relation between a pressure generator and a load resistance is expressed as an equivalent electric circuit model as shown in FIG. 4. In FIG. 4, $Q^*_{squ2}=P^*_{squ2}/R_r$.

[2] Embodiments

(2-1) Specific Embodiment

Figure 5A:
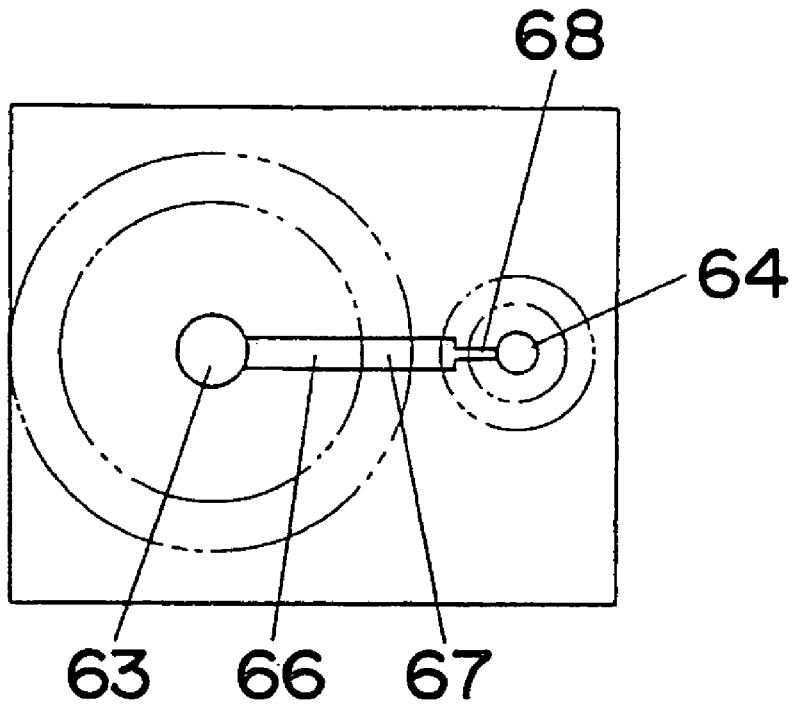
FIG. 5A is a top view showing the fluid injection apparatus according to the first embodiment of the present invention.
Figure 5B:
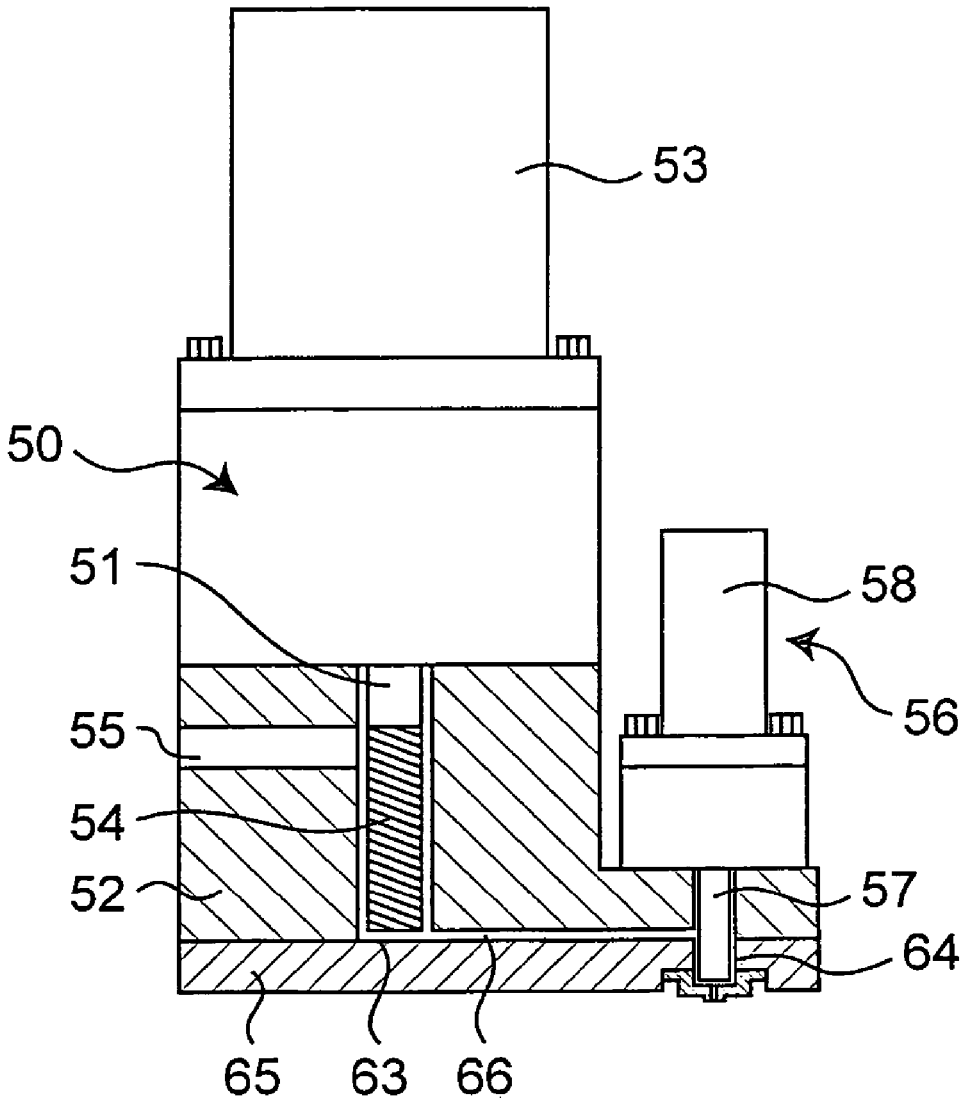
FIG. 5B is a partially cross sectional front view showing the fluid injection apparatus according to the first embodiment of the present invention.
Figure 6:
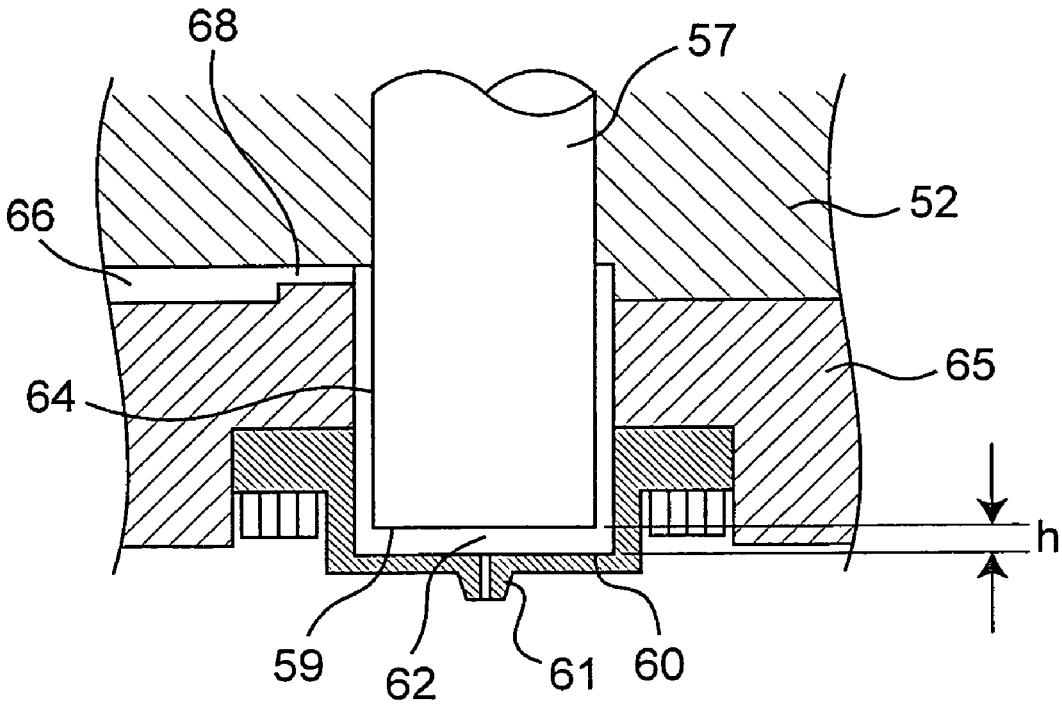
FIG. 6 is an enlarged cross sectional front view showing a piston portion in FIG. 5B.

FIG. 5A and FIG. 5B show a fluid injection apparatus according to the first embodiment of the present invention. FIG. 6 is an enlarged view showing a piston portion.

Reference numeral 50 denotes a grooved pump portion, and 51 a grooved shaft housed in a housing 52, which serves as one example of the casing, movably in rotational direction. The grooved shaft 51 is rotationally driven by a motor 53 serving as one example of a rotation transmission unit. Reference numeral 54 denotes a thread groove formed on a relative movement face between the grooved shaft 51 and the housing 52, and 55 a suction port of a fluid.

Reference numeral 56 denotes a piston portion, 57 a piston and 58 a piezoelectric actuator serving as one example of an axial driving unit 9A of the piston 57.

Reference numeral 59 denotes an end face of the piston 57, 60 a fixed-side opposite face, and 61 a discharge nozzle. The piston end face 59 and the fixed-side opposite face 60 constitute two faces which relatively move in clearance direction to form a discharge chamber 62 (corresponding to reference numeral 17 in the analysis mode in FIG. 3).

The piezoelectric actuator 58 gives changes to relative axial positions of the piston 57 and the fixed-side member. The piezoelectric actuator 58 enables a clearance h between the piston end face 59 and the fixed-side opposite face 60 to change. Reference numeral 63 denotes a grooved shaft end portion of the grooved shaft 51, 64 a piston outer peripheral portion of the piston 57, 65 a lower plate, and 66 a flow passage connecting the grooved shaft end portion 63 and the piston outer peripheral portion 64, which is formed in between the housing 52 and the lower plate 65. A fluid 67 to be discharged is constantly fed to the piston outer peripheral portion 64 through the flow passage 66 from the grooved pump portion 50 serving as one example of the fluid supply apparatus. Reference numeral 68 denotes a throttle (corresponding to the throttle 18 serving as one example of the fluid resistance portion having a fluid resistance $R_r$ in the analysis model in FIG. 3) serving as one example of the fluid resistance portion provided in the flow passage 66 in the vicinity of the piston outer peripheral portion 64. The throttle 68 in the first embodiment is, as shown in Table 1, structured to have a passage width of w=2 mm, a passage depth of b=0.097 mm, and a passage length 1=4 mm, which are sufficiently smaller than those of the flow passage 66 on the side of the grooved pump portion 1

(2-2) Analysis Result of the Embodiment

Figure 7:
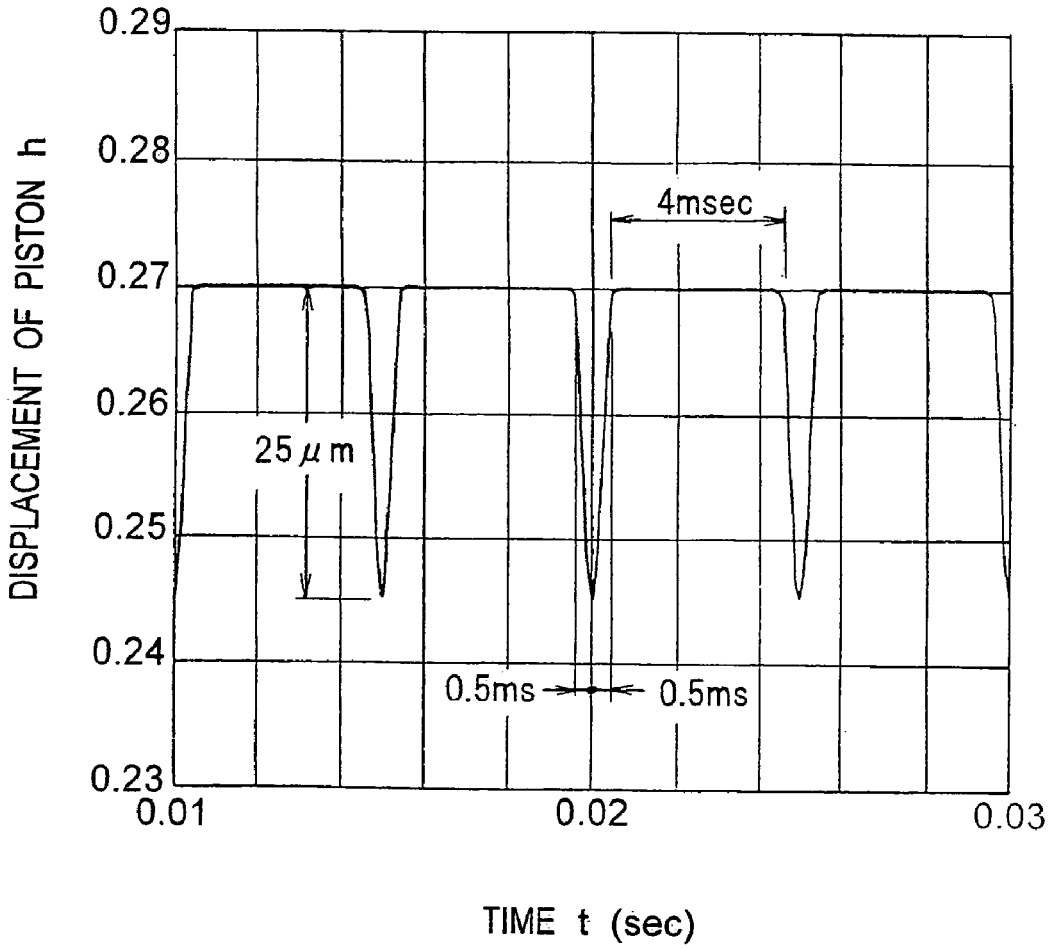
FIG. 7 is a graph view showing displacement of the piston against time.
Figure 8A:
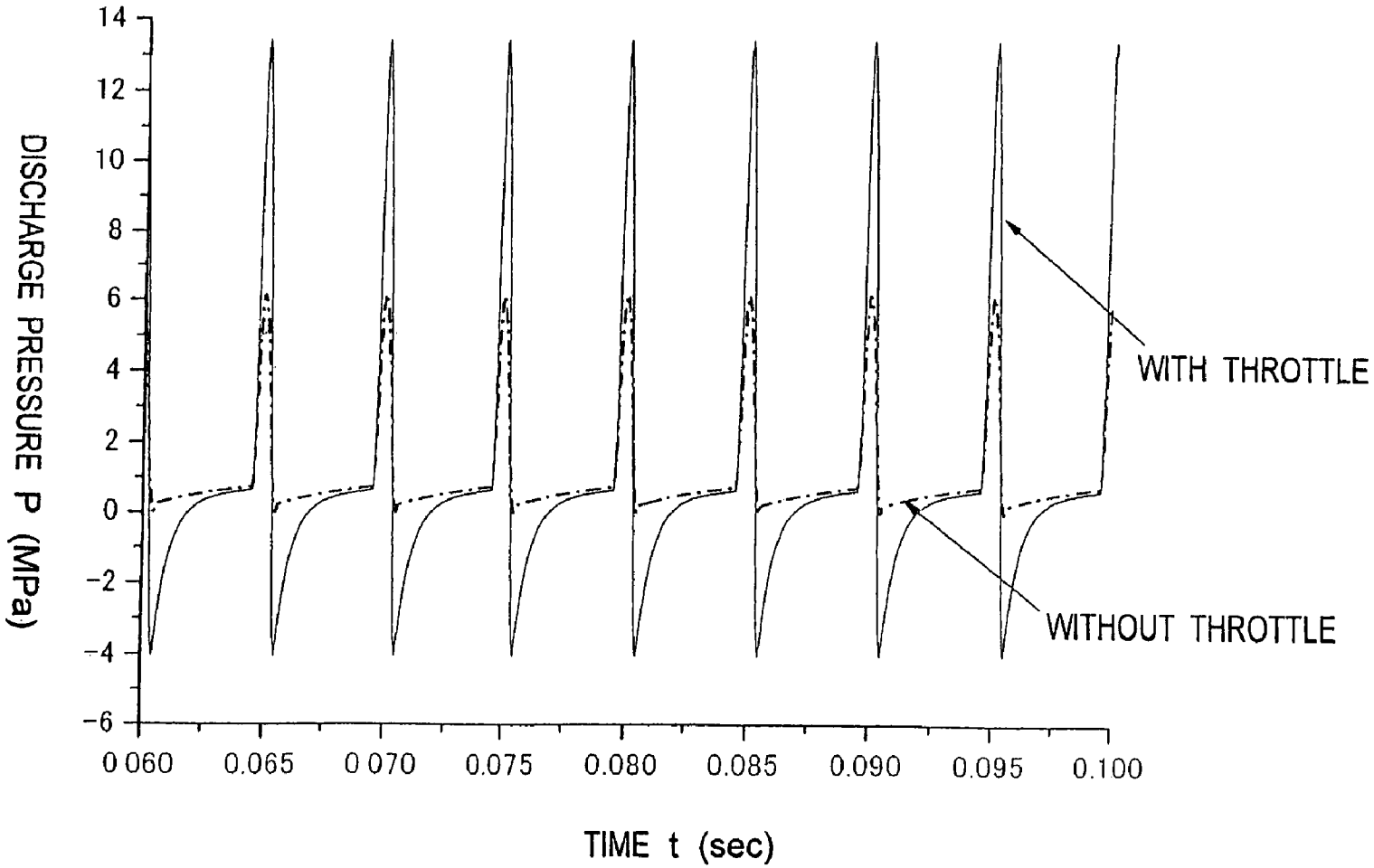
FIG. 8A is a graph view showing discharge pressure against time.

Shown below is the analysis result of pressures in the case where the dispenser serving as one example of the fluid injection apparatus according to the embodiment of the present invention is structured under the conditions shown in Table 1 and Table 2. It is to be noted that values of two fluid capacitances having volumes $V_{s1}$, $V_{s2}$ with the flow passage interposed therebetween are assumed to be $C_{h1}(=V_{s1}/K)=0.421$ $mm^5/kg$ and $C_{h2}(=V_{s2}/K)=1.02\ mm^5/kg$. FIG. 7 shows a driving waveform of the piston, which shows displacement of the piston (expressed as the size of the clearance h) against time. FIG. 8A shows the analysis result of the discharge pressure $P_i$ as a form of a graph showing the discharge pressure against time. In FIG. 8A, in addition to the pressure waveform in the case where the throttle 68 is formed (graph in solid line), a pressure waveform in the case where the throttle 68 is not formed (graph in chain line), i.e., in the case of $R_r \rightarrow 0$, is shown in comparison. As shown in FIG. 8A, in the case where the throttle 68 is formed, a peak pressure is $P_{max}$=13 Mpa, indicating that an extremely high pressure necessary for the fluid to fly is generated. Moreover, in the case where the throttle 68 is formed, a negative pressure immediately after discharge is $P_{min}<0$, indicating that a negative pressure sufficient enough for sucking the fluid, which flowed out from the discharge nozzle but remains in the top area of the discharge nozzle without flying immediately after discharge, into the inside of the discharge nozzle again is generated.

Figure 8B:
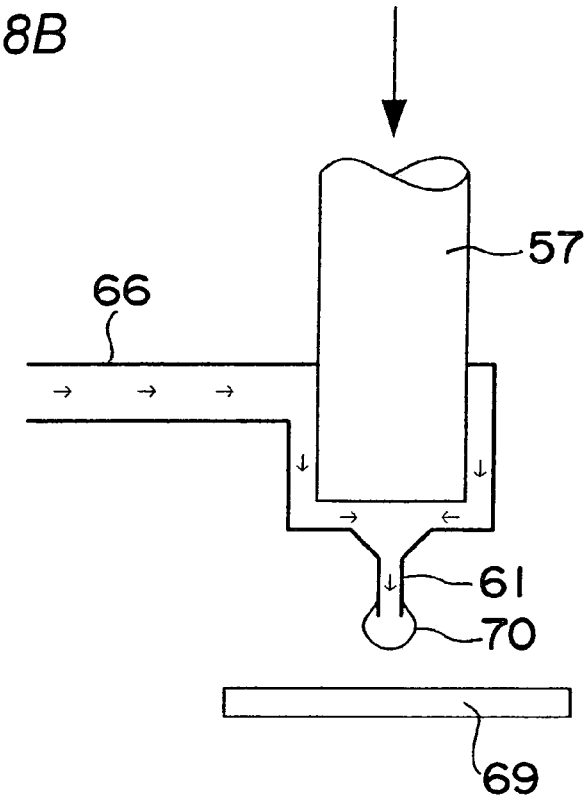
FIG. 8B is an image view showing a flowing-out state of a fluid from a discharge nozzle in the case where a throttle is not disposed.
Figure 8C:
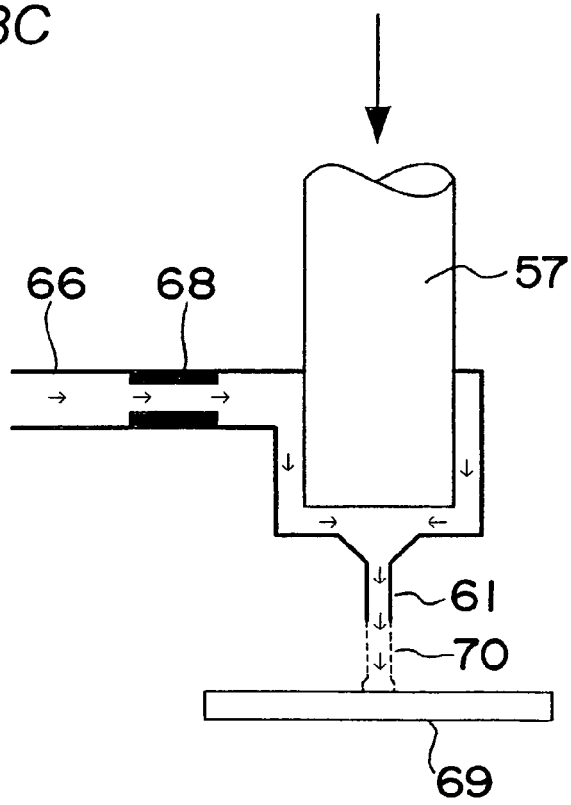
FIG. 8C is an image view showing a flowing state of a fluid from a discharge nozzle in the case where a throttle is disposed.

FIG. 8B and FIG. 8C show behaviors of a discharge fluid which has flowed out from the discharge nozzle 61 with and without the throttle 68 as image views. FIG. 8B shows the case where a throttle resistance is not applied and FIG. 8C shows the case where the throttle 68 is disposed to apply the throttle resistance. Reference numeral 69 denotes a substrate serving as one example of the discharge target disposed opposed to the discharge nozzle 61, and 70 a fluid to be discharged after flowing out from the discharge nozzle 61 to the substrate 69.

In the case shown in FIG. 8B, since a maximum developed pressure in the grooved pump portion 1, i.e., a developed peak pressure $P_{max}$, is low, a discharge fluid 70 flowed out from the discharge nozzle 61 adheres to the top of the discharge nozzle 61 as a fluid dollop without falling to the substrate 69 due to the influence of the surface tension.

Figure 9:
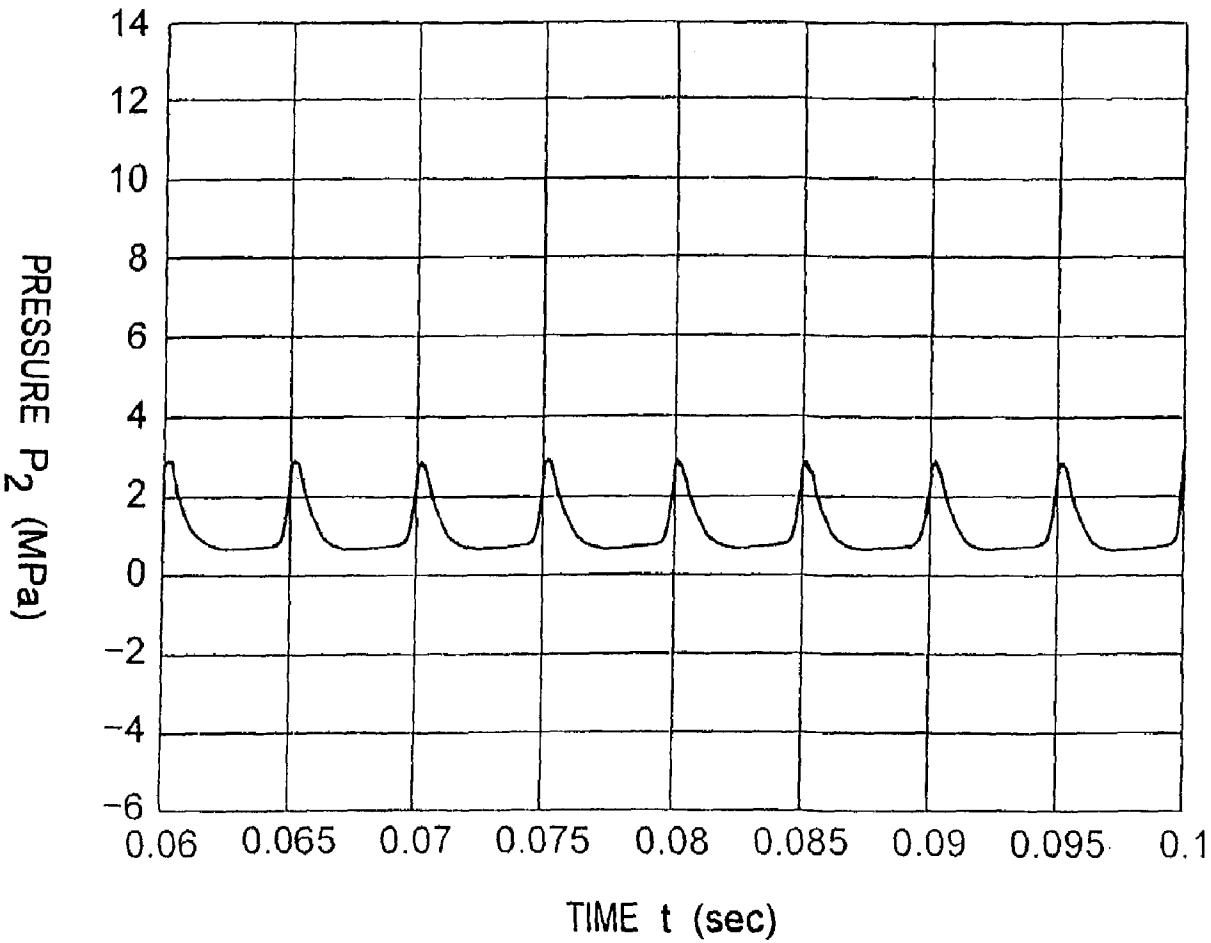
FIG. 9 is a graph view showing pressure under a thread groove against time.

FIG. 9 shows a waveform of the discharge-side pressure $P_2$ on the side of the grooved pump portion in the form of a graph showing the discharge-side pressure $P_2$ on the side of the grooved pump portion against time. Compared to the waveform of the pressure $P_1$ on the side of the piston portion in FIG. 8A, the amplitude of the pressure waveform is as small as $P_{max}$=3.0 MPa, $P_{min}$=0.9 MPa and a negative pressure is not generated.

The result indicates that due to the effect of a low-pass filter formed by the throttle 68 and the fluid capacitances $C_{h1}$, $C_{h2}$, a sharp squeeze pressure generated on the side of the piston portion is not sufficiently transmitted to the upstream side (grooved pump portion side). More particularly, the throttle 68 disposed in the vicinity of the piston portion 56 brings about the effect of confining generation of the discharge pressure having a shark peak pressure and the negative pressure to the vicinity of the piston portion 56.

TABLE 1

| Parameter | | Symbol | Specification |
|---|---|---|---|
| Viscosity | | μ | 760 cps |
| Performance of grooved pump portion | Max. flow quantity | $Q_{max}$ | 27.8 $mm^3/s$ |
| | Max. pressure | $P_{max}$ | 0.98 MPa (0.10 $kg/mm^2$) |
| Air supplementary pressure | | $P_{sup}$ | 0.188 MPa (0.019 $kg/mm^2$) |
| Piston outer diameter | | $D_o$ | 6 mm |
| Minimum clearance in piston end face | | $h_{min}$ | 245 μm |
| Driving conditions of Piston | Piston stroke | $h_{st}$ | 25 μm |
| | Rise time | $T_u$ | 0.5 ms |
| | Fall time | $T_d$ | 0.5 ms |
| | Period | $T_s$ | 5 ms |
| Specification of throttle | Passage width | w | 2 mm |
| | Passage depth | b | 0.097 mm (FIG. 8A. FIG. 9) |
| | Passage length | l | 4 mm |
| Discharge nozzle radius | | $r_n$ | 0.035 mm |
| Discharge nozzle length | | $l_n$ | 0.25 mm |

TABLE 2

| parameter | Symbol | Specification |
|---|---|---|
| Internal resistance in grooved pump portion | $R_s$ | $3.61 \times 10^{-3}$ $kgs/mm^5$ |
| Fluid resistance in throttle | $R_r$ | $2.07 \times 10^{-3}$ $kgs/mm^5$ |
| Fluid resistance between discharge nozzle opening portion and piston outer peripheral portion | $R_p$ | $2.73 \times 10^{-5}$ $kgs/mm^5$ |
| Fluid resistance of discharge nozzle | $R_n$ | $3.29 \times 10^{-2}$ $kgs/mm^5$ |
| Time constant on piston portion side | $T_1$ | $8.20 \times 10^{-4}$ s |
| Time constant on grooved pump portion side | $T_2$ | $1.34 \times 10^{-3}$ s |

Figure 10:
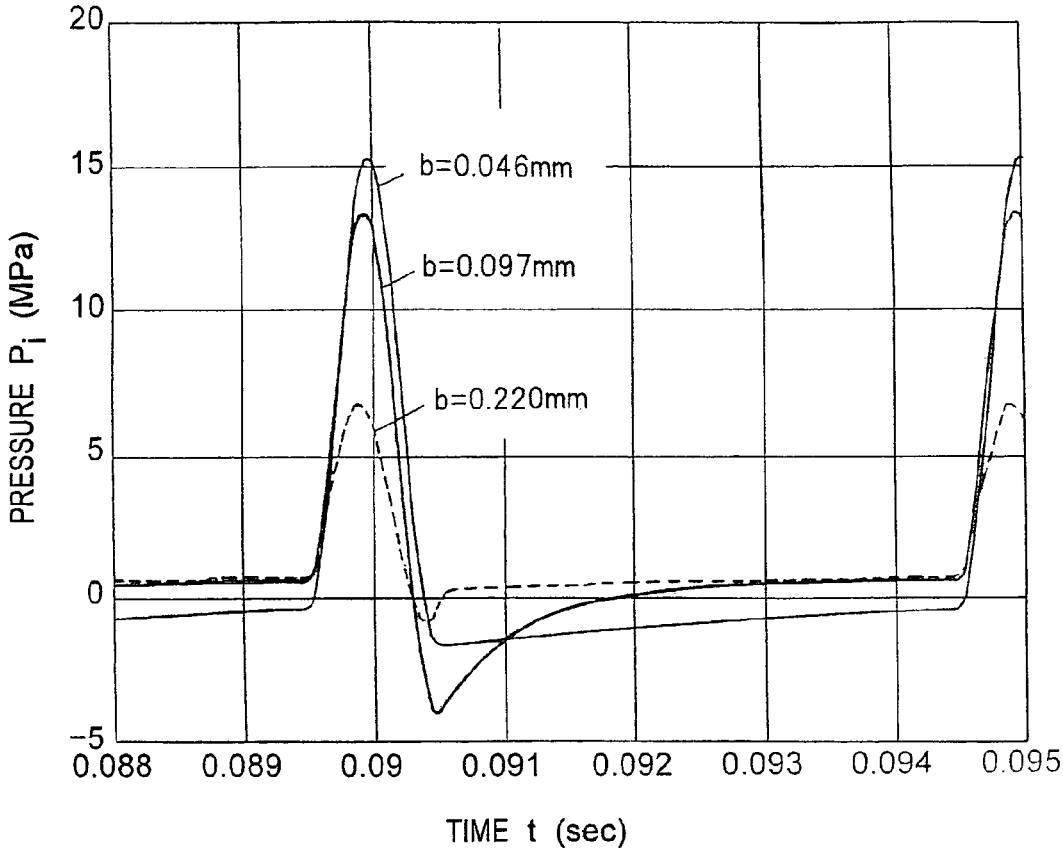
FIG. 10 is a graph view showing discharge pressure against time with a throttle depth as a parameter.
Figure 1:
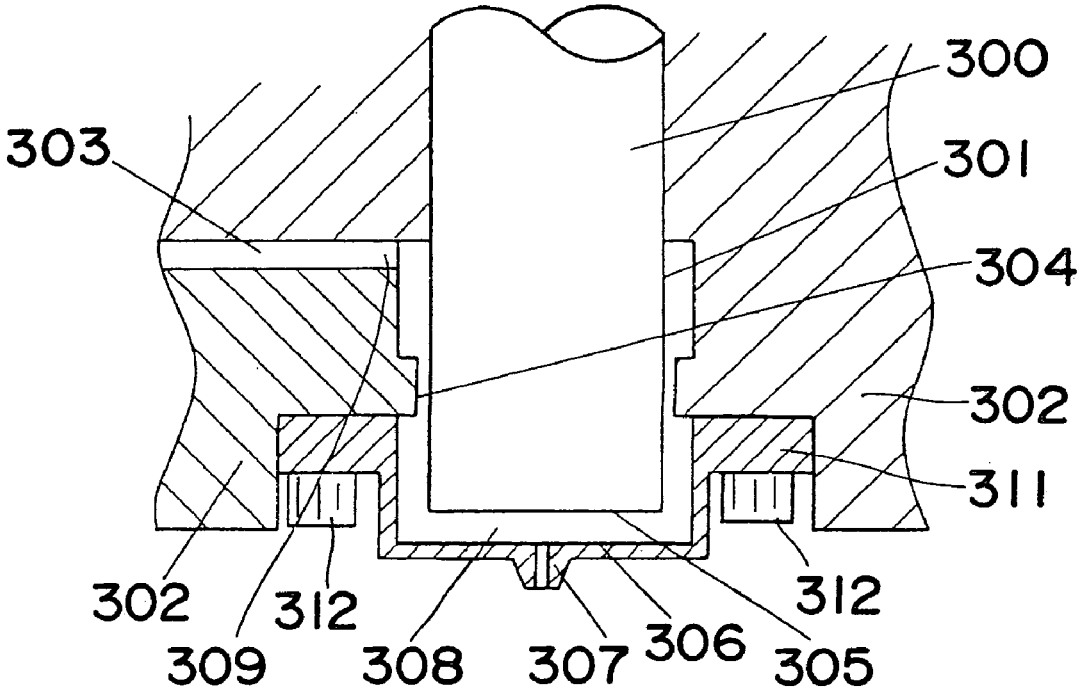
Figure 1:
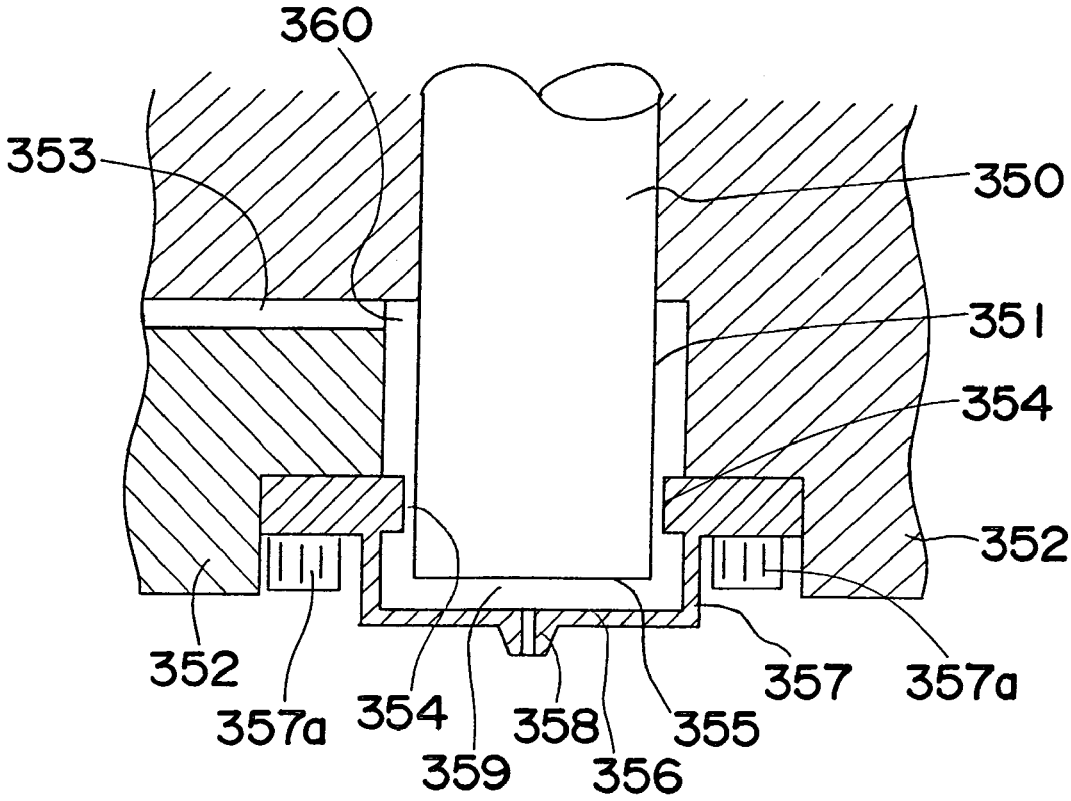

FIG. 10 shows comparison of waveforms of a discharge pressure with only the flow passage depth b of the throttle being changed and other specifications being intact in the form of a graph showing the discharge pressure against time with a throttle depth as a parameter.

Listed below are conditions required for high-speed intermittent discharge:

(i) a high peak pressure is available during discharge operation (ii) a sufficient negative pressure is generated after the discharge operation (iii) a discharge pressure returns to a supply pressure by the end of the suction step From the viewpoints of the conditions (i) to (iii), the discharge pressure waveforms are evaluated.

A fluid resistance $R_r$ of the throttle in this case is as shown below:

$$R_r = \frac{12\mu l}{wb^3} \tag{32}$$

In the case where the throttle depth is b=0.220 mm, the pressure is as low as $P_{max}$=6.5 MPa, and the level of a negative pressure generated after the end of discharge operation is also small. In the case where the throttle depth is b=0.097 mm, the pressure increases to $P_{max}$=13 MPa, and also a sufficiently large negative pressure is generated. In the case where the throttle depth is b=0.046 mm, the pressure increases to $P_{max}$=15 MPa while a negative pressure generation level decreases slightly, and the pressure still fails to return to the supply pressure after the end of the suction step (t=0.0945 s at the beginning of the next discharge step). As a result of this analysis, it is proved that there is an optimum throttle resistance for satisfying the (i) to (iii) at the same time.

In the first embodiment, a ratio of the volumes $V_{s1}$, $V_{s2}$ of two fluid capacitances provided in the flow passage 15 with the throttle 18 interposed therebetween is $V_{s1}/V_{s2}=C_{h1}/C_{h2}=0.421/1.02=0.413$ and so $V_{s1}<V_{s2}$. As is clear from the comparison of the waveforms of the pressures $P_1$ and $P_2$ (FIG. 8A and FIG. 9), providing the throttle 18 with a throttle resistance $R_r$ in the vicinity of the discharge chamber 17 dynamically separates the discharge side (piston portion 2 side) from the fluid supply apparatus side (served as one example of the grooved pump portion 1 side). As a result, the volume $V_{s2}$ on the side of the fluid supply apparatus does not excise a large influence over the response of the discharge pressure. This effect of the fluid supply apparatus according to the first embodiment of the present invention becomes prominent in the case of the multi-head structure (later described) having a plurality of the piston portions 2 and a larger number of flow passages 15 which are connected to the grooved pump portion 1 of the fluid supply apparatus and the respective piston portions 2.

It is to be noted that by setting the time constant on the side of the piston portion at $T_1 \leqq 30$ ms, the dispenser of the present invention becomes advantageous in terms of response compared to the conventional dispensers, and becomes applicable to various uses.

(2-3) Other Methods for Forming Throttle Resistance (Second and Third Embodiments)

Second Embodiment

FIG. 11A shows a fluid injection apparatus according to a second embodiment of the present invention, in which a throttle resistance is formed in between a piston outer peripheral portion and its opposite face. It is to be noted that the structure of the grooved pump portion side not shown in FIG. 11A is similar to that in the previous embodiment.

Reference numeral 300 denotes a piston, 301 a piston outer peripheral portion, 302 a lower plate, 303 a flow passage connecting a grooved shaft end portion and the piston outer peripheral portion 301, and 304 a throttle (corresponding to the throttle 18 having the fluid resistance $R_r$ in the analysis model in FIG. 3) formed in between the piston outer peripheral portion 301 and the lower plate 302. Reference numeral 305 denotes an end face of the piston 300, 306 its fixed-side opposite face, 307 a discharge nozzle, 308 a discharge chamber, and 309 an opening end of the flow passage 303 on the side of the piston portion. Further, reference numeral 311 denotes a discharge portion having a nozzle 307 and removably fixed onto the lower plate 302 with a plurality of bolts 312.

The throttle 304 is formed in between the piston outer peripheral portion 301 and the lower plate 302 on the side close to the discharge chamber 308. With this, a volume $V_{s1}$ (i.e., fluid capacitance $C_{h1}$) of a space formed by the lower end portion of the piston 300 and the fixed-side opposite face 306 can be minimized, which allows further increase in response.

FIG. 11B shows a fluid injection apparatus according to a modified example of the second embodiment of the present invention, in which a throttle resistance is formed in a discharge portion mountable or dismountable from the outside.

Reference numeral 350 denotes a piston, 351 a piston outer peripheral portion, 352 a lower plate, 353 a flow passage connecting a grooved shaft end portion and the piston outer peripheral portion 351, and 354 a throttle (corresponding to the throttle 18 having a fluid resistance $R_r$ in the analysis model in FIG. 3) formed in between the piston outer peripheral portion 351 and the lower plate 352. Reference numeral 355 denotes an end face of the piston 350, 356 its fixed-side opposite face, 357 a discharge portion removably fixed onto the lower plate 352 with a plurality of bolts 357*a*, 358 a discharge nozzle, 359 a discharge chamber, and 360 an opening end of the flow passage. The throttle 354 is formed in between the piston outer peripheral portion 351 and the discharge portion 357 on the side close to the discharge chamber 359. With this, a volume $V_{s1}$ (i.e., fluid capacitance $C_{h1}$) of a space on the discharge side can be minimized while at the same time, after the discharge portion 357 is dismounted from the lower plate 352 without disassembling the dispenser mainframe by unscrewing a plurality of the bolts 357*a*, a discharge portion 357 allowing formation of a throttle 354 having the most suitable throttle resistance in compliance with discharge conditions can be selected (in other words, the previously mounted discharge portion 357 is replaced with another discharge portion 357 having a throttle 354 different in inner diameter from the throttle 354 of the previous discharge portion 357), and a plurality of the bolts 357*a* can be screwed again to mount the selected discharge portion 357 on the lower plate 352.

In each case in the aforementioned embodiments or the modified example, what is necessary is to form the throttle 354 in between the end face 355 of the piston 350 and the opening end 360 of the flow passage 353 and in between the piston outer peripheral portion 351 and its opposite face. Further, a protruding portion for forming the throttle 354 may be formed on either one of the piston side (shaft side) and the fixed-side (housing side) for housing the piston, or on both the sides.

Third Embodiment

Figure 12A:
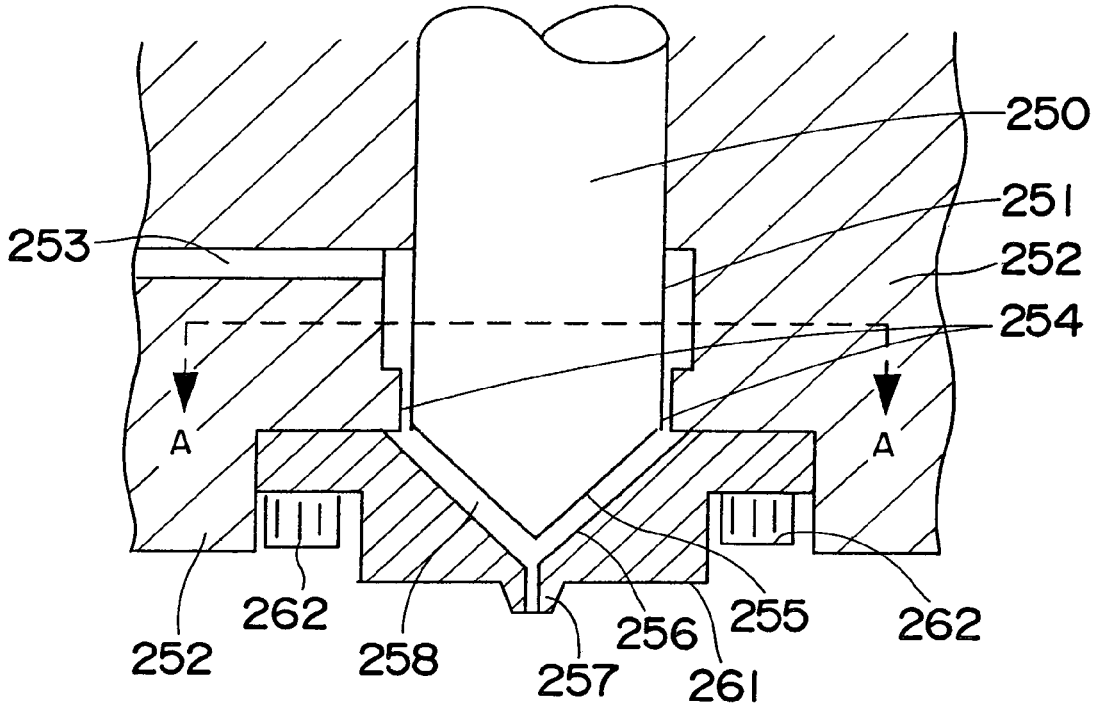
FIG. 12A is a partially cross sectional front view showing a fluid injection apparatus according to a third embodiment of the present invention.
Figure 12B:
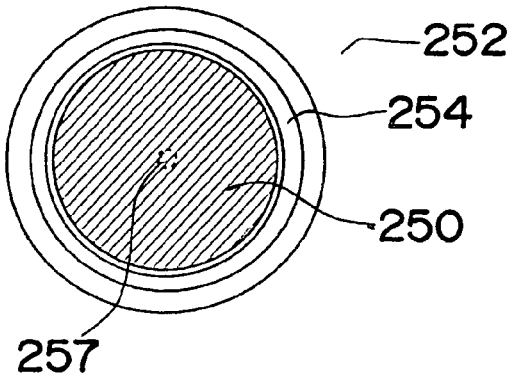
FIG. 12B is a cross sectional view taken along a line A-A in FIG. 12A.

FIG. 12A shows a fluid injection apparatus according to a third embodiment of the present invention, in which the top end of a piston is formed into a taper shape which is gradually narrowed down toward the top end, and a throttle is formed in the vicinity of a discharge chamber. FIG. 12B is a cross sectional view taken along the line A-A in FIG. 12A.

Reference numeral 250 denotes a piston, 251 a piston outer peripheral portion, 252 a lower plate, 253 a flow passage connecting a grooved shaft end portion and the piston outer peripheral portion 251, and 254 a throttle (corresponding to the throttle 18 having a fluid resistance $R_r$ in the analysis model in FIG. 3) formed in between the piston outer peripheral portion 251 and the lower plate 252 (a part of the flow passage 253). Reference numeral 255 denotes a conical end face of the piston 250, 256 a fixed-side opposite face formed into a taper shape (cone shape), 257 a discharge nozzle, and 258 a discharge chamber. Moreover, reference numeral 261 denotes a discharge portion having a nozzle 257 and removably fixed onto the lower plate 252 with a plurality of bolts 262. Thus, by forming a space between the piston end face 255 and its fixed-side opposite face 256 into a taper shape, it becomes possible to lead a fluid to the discharge nozzle 257 more smoothly, thereby making it possible to avoid trouble such as clogging of the nozzle in the case where powder and granular materials are used as the fluid.

[2] Fourth Embodiment with Multi-Head Structure

The dispensers in the above-described embodiments are of single head structure having one pump portion serving as one example of the fluid supply apparatus and one piston driving portion such as piezoelectric actuator serving as one example of an axial driving unit 9A. In a fluid injection apparatus (served as one example of dispensers) according to a fourth embodiment of the present invention, description will be given of a method for further increasing the production rate of heads.

In the case of PDP panels, for example, a phosphor layer formed on both a front panel and a rear panel is formed by screen printing method, photo lithography method, or the like.

In order to solve the aforementioned issues regarding the screen printing method and the photo lithography method, there are strong demands for establishing direct patterning method using dispensers. However, in the case where a phosphor layer is formed on the panel face on the front plate or the rear plate with use of the dispenser, the production rate equal to that in the screen printing is still demanded.

In the case of applying the fluid injection apparatuses in the embodiments of the present invention to the process of intermittently injecting phosphors into box-type cells, "multi-head structure" becomes a necessary condition in addition to the aforementioned discharge process conditions: (i) constant discharge quantity per dot; (ii) constant period; and (III) extremely high-speed discharge.

Figure 13A:
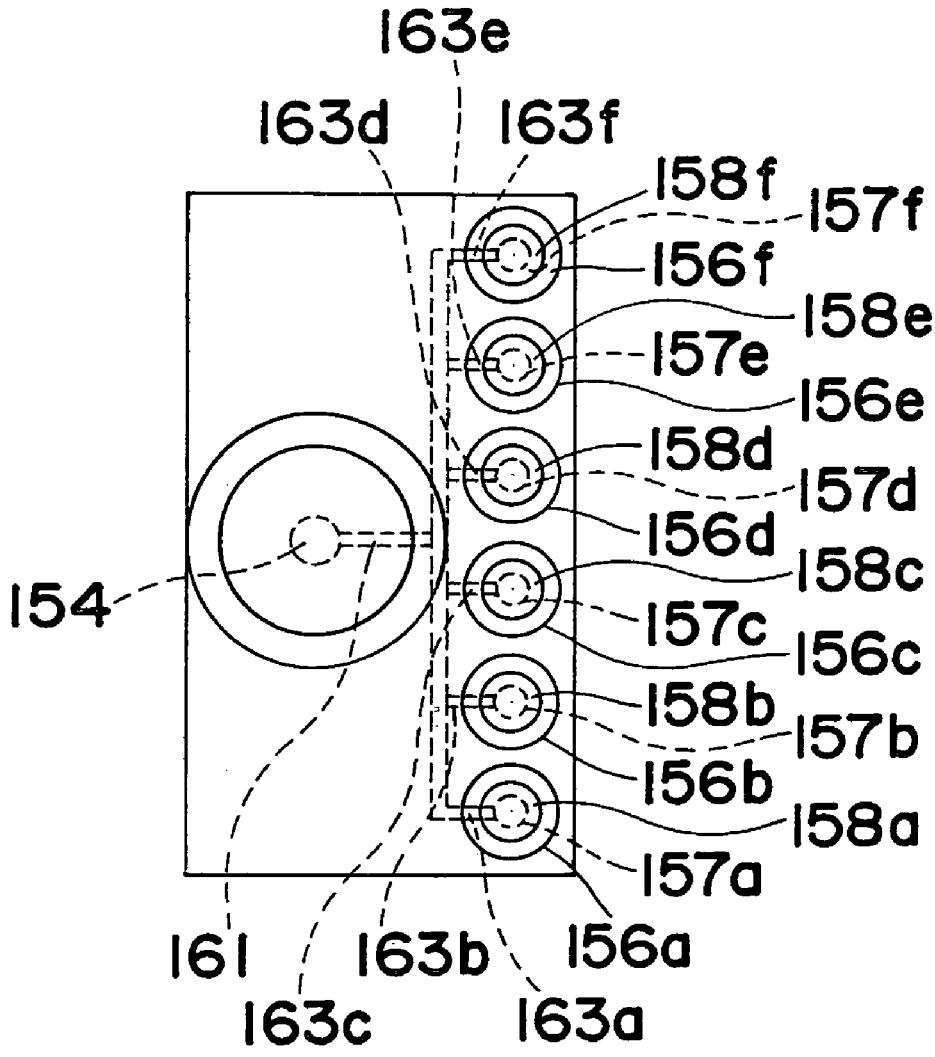
FIG. 13A is a top view showing a multi-head-type fluid injection apparatus according to a fourth embodiment of the present invention.
Figure 13B:
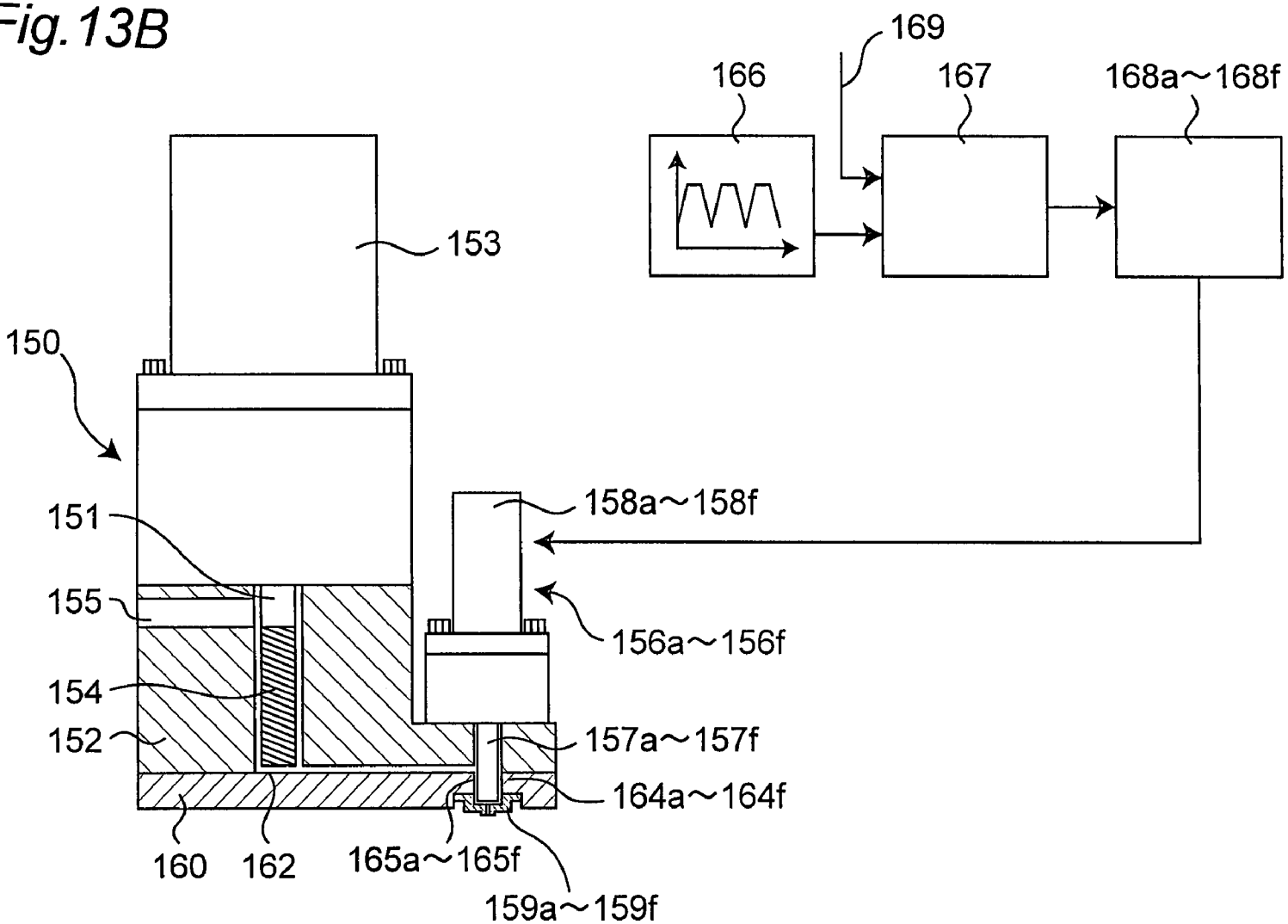
FIG. 13B is a partially cross sectional front view showing the fluid injection according to a fourth embodiment in FIG. 13A.
Figure 13C:
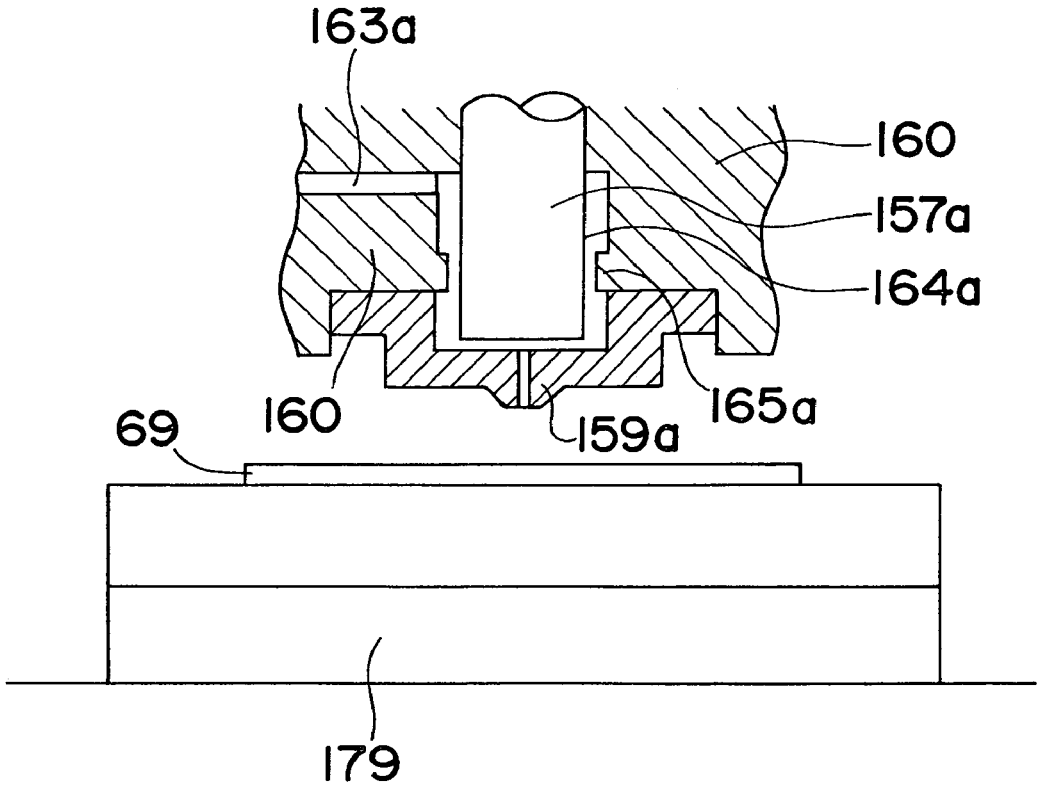
FIG. 13C is an enlarged view showing a discharge port area of the fluid injection apparatus according to the fourth embodiment in FIG. 13A.

FIG. 13A and FIG. 13B show the fluid injection apparatus according to the fourth embodiment of the present invention, which is the fluid injection apparatus having multi-head structure. FIG. 13C is an enlarged view showing the vicinity of the piston portion in FIG. 13B.

Reference numeral 150 denotes a grooved pump portion, and 151 a grooved shaft housed in a housing 152 serving as one example of the casing, movably in rotational direction. The grooved shaft 151 is rotationally driven by a motor serving as one example of a rotation transmission unit 153. Reference numeral 154 denotes a thread groove formed on a relative movement face between the grooved shaft 151 and the housing 152, and 155 a suction port of a fluid. Reference numerals 156*a* to 156*f* denote six piston portions sharing an identical structure as shown in FIG. 13C, 157*a* to 157*f* six pistons in the piston portions 156*a* to 156*f*, 158*a* to 158*f* six piezoelectric actuators serving as one example of axial driving units 9A which are piston driving portions of six respective pistons 157*a* to 157*f*, and 159*a* to 159*f* six discharge nozzles. Reference numeral 160 denotes a lower plate, and 161 a common flow passage connected to a grooved shaft end portion 162. A fluid is fed from the common flow passage 161 to six piston outer peripheral portions 164*a* to 164*f* through six separate flow passages 163*a* to 163*f*. These flow passages 161, 163*a* to 163*f* are formed in between the housing 152 and the lower plate 160. Reference numerals 164*a* to 164*f* denote piston outer peripheral portions and 165*a* to 165*f* throttles formed between the piston outer peripheral portions 164*a* to 164*f* and their respective opposite faces. In the piston portions 156*a* to 156*f*, piezoelectric actuators 158*a* to 158*f* sharing an identical structure and pistons 157*a* to 157*f* independently driven by these actuators 158*a* to 158*f* are disposed. A fluid is fed from the grooved pump portion 150 to discharge chambers of the respective piston portions 156*a* to 156*f* through the common flow passage 161, the separate flow passages 163*a* to 163*f*, and the throttles 165*a* to 165*f*.

As described in the fourth embodiment, when the injection apparatus is structured such that the pump portion 1 serving as one example of the fluid supply apparatus is separated from the piston portions 156*a* to 156*f*, divergently supplying a fluid from a single set of the pump portion 1 to a plurality of the piston portions 156*a* to 156*f* makes it possible to realize discharge heads having multi-heads which achieve synchronized discharge.

FIG. 13B shows one example of the simplified control block diagram of the fluid injection apparatus according to the fourth embodiment. Reference numeral 166 denotes a command signal generator for providing driving methods of the piezoelectric actuators 156*a* to 156*f*, 167 a control controller, 168*a* to 168*f* six drivers serving as driving power sources of six piezoelectric actuators 156*a* to 156*f*, and 169 position data from a linear scale provided in a stage 179 (see FIG. 13C) for holding objects such as substrates or discharge targets and being moved in XY two orthogonal directions with respect to the multi-head positionally fixed. Based on command signals regarding predetermined rising waveforms, falling waveforms, intermittent periods, amplitudes, minimum clearances, and the like of the six pistons 157*a* to 157*f* as well as the position data 169 from the linear scale which detects relative speeds and relative positions of the injection apparatus and the substrate, the six piezoelectric actuators 156*a* to 156*f* are driven independently and in synchronization if necessary by the six drivers 168*a* to 168*f* through the control controller 167, by which a fluid fed from a single grooved pump portion 150 is discharged in synchronization from the discharge nozzles 159*a* to 159*f* of the six piston portions 156*a* to 156*f* through the common flow passage 161, the separate flow passages 163*a* to 163*f*, and the throttles 165*a* to 165*f*.

Figure 14:
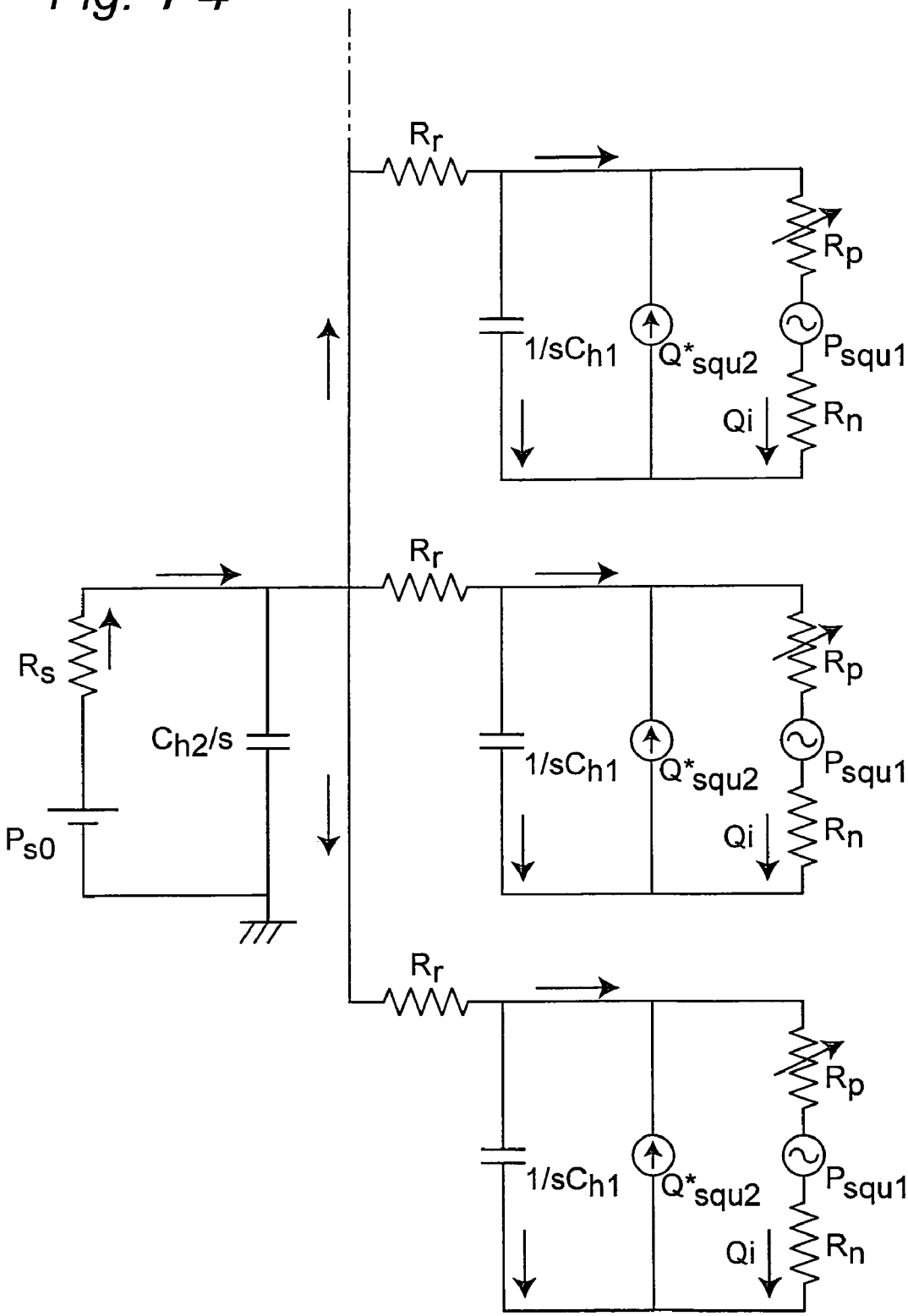
FIG. 14 is a view showing an equivalent electric circuit model of the fluid injection apparatus according to the fourth embodiment of the present invention.

As shown in the description of the fourth embodiment, by adopting the multi-head structure in which a single set of the pump 1 serving as one example of the fluid supply apparatus is disposed for a plurality of number of the pistons, drastic downsizing of the entire apparatus becomes possible. FIG. 14 shows an equivalent electric circuit in the case of the multi-head structure.

Although downsizing of the pump portion serving as one example of the fluid supply apparatus is generally limited, small-size piezoelectric actuators or the like is applicable to the piston driving portion, and so with the multi-head structure, a pitch of nozzles can be sufficiently decreased.

Moreover, in the case of the multi-head structure with the present invention applied thereto, an independent throttle (throttle resistance $R_r$) is put on the respective piston driving portions so that the following is expected.

(i) Secondary squeeze pressure in proportion to the level of the throttle resistance $R_r$ (Equation (28)) can be generated in each discharge chamber independently.

(ii) Since the time constant $T_1$ on the discharge side is in proportion to the fluid capacitance $C_{h1}(=V_{s1}/K)$, i.e., the volume $V_{s1}$ of the discharge chamber, the time constant $T_1$ (Equation (27)) on the discharge side which exercises a large influence over the response of discharge can be sufficiently decreased.

In the case of the multi-head structure, as is clear from FIG. 13A, the volume $V_{s2}$ on the side of the fluid supply apparatus increases as the number of heads becomes larger. More particularly, $V_{s1} \ll V_{s2}$. Therefore, the time constant $T_2$ on the side of the fluid supply apparatus also increases and becomes $T_1 \ll T_2$, though this does not exerts a large influence on the response of the discharge side.

(iii) Absence of the limitation of the number of heads in the multi-head structure allows enhancement of productivity.

It is to be noted that the level of the throttle resistance $R_r$ of the throttles put on the respective head portions may be changed by locations. For example, for further equalization of the discharge quantity, the levels of the throttle resistances of the throttles 165*a* and 165*f* far away from the grooved pump portion 150 may be set smaller than the throttle resistance of the throttles 165*c* or 165*d* close to the grooved pump portion 150 in consideration of the different resistances in the flow passages.

Moreover, with use of the multi-head shown as one example in FIG. 13A and FIG. 13B as a sub-unit, a plurality of the sub-units may be combined to structure the injection apparatus.

Figure 35A:
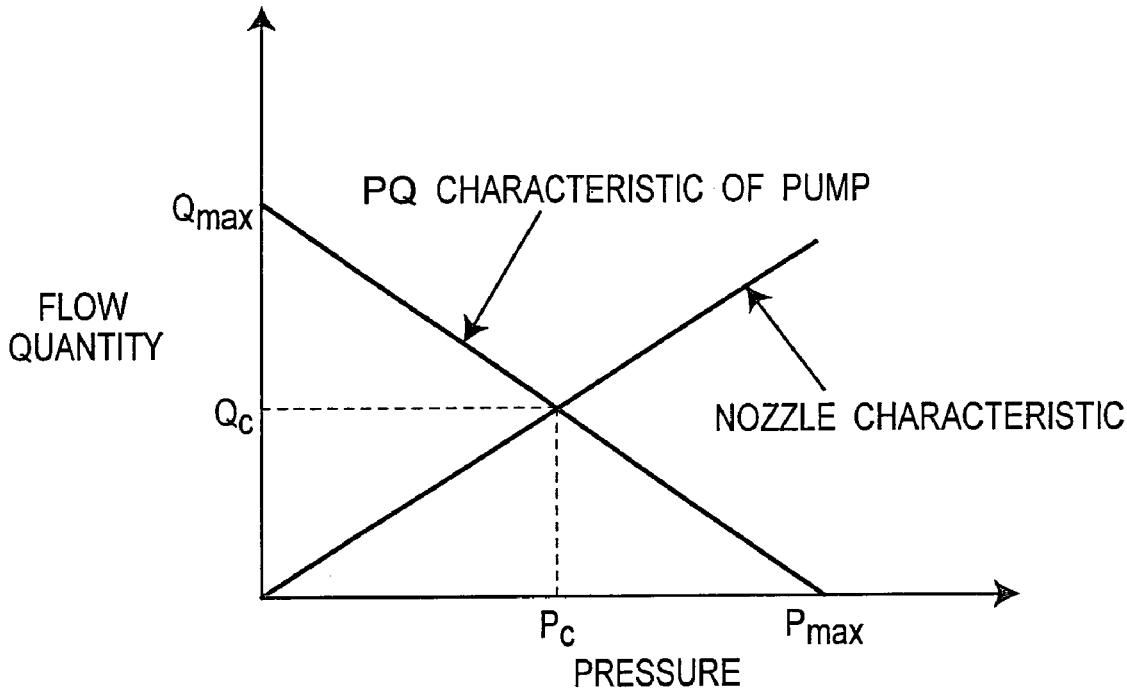
FIG. 35A is a view showing a PQ characteristic of the pump in FIG. 34.

The application examples of the above-described first to the fourth embodiments of the present invention are for achieving intermittent discharge by setting a clearance in the piston end face to be sufficiently large so that a continuous flow (analog flow) fed from the fluid supply apparatus is AD-converted to an intermittent flow (digital flow) with use of only the secondary squeeze pressure in the region where influence of the primary squeeze pressure is small. In this case, the discharge quantity per dot does not depend on the stroke and the displacement of a piston, but is determined by an operating-point flow quantity $Q_C(=P_c/R_n)$ which is determined by the pressure flow quantity characteristics of the pump serving as one example of the fluid supply apparatus and the discharge nozzle fluid resistance (see FIG. 35A). Therefore, constant discharge quantity per dot, constant period, ultrahigh-speed intermittent discharge.

The present discharge method offers an extremely effective means to the discharge process which are required to achieve the above-described (i) to (iii) at the same time.

For example, the method is effective in the case where R, G, and B phosphors are intermittently discharged into the box-type cells on the rear plate of a plasma display panel (hereinbelow referred to as a PDP panel) for color display. In the case of the PDP panel, the box-type cells are disposed on the panel in geometrically symmetric and matrix state with high accuracy. In this case, what is required is to shoot a constant quantity of materials into cells at identical time intervals at high speed, which is largely different from the requirements of the methods widely used in circuit formation and the like. More particularly, in the application example of the embodiment in the present invention, attention is focused on "geometrical asymmetry" of the discharge target and discharge operation is performed by replacing the asymmetry with "periodicity of time" so as to realize ultrahigh-speed intermittent discharge on a few millisecond time scale or of 1 millisecond or shorter.

[3] Reason Why Intermittent Discharge Quantity is Determined by Operating Point of the Grooved Pump Portion

(3-1) Basic Concept

In the dispenser serving as one example of the fluid injection apparatus according to the embodiment of the present invention, the intermittent discharge quantity per dot can be set by adjustment of the pressure and the flow quantity characteristics of the fluid supply apparatus. The reasons thereof will be described below.

When a minimum clearance $h_{min}$ in the piston end face is set to be sufficiently large, $R_p \to 0$ with $h \to \infty$ from Equation (11), $P_{squ1} \to 0$ from Equation (17), and $P_i = P_1$ from Equation (24), so that Equation (26) leads to the following:

$$P_i + T_1 \frac{dP_i}{dt} = \frac{R_n}{R_n + R_r}(P_2 + P_{squ2}) \tag{33}$$

If it is assumed that pressure fluctuation on the grooved pump side is sufficiently decreased by the effect of a low-pass filter of the throttle and the volume, the following is satisfied:

$$P_2 \approx \frac{(R_r + R_n)P_{s0}}{R_s + R_r + R_n} \tag{34}$$

Figure 15:
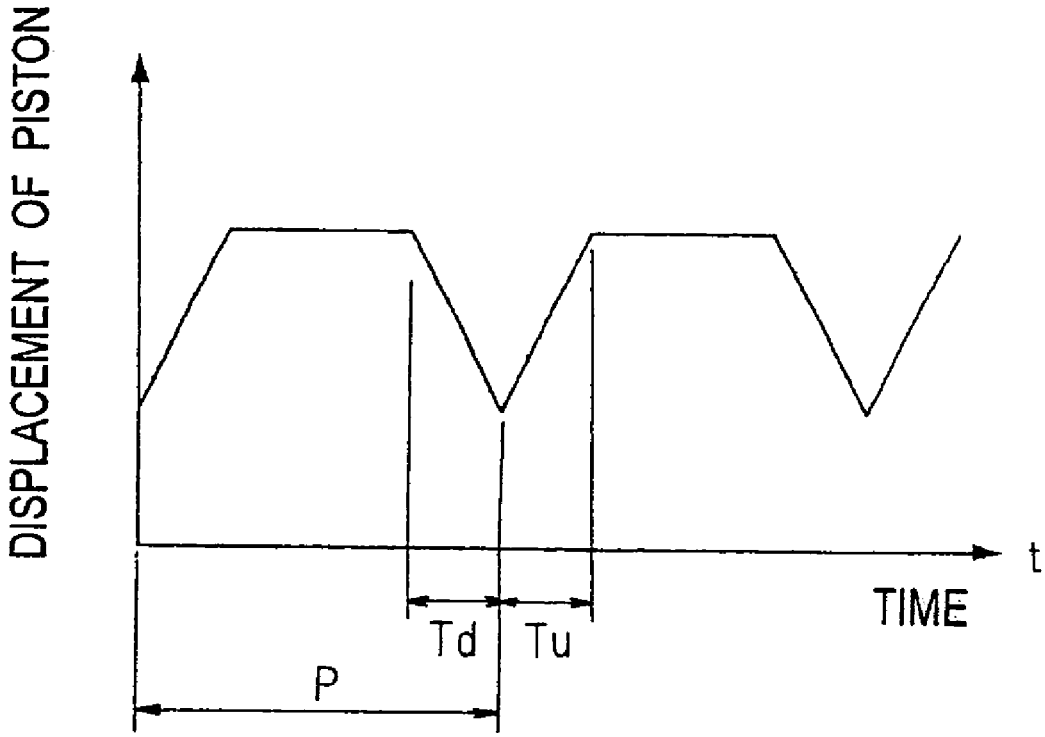
FIG. 15 is a view showing displacement of a piston against time.
Figure 16:
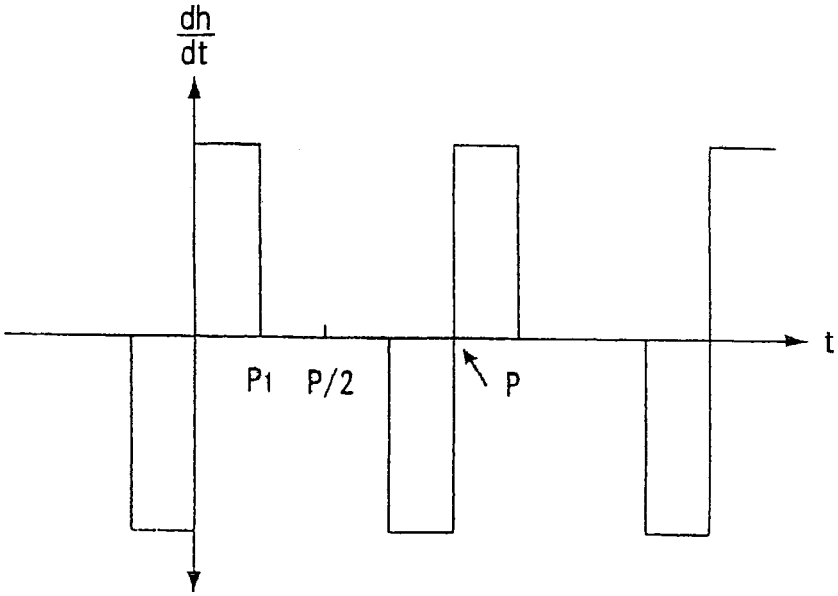
FIG. 16 is a view showing a differential of displacement of the piston against time.

Since $Q_i = P_i/P_n$, the following is satisfied:

$$Q_i + T_1 \frac{dQ_i}{dt} = \frac{P_{s0}}{R_s + R_r + R_n} + \frac{R_r S_p h_a \dot{u}}{R_n + R_r} = Q_0 + A\dot{u} \tag{35}$$

wherein $$\dot{h} = h_a \dot{u} \tag{36}$$

and A is $(R_r S_p h_a)/(R_n + R_r)$ and u is $h/h_a$. The first term on the right-hand side of Equation (35) is a flow quantity determined by a cross point (operation point) of the pressure and the flow quantity characteristics and the load resistance of the grooved pump portion (serving as one example of the fluid supply apparatus). The second term is a variable flow quantity generated by the secondary squeeze pressure. In FIG. 15, displacement h (period P) of the piston against time is assumed. FIG. 16 shows a differential dh/dt (velocity) of the displacement of the piston against time. More particularly, the second term on the right-hand side of Equation (35) is a periodic function having negative and positive values alternatively. In FIG. 16, in consideration of an odd function $[f(t) = -f(-t)]$, a coefficient of Fourier series is obtained. Herein, $b_n$ refers to a Fourier coefficient, n refers to an nth higher harmonic, and p refers to a period.

$$b_n = \frac{2}{p}\int_0^{p_1} h_a \sin\frac{n\pi t}{p}dt + \frac{2}{p}\int_{p_1}^{\frac{p}{2}} 0\cdot\sin\frac{n\pi t}{p}dt = -\frac{2h_a}{n\pi}(\cos n\pi - 1) \quad (37)$$

Therefore, the following is established:

$$A\dot{u} = A\sum_{n=1}^{\infty} b_n \sin\frac{n\pi t}{p} \quad (38)$$

A particular solution of linear first differential equation (Equation 35) in the steady oscillating state with Equation (38) as a forced input term is, as well known, a sum of sine waves having an amplitude $B_n$ and a phase $\phi_n$. Therefore, the flow quantity $Q_i$ obtained by solving Equation (35) is a sum ($Q_i$=$Q_{i1}$+$Q_{i2}$) of a flow quantity $Q_{i1}$ in the grooved pump portion and a fluctuating flow quantity $Q_{i2}$ generated by the secondary squeeze pressure. A value of the flow quantity $Q_i$ integrated by the section of the period P is a discharge flow quantity $Q_s$ per dot:

$$Q_s = \int_0^p Q_{i1}dt + \int_0^p Q_{i2} = \int_0^p \frac{P_{s0}}{R_s + R_r + R_n}dt + \int_0^p \sum_{n=1}^{\infty} B_n \sin\left(\frac{n\pi t}{p} + \phi_n\right) \quad (39)$$

In the second term on the right-hand side of Equation (39), a value of each sine wave integrated by the period P becomes 0. Therefore, the fluctuating flow quantity generated by the secondary squeeze pressure does not exerts influence on the discharge flow quantity per dot and is determined only by the operating point flow quantity $Q_c$ (first term on the right-hand side) in the grooved pump portion. In this case, even if the amplitude of the piston fluctuates due to, for example, unstable power source, i.e., even if the value of the second squeeze pressure fluctuates, the discharge flow quantity per dot is not influenced. It is to be noted that this result holds only when the following conditions are satisfied: a differential dh/dt (velocity) of the displacement of the piston against time is a periodic function having negative and positive values alternatively; and an odd function [f(t)=−f(−t)] is satisfied, i.e., the fall time $T_d$ and the rise time $T_a$ of the piston are identical and values of the displacement of the piston before the fall and after the rise are equal.

Therefore, in the dispenser serving as one example of the fluid injection apparatus according to the embodiment of the present invention, driving the piston by providing the input waveform (e.g., FIG. 15) which satisfies these conditions makes it possible to realize more stabilized intermittent discharge.

(3-2) Specific Analysis Example

Shown below are specific analysis results of examining the idea.

Figure 17:
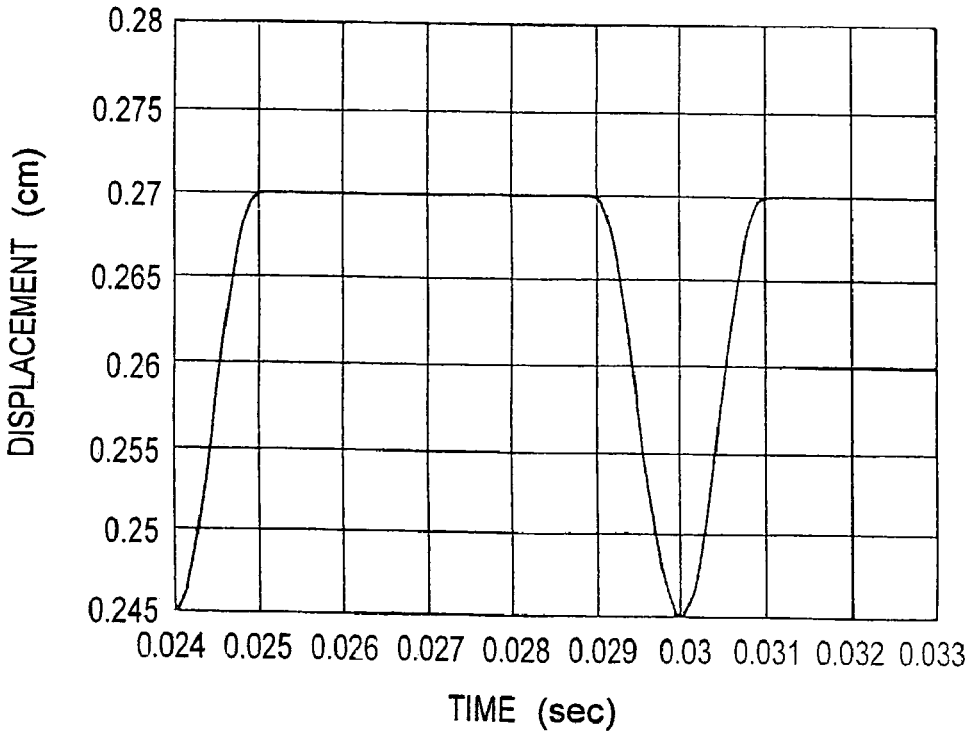
FIG. 17 is a graph showing displacement of the piston against time.
Figure 18:
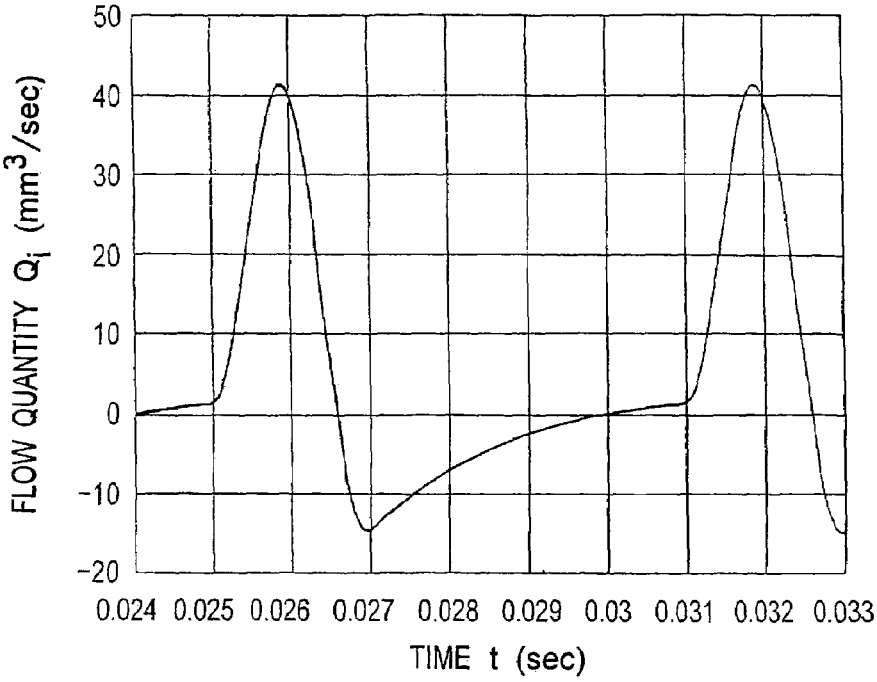
FIG. 18 is a graph showing discharge pressure against time.

The analysis conditions are identical to those shown in Table 1 and Table 2, and FIG. 17 shows a displacement waveform of the piston against time while FIG. 18 shows a discharge flow quantity against time. No. 1 in Table 3 shows a value of the flow quantity waveform in FIG. 18 integrated by time t=0.025 s to t=0.031 s. No. 2 shows a value of the first term on the right-hand side of Equation (39) calculated with the period P=0.031−0.025. Both values correspond to each other extremely well, indicating that regardless of the secondary squeeze pressure, the intermittent discharge flow quantity per dot may be obtained from the operating point flow quantity $Q_c$ in the grooved pump portion.

TABLE 3

| No. | Calculation method | Calculation result |
|---|---|---|
| 1 | Calculated value obtained from flow quantity waveform | $1.74032 \times 10^{-2}$ mm$^3$ |
| 2 | Calculated value obtained from operating point flow quantity in the grooved pump portion | $1.74023 \times 10^{-2}$ mm$^3$ |

[4] Other Embodiments (4-1) Case of Using Actuator with 2 Degrees of Freedom

Figure 19:
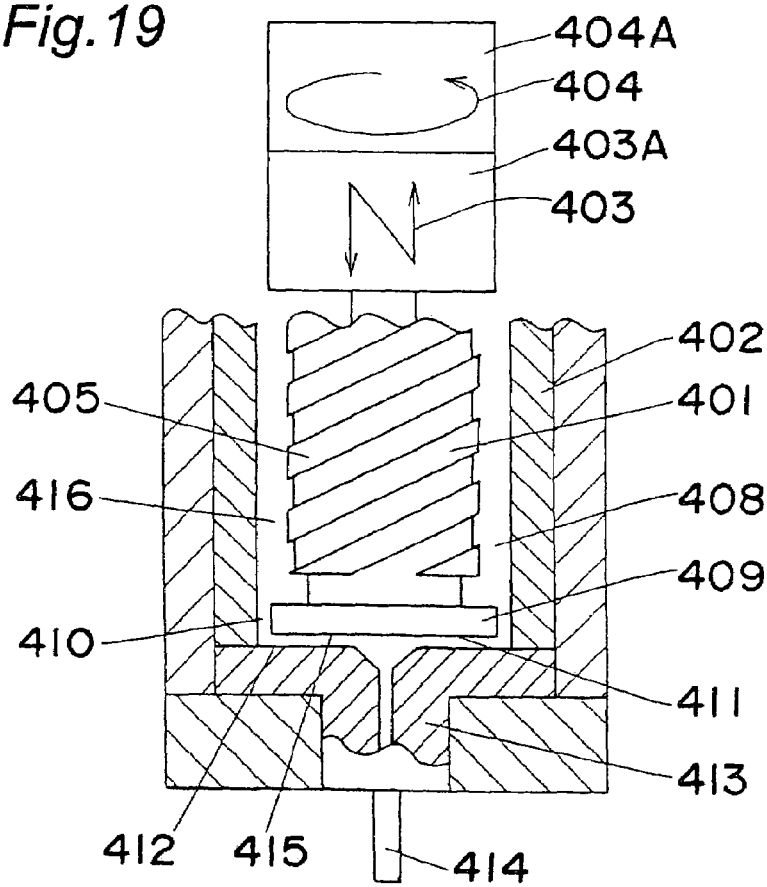
FIG. 19 is an enlarged cross sectional front view showing a piston portion of a fluid injection apparatus according to a fifth embodiment of the present embodiment.
Figure 20:
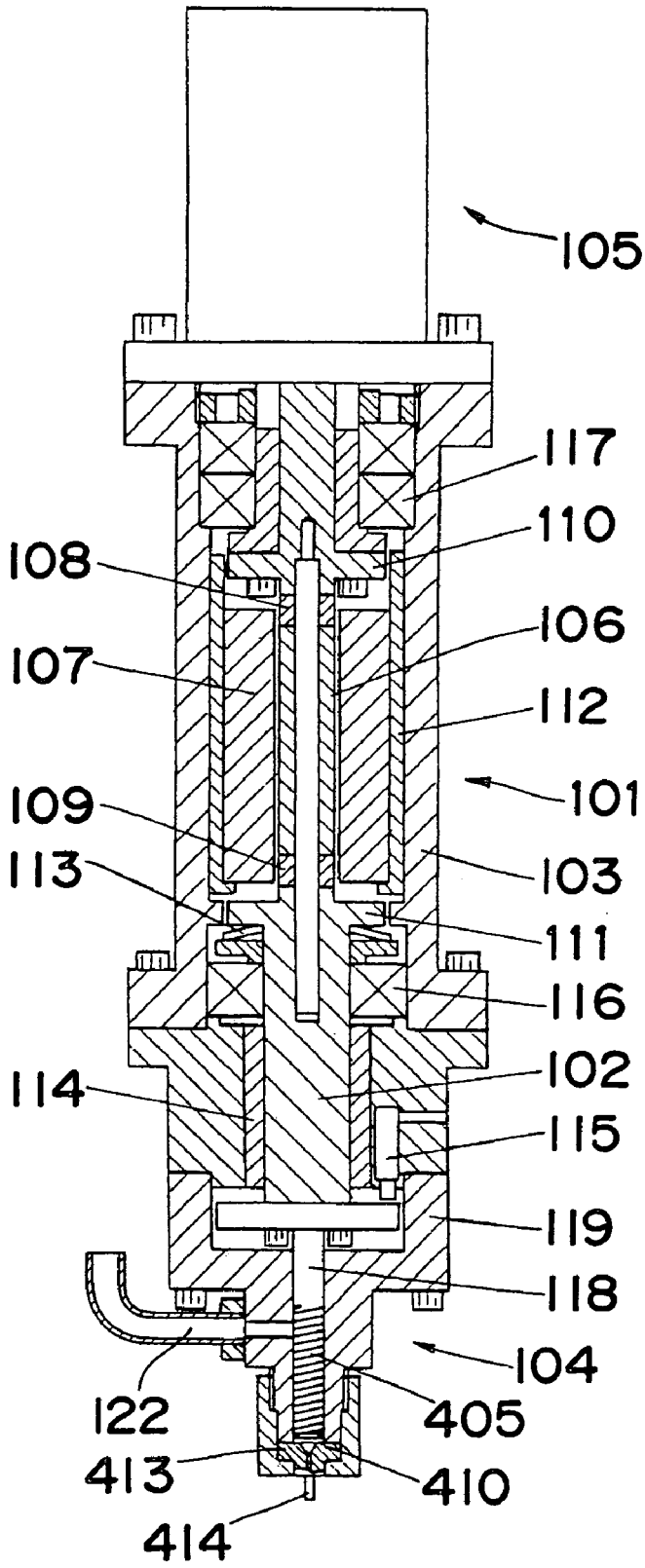
FIG. 20 is a cross sectional front view showing the entire fluid injection apparatus according to a fifth embodiment of the present invention.

The aforementioned first to fourth embodiments are the cases structured to have the grooved pump portion serving as one example of the fluid supply apparatus being separated from the piston portion. The fluid injection apparatuses in the embodiments of the present invention are apparently applicable to the already-proposed head structure with an actuator having 2 degrees of freedom driven by giant-magnetostrictive elements and motors (e.g., already proposed Japanese Patent Application No. 2000-188899 (U.S. Pat. Nos. 6,558,127 and 6,679,685), and a head structure in which a grooved pump portion and a piston portion are disposed on the same axis (e.g., already-proposed Japanese Patent Application 2001-110945 (U.S. Pat. No. 6,679,685). FIG. 19 to FIG. 20 show a fluid injection apparatus according to a fifth embodiment of the present invention. FIG. 19 is a model view showing the principle of the fifth embodiment of the present invention, in which reference numeral 401 denotes a piston housed in a housing 402 serving as one example of the fixed-side casing, movably in axial direction and rotational direction. The piston 401 is driven by an axial driving unit 403A and a rotation transmission unit 404A in axial direction shown by an arrow 403 and in rotational direction shown by an arrow 404 respectively and independently. Reference numeral 405 denotes a thread groove formed on a relative movement face between the piston 401 and the housing 402, and 408 a discharge fluid fed between the piston 401 and the housing 402. Reference numeral 409 denotes a disc-like large diameter portion disposed on the discharge-side end face of the piston 401 to form a throttle 410 between the housing 402 and the disc-like large diameter portion 409. Reference numeral 411 denotes a discharge-side end face of the piston 401, and 412 its fixed-side opposite face. The piston end face 411 and the fixed-side opposite face 412 constitute two faces relatively moving in clearance direction. Reference numeral 413 denotes a discharge portion and 414 a discharge nozzle.

A volume $V_{s1}$ of a flow passage in this case is equal to a volume of a space 415 between the piston end face 411 and the fixed-side opposite face 412. Moreover, a volume $V_{s2}$ is equal to a volume of a space 416 between the thread groove 405 and the housing 402. In the case of using the structure, the volume of the flow passage can be minimized, which allows minimization of a time constant (Equation (27)) on the discharge side and a time constant (Equation (31)) on the grooved pump portion, thereby providing an advantage for enhancing the response of discharge operation.

FIG. 20 shows the entire structure of a dispenser to which the fluid injection apparatus in the embodiment of the present invention is practically applied.

Reference numeral 101 denotes a first actuator composed of giant-magnetostrictive elements and functioning as one example of the axial driving unit 403A, 102 a main shaft linearly driven by the first actuator 101, and 103 a housing serving as one example of a casing for housing the first actuator 101. On the lower end portion (front side) of the light-receiving portion 103, a pump portion 104 for housing the main shaft 102 is mounted.

Reference numeral 105 denotes a motor or a second actuator which gives revolution to the main shaft 102 and functions as one example of the rotation transmission unit 404A. Reference numeral 106 denotes a cylinder-shaped giant-magnetostrictive rod composed of giant-magnetostrictive elements, and 107 a magnetic filed coil for imparting magnetic fields to the longitudinal direction of the giant-magnetostrictive rod 106. Reference numerals 108, 109 denote rear-side and front-side permanent magnets for imparting bias magnetic fields to the giant-magnetostrictive rod 106. The rear-side and front-side permanent magnets 108, 109 are disposed in the form of holding the giant-magnetostrictive rod 106.

Reference numeral 110 denotes a rear-side yoke which is a yoke material of a magnetic circuit disposed on the rear side of the giant-magnetostrictive rod 106, 111 a front-side rod disposed on the front side of the giant-magnetostrictive rod 106 and functioning also as a yoke material, and 112 a cylinder-shaped yoke material disposed on the outer peripheral portion of the magnetic filed coil 107. More particularly, the giant-magnetostrictive rod 106, the magnetic filed coil 107, the permanent magnets 108, 109, the rear-side yoke 110, the main shaft 102, and the yoke material 112 constitute a giant-magnetostrictive actuator (first actuator 101) capable of controlling axial expansion and contraction of the giant-magnetostrictive rod 106 with a current given to the magnetic coil.

Reference numeral 113 denotes a bias spring of the giant-magnetostrictive rod 106, 114 a bearing for supporting the main shaft 102 rotatably and movably in axial direction, and 115 a displacement sensor for detecting an axial displacement of the main shaft 102. Reference numerals 116 and 117 denote bearings.

Reference numeral 118 denotes a piston housed in a lower housing 119 movably in axial direction and rotational direction, the lower housing 119 being a fixed side and constitutes a part of an example of the casing. Reference numeral 405 denotes a thread groove formed on a relative movement face of the piston 118 and the lower portion housing 119, 410 a throttle formed in between the lower end portion of the piston 118 and the lower housing 119, 122 a suction port, and 414 a discharge nozzle.

(4-2) Method for Changing Time Intervals of Intermittent Discharge

Hereinbelow, description is given of a method for applying the dispenser serving as one example of the fluid injection apparatus according to any one of the first to fifth embodiment of the present invention as a fluid injection apparatus according to a sixth embodiment of the present invention in the case where time intervals of intermittent discharge is not constant. For example, in the case where solder is discharged on electrodes of circuit substrates, discharge time intervals are generally at random.

Figure 21:
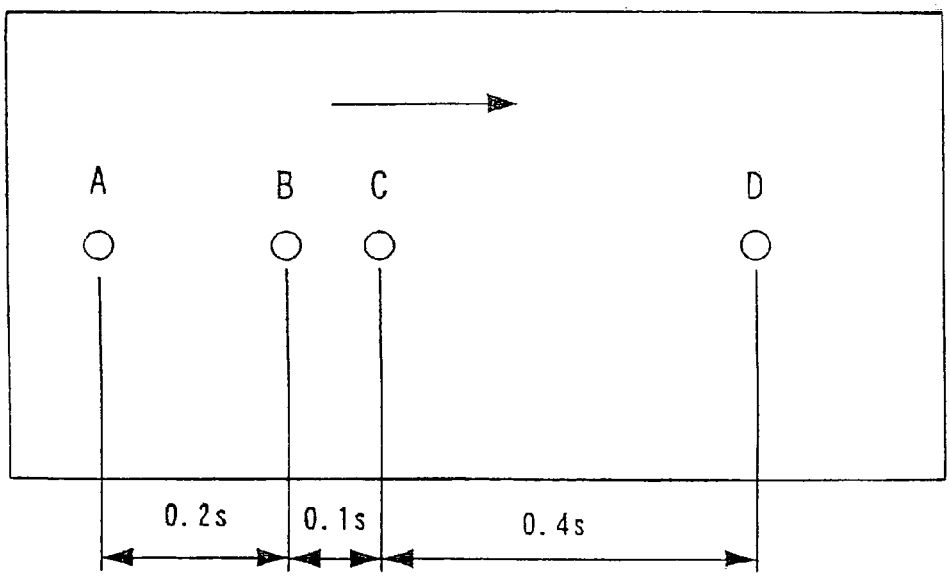
FIG. 21 is a view showing dots representing a fluid discharged onto a substrate by a fluid injection apparatus according to a sixth embodiment of the present invention.
Figure 22:
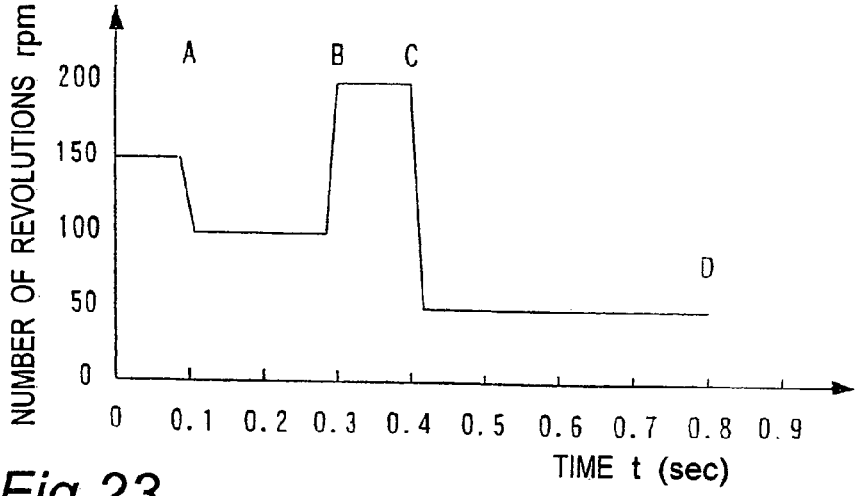
FIG. 22 is a graph view showing number of revolutions of a thread groove against time in the fluid injection apparatus according to a sixth embodiment.
Figure 23:
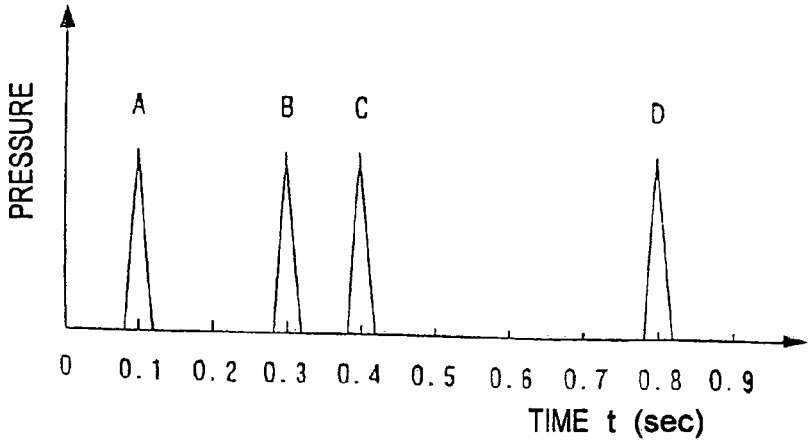
FIG. 23 is a graph view showing discharge pressure against time in the fluid injection apparatus according to the sixth embodiment.

FIG. 21 shows the case where an identical discharge quantity is discharged to four dots (A, B, C, and D points) on a substrate. FIG. 22 shows number of revolutions of a grooved shaft against time, and FIG. 23 shows a discharge pressure waveform. Since distances between each dot are different, a movement time of a stage 179 for which holding and moving the substrate to XY two orthogonal directions is set constant so as to vary the time intervals of discharge operation. As the dispenser, one with the structure used in the first embodiment (FIG. 5B) is used, for example.

In the case of the dispenser according to the first embodiment, the fact that the discharge quantity per dot basically does not depend on the stroke and the displacement of a piston, but is determined by an operating-point flow quantity $Q_C$ (see FIG. 35A) which is determined by the pressure flow quantity characteristics and the load resistance in the grooved pump portion 50 serving as one example of the fluid supply apparatus is used.

After discharge is ended at the point A of time t=0.1 sec, the number of revolutions of the grooved pump portion 50 (see FIG. 5B) is rapidly dropped to N=150→100 rpm. From the grooved pump portion 50, a fluid of a flow quantity $Q_n$ equivalent to N=100 rpm is fed to the discharge chamber 62 (see FIG. 6). Therefore, a total flow quantity $Q_s$ of a fluid fed to the discharge chamber 62 during a period of time from the point A of t=0.1 sec to the point B of t=0.3 sec (time interval is 0.2 sec.) is as shown below:

$$Q_s = \int_A^B Q_n dt \tag{40}$$

Further, the number of revolutions of the grooved pump portion 50 is rapidly increased to N=100→200 rpm after the end of discharge at the point B of t=0.3 sec till discharge starts at the point C of t=0.4 sec. A time interval between the point B of t=0.3 sec to the point C of t=0.4 sec is 0.1 sec., and so the process time is reduced to half the process time of the previous discharge, though the flow quantity (i.e., number of revolutions) is doubled, and therefore the total flow quantity $Q_s$ is the same.

Therefore, the filled states of the fluid in the discharge chamber 62 at the point A of t=0.1 sec and the point B of t=0.3 sec are identical conditions, thereby making it possible to ensure discharge of an identical discharge quantity per shot.

In the normal discharge process, the time intervals of intermittent discharge are pre-programmed, and so the flow quantity (number of revolution) of the grooved pump portion 50 in the fluid supply apparatus may be controlled in accordance with the time intervals. As an alternative to this, as shown in Table 4 as one example, it is also possible to set several cases of time intervals of intermittent discharge categorized by necessary time ranges, and to set the same number of cases of number of revolutions corresponding to these cases. Use of this method simplifies the operation to calculate the number of revolutions with respect to the time intervals.

As a motor for rotationally driving the grooved pump portion 50, a pulse motor, a DC servo motor, or the like may be used. It is to be noted that for changing the total flow quantity $Q_s$ of discharge (or dot size) per dot, the number of revolutions may be controlled similarly.

TABLE 4

| No. | Time necessary for moving the stage or the like | Set value: Time interval of discharge | Set value: Number of revolutions |
|---|---|---|---|
| 1 | T ≦ 0.05 s | 0.1 s | 200 rpm |
| 2 | 0.05 < T ≦ 0.15 s | 0.2 s | 100 rpm |
| 3 | 0.15 < T ≦ 0.25 s | 0.3 s | 66.67 rpm |
| 4 | 0.25 < T ≦ 0.35 s | 0.4 s | 50 rpm |

(4-3) Method for Handling an Ultra Small Flow Quantity

Figure 24A:
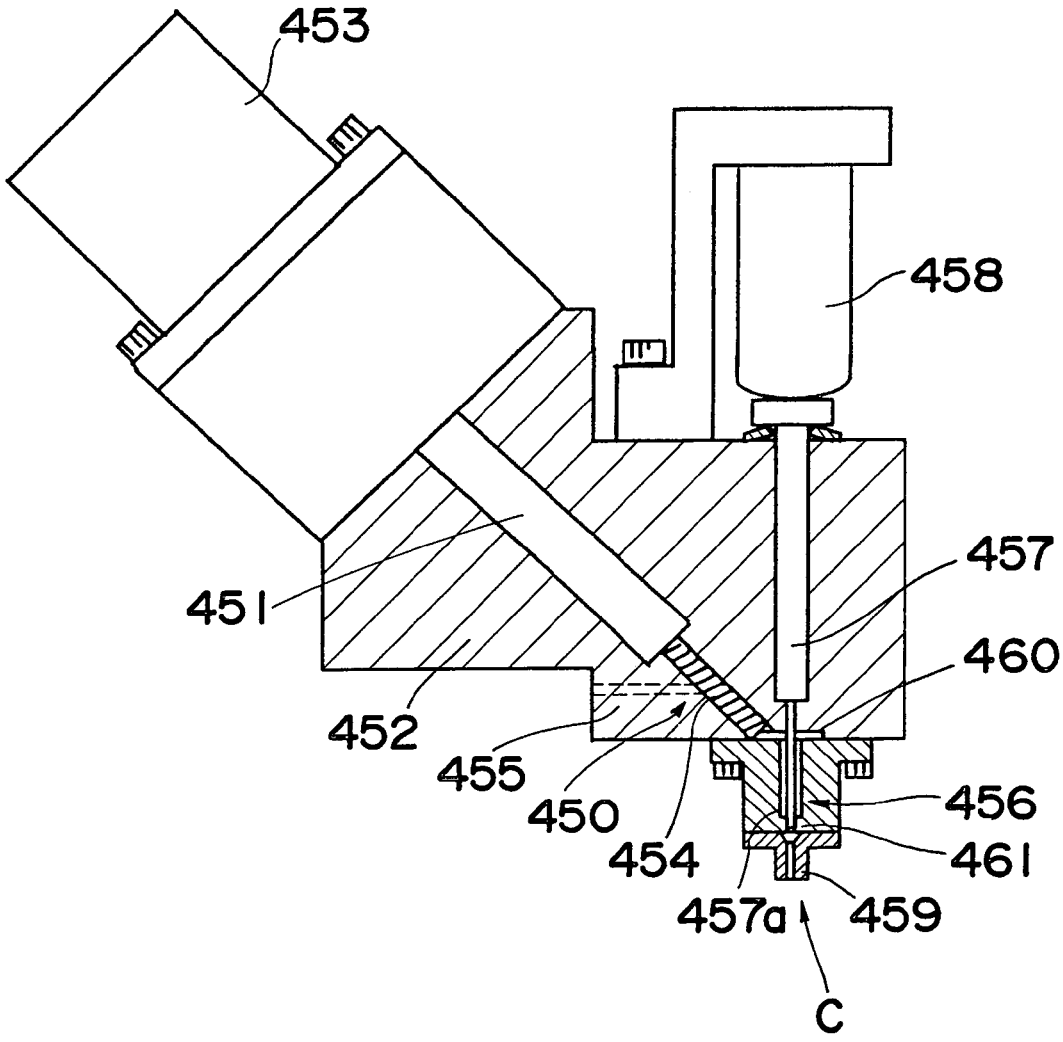
FIG. 24A is a cross sectional front view showing a fluid injection apparatus according to a seventh embodiment of the present invention.

FIG. 24A shows a dispenser serving as one example of a fluid injection apparatus according to a seventh embodiment of the present invention, in which a discharge fluid with a super small flow quantity is pursued (e.g., a fluid with a flow quantity of about 20 to 30 pl ($10^{-6}$ $mm^3$) is dischargeable).

Using the dispenser serving as one example of the fluid injection apparatus according to the seven embodiment of the present invention makes it possible to achieve intermittent discharge and continuous discharge of an ultra small flow quantity. For example, in the manufacturing step for semiconductor wafers, as development of higher functionality and miniaturization of devices proceed, demands for quality-guaranteed process increases, which causes an issue of increased manufacturing costs. As a part of improvement method for simplifying the quality guaranteed process, an attempt to discharge resin materials to electrode portions of defective chips with use of dispensers to establish electric insulation has conventionally been conducted.

This requires a technology to intermittently discharge a high-viscosity material of an ultra small quantity of about 20 to 30 pl ($10^{-6}$ $mm^3$) into a vessel of, for example, about 30 μm length, 100 μm width, and 5 to 7 μm depth in the state of protruding higher than the depth of the vessel.

With use of the inkjet method, a quantity of 2 to 3 pl per shot is normally easy to handle, and so there is no problem in terms of the discharge quantity. However, the inkjet system can handle only the materials with a viscosity of, at most, about several dozen mPa·s, i.e., low-viscosity fluids, which causes an issue that the thickness of the discharge form (protruding state) cannot be obtained.

Assumed is a case of intermittent discharge of an ultra small quantity of about 20 to 30 pl with use of the above-described jet-type dispenser. In the case of this method, high-viscosity fluid can be handled, though since this is a positive displacement method in which an enclosed space is formed in between two members, the level of the ultra small flow quantity is limited. In the case of the positive displacement method, when a piston area is $S_P$ and a piston stroke is $h_{st}$, a volume $S_p \times h_{st}$ extruded by the piston becomes a discharge quantity. In order to discharge a quantity of 30 pl per shot, it is necessary to accurately control the position of the piston so that the displacement of the piston is 3 to 4 μm in the case where the piston is structured to have a piston diameter of, for example Φ0.1 mm. Therefore, practical application is expected to be extremely difficult.

In the case of the dispenser serving as one example of the fluid injection apparatus according to the seventh embodiment of the present invention, as described before, the discharge quantity per dot is not determined by the piston area $S_p$ and the piston stroke $h_{st}$ but can be adjusted by setting the pressure and the flow quantity characteristics (see FIG. 35A) of the fluid supply apparatus (i.e., grooved pump portion). The role of the piston is only to convert a continuous flow to an intermittent flow, so that if the flow quantity of the fluid supply apparatus can be minimized, the piston diameter and the stroke can be set to be sufficiently large for easy handling in practical application.

Figure 24B:
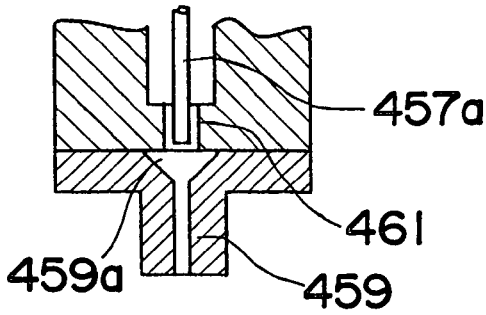
FIG. 24B is an enlarged cross sectional view showing a portion C in FIG. 24A.

FIG. 24A shows the fluid injection apparatus according to the seventh embodiment of the present invention, and FIG. 24B is an enlarged view of a portion C in FIG. 24A. Reference numeral 450 denotes a grooved pump portion and 451 a grooved shaft housed in a housing 452 serving as one example of the casing, movably in its rotational direction. The grooved shaft 451 is disposed so as to be inclined to the axial direction of a piston 457. The grooved shaft 451 is rotationally driven by a motor 453 serving as one example of the rotation transmission unit. Reference numeral 454 denotes a thread groove formed on a relative movement face of the grooved shaft 451 and the housing 452, and 455 a suction port (shown by a dashed line) of a fluid.

Reference numeral 456 denotes a piston portion, 457 a piston having a small-diameter shaft 457*a* at its top end, 458 a piezoelectric actuator serving as one example of an axial driving unit of the piston 457, 459 a discharge nozzle, 460 an annular flow passage connecting the grooved pump portion 450 and the piston portion 456, and 461 a throttle (corresponding to the throttle 18 having a fluid resistance $R_r$ in the analysis model in FIG. 3) disposed in the vicinity of the small-diameter shaft 457*a* at the top end of the piston 457.

A volume $V_{s1}$ of the flow passage 460 of this structure is equal to a volume of the space between the end face of the small-diameter shaft 457*a* of the piston 457 and its cone-shaped fixed-side opposite face 459*a*. Moreover, a volume $V_{s2}$ is equal to a volume of the space between the thread groove 454 and the housing 452. In the case of using the structure, the volume of the flow passage 460 can be minimized, which allows minimization of a time constant $T_1$ (Equation (27)) on the discharge side and a time constant $T_2$ (Equation (31)) on the grooved pump portion side, thereby making it possible to enhance the response of discharge operation.

As shown in the seventh embodiment described above, the point that the time constant $T_2$ on the grooved pump portion side can be decreased in the case where the number of revolutions of the grooved shaft 451 is changed for changing the process time of discharge is a large advantage in terms of discharge quantity accuracy. This is because the discharge quantity can be changed instantaneously in response to the change in number of revolutions of the grooved shaft 451. This effect applies in the case of the continuous discharge, and use of this structure allows instantaneous change of a line width of a discharge line during discharge of the continuous line for example.

[5] Application Example to PDP Phosphor Discharge

Figure 25:
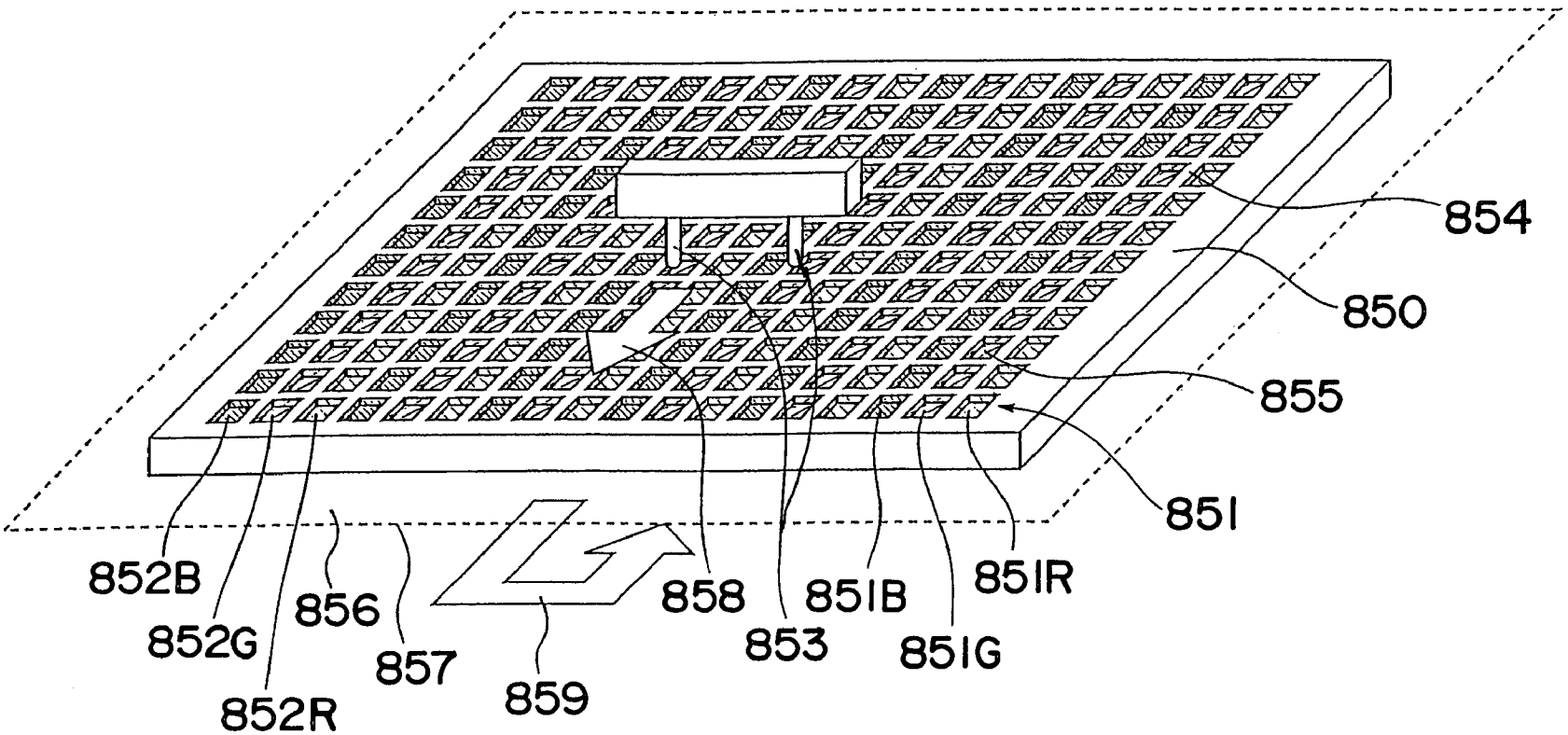
FIG. 25 is a perspective view showing a process assumed for shooting phosphors into independent cells of a PDP by the fluid injection apparatus according to the embodiment.

Assumed herein, as shown in FIG. 25, is a process in which the dispenser serving as one example of the fluid injection apparatus according to the seventh embodiment of the present invention having a multi-nozzle structure shoots phosphors into independent cells of a PDP while relatively moving on a substrate. The dispenser relatively moving on the substrate herein refers to the case where the dispenser is fixed and a stage 179 (see FIG. 13C) for holding the substrate moves against the fixed dispenser and to the case where the stage for holding the substrate is fixed and the dispenser moves against the fixed substrate (see FIG. 40).

Reference numeral 850 denotes a second substrate constituting a rear plate, and 851 independent cells formed by barrier ribs. The independent cells 851 are composed of RGB independent cells 851R, 851G, 851B into which phosphors of each of RGB colors are shot. Moreover, as phosphors 852, there are used R-color (red color) phosphor 852R, G-color (green color) phosphor 852G, and a B-color (blue color) phosphor 852B.

Figure 26A:
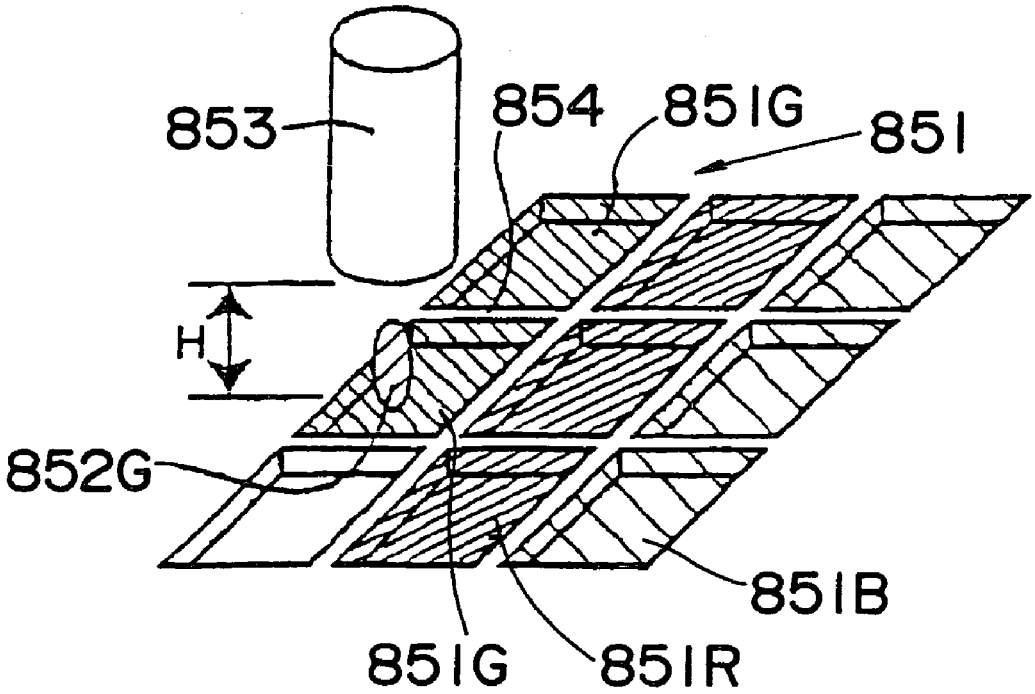
FIG. 26A is a partially enlarged perspective view of FIG. 25.

Here, focus is put only on a single nozzle 853 (corresponding to the discharge nozzle in the specification, and more specifically, for example, corresponding to the discharge nozzle 257 in FIG. 12A). In this method in which the phosphors 852 are shot into the independent cells 851 while flown from the nozzle 853 of the dispenser, it is necessary to keep a distance H between the top end of the discharge nozzle 853 and a barrier rib peak 854 sufficiently large as shown in the enlarged view in FIG. 26A. The reason is as follows. A volume of a PDP independent cell 851 in one embodiment for example is about V=0.65 mm (length)×0.25 mm (width)×0.12 mm (depth) which is an approximate of 0.02 $mm^3$, and it is necessary to fill the vessel-shaped independent cell 851 with the paste of the phosphor 852. This is because, as described above, after volatile components in a phosphor coating liquid are removed through filling and drying steps of the phosphor coating liquid, it is necessary to form a thick phosphor layer on the inner wall of the independent cell.

Figure 26B:
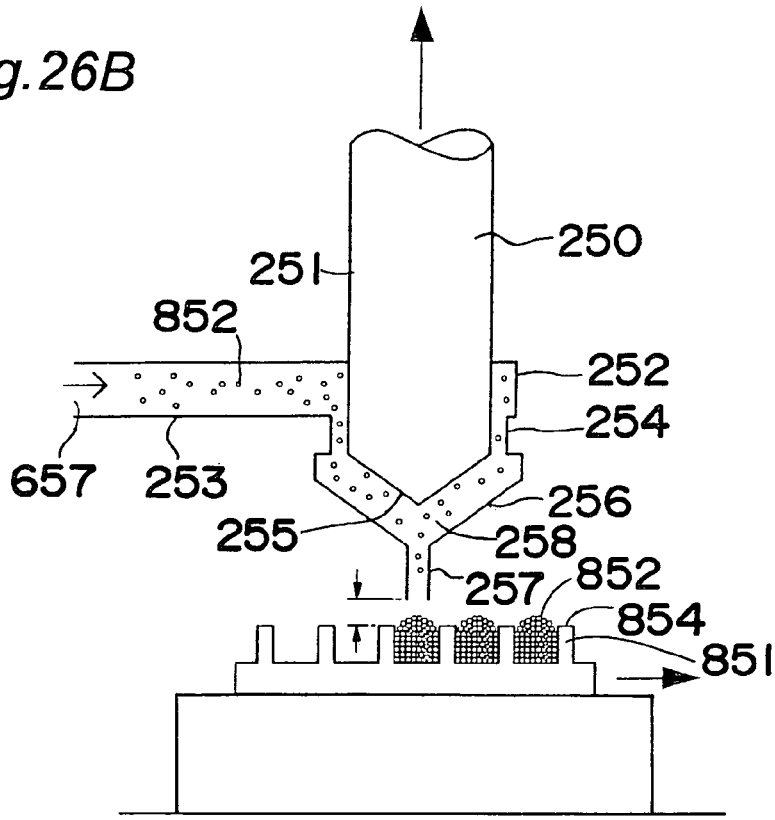
FIG. 26B is an image view showing a suction step for shooting phosphors into the independent cells by the fluid injection apparatus according to the embodiment.
Figure 26C:
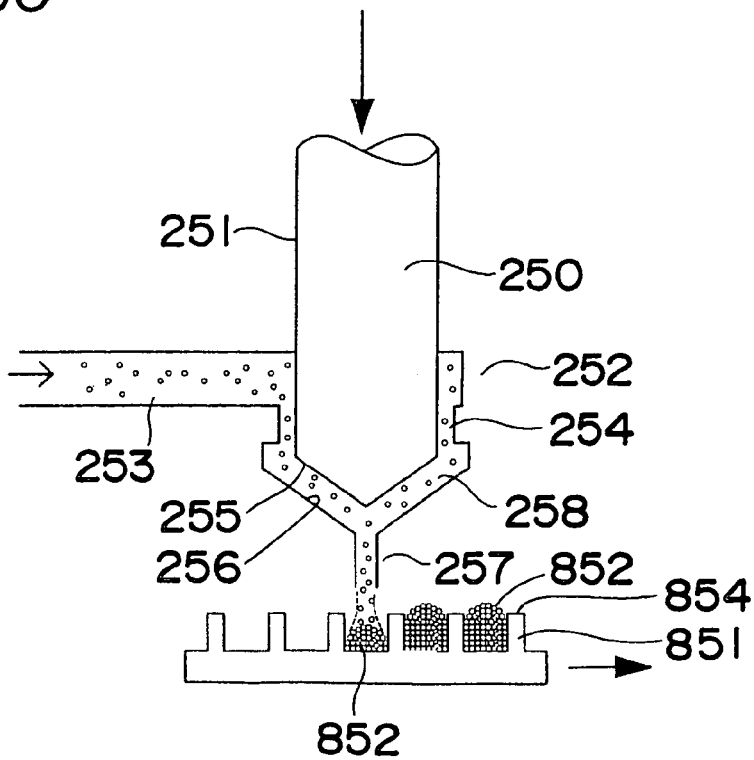
FIG. 26C is an image view showing a discharge step for shooting phosphors into the independent cells by the fluid injection apparatus according to the embodiment.

FIG. 26B and FIG. 26C are image views showing the step of shooting the phosphors 852 into the independent cells 851 with the use of the dispenser. As for the shape of the piston and a disposing method for the throttle, the fluid injection apparatus according to the aforementioned third embodiment of the present invention is employed as one example. FIG. 26B shows a suction step and FIG. 26C shows a discharge step. Reference numeral 250 denotes a piston, 251 a piston outer peripheral portion, 252 a housing serving as one example of the casing, 253 a flow passage connecting a grooved shaft end portion and the piston outer peripheral portion 251, and 254 a throttle formed in between the piston outer peripheral portion 251 and the housing 252. Reference numeral 255 denotes an end face of the piston 250, 256 a fixed-side opposite face formed into a taper shape (cone shape), 657 a fluid supply apparatus side, and 258 a discharge chamber. The third embodiment in which a space between the piston end face 255 and its fixed-side opposite face 256 are formed into a taper shape can lead powder and granular materials to the discharge nozzle 257 more smoothly, and therefore suffers least from trouble such as clogging of the nozzle 257 in the case where powder and granular materials are used. Moreover, since the throttle 254 is disposed in the vicinity of the discharge chamber 258, a volume ($V_{s1}$) of the discharge chamber 258 which exerts a large influence on the response can be minimized, thereby allowing a fluid discharge with good sharpness. This effect naturally applies not only to the phosphor discharge, but also to various powder-and-granular-materials discharge processes regardless of intermittent discharge or continuous discharge.

In the stage of shooting the paste of the phosphor 852 into the independent cells 851, the high-viscosity paste does not fill promptly the entire vessel that is a cell due to its poor flowability. The paste fills the vessel-shaped independent cell 851 from above while the meniscus keeps a shape of protruding from the barrier rib peak 854. Therefore, at the stage that discharge of the paste into a target cell 851 ends, the meniscus is not planarized. When the top end of the discharge nozzle 257 comes into contact with the protruding meniscus of the phosphor 852 at the stage of the middle of paste discharge, the paste adheres to the top end of the nozzle 257, so that a fluid flowing out from the nozzle 257 is influenced by a fluid dollop at the top end of the nozzle 257 and causes various troubles. Therefore, the distance H between the top end of the discharge nozzle 257 and the barrier rib peak 854 needs to be kept sufficient.

In order to prevent fluid adhesion to the top end of the nozzle, H≧0.5 mm is necessary in the third embodiment. Further, with H≧1.0 mm, the fluid adhesion is sufficiently prevented, allowing achievement of long-time highly-reliable intermittent discharge.

The method, in which a high-viscosity powder and granular material is flown and shot into a specific "independent cell" at high speed in the state that a gap of the flow passage is maintained to be sufficiently larger than a particulate diameter while a sufficiently large gap H between the top end of the discharge nozzle 257 and its opposite face is kept, becomes possible by the dispenser serving as one example of the fluid injection apparatus according to third embodiment of the present invention. The characteristics of the fluid injections apparatus according to the third embodiment of the present invention are outlined as shown below:

(1) high-viscosity fluids of order of several thousand to several tens of thousands mPa·s (cps) are used;

(2) clogging does not occur in the case of handling discharge materials containing particulate diameters having a size of several μm or larger;

(3) intermittent discharge can be executed at a short period of msec order or smaller;

(4) discharge fluids can fly from the discharge nozzle across a long distance as long as 0.5 to 1.0 mm;

(5) a discharge quantity per dot is ensured at high accuracy; and (6) a multi-head structure is easy to employ and the structure is simple.

These items (1) to (6) are also the necessary conditions for forming the phosphor layers in the independent cell method with use of dispenser by direct patterning instead of the conventional screen printing method and photo lithography method. Hereinbelow, supplemental description will be briefly given of the reasons why the items (1) to (6) are the necessary conditions and the reasons why the dispenser has these characteristics.

As described before, the reason why the item (1) is necessary in forming the phosphor layer is because a paste-like fluid with high viscosity with a decreased quantity of solution is used as the coating material containing phosphors in order to form a phosphor layer as thick as 10 to 40 μm on the rib wall face after the discharge and dry operations. Further, one of the reasons why the present invention can support high-viscosity fluids of orders of several thousand to several tens of thousands mPa·s (cps), more specifically, orders of 5000 to 100,000 mPa·s is because the fluid injection apparatuses according to the embodiments of the present invention use the grooved pump portions as one example of the fluid supply apparatuses so that the pumping pressure for sending the high-viscosity fluid to the side of the piston portions (discharge chambers) under pressure can be easily obtained in the grooved pump portions. Moreover, in the case of using the high-viscosity fluid, the squeeze pressure is in proportion to the viscosity, so that a large discharge pressure is developed. When the developed pressure is $P_i$=10 MPa, and a piston diameter is, for example, $D_0$=3 mm from Table 1, an axial load applied to the piston is $f=0.0015^2\times\pi\times10\times10^6$ which is an approximate of 70N. In the present embodiment, an electromagnetostrictive actuator with a large load capacity capable of withstanding the load is used on the piston side.

The reason why the item (2) is necessary in forming the phosphor layers is because, as described above, phosphor fine particles with a particulate diameter of several micron orders are generally considered optimum for the displays to have high luminance. Moreover, the reason why clogging is less likely to occur in the flow passage in the dispenser serving as one example of the fluid injection apparatus according to the embodiment of the present invention is because the secondary squeeze pressure can be used so that a minimum value $h_{min}$ of the clearance between the piston and its opposite face which is most likely to cause clogging can be set at values sufficiently larger than the powder particulate diameter, e.g., $h_{min}$=50 to 150 μm or larger.

The reason why the item (3) is necessary for forming the phosphor layers in the independent cell method by direct patterning is as follows. For example, in the case of PDPs of 42 inches wide, the number of pixels of 852RGB length and 480 width provides the independent cell number of 3×408960 which is an approximate of 1.23 million pixels. If it is assumed that a time allowed for the discharge process of phosphors is $T_P$=30 sec and that 100 units of nozzles are mounted on the fluid injection apparatus, a time per shot becomes $T_S$=30×100/1230000 which is an approximate of 0.0024 sec. This value is 1/100 or lower than the response of the conventional air-type and grooved-type dispensers. Therefore, when consideration is given to mass production capability, fast response dispensers exceedingly beyond the conventional dispensers are required.

One of the reason which the dispenser serving as one example of the fluid injection apparatus according to the embodiment of the present invention can fulfill the item (3) is because a clearance $h_{min}$ in the piston end face can be set at a large value, e.g., 50 to 150 μm or larger, and in the filling step of a fluid in the thread groove in the grooved pump portion serving as one example of the fluid supply apparatus (suction step in the state that the piston has risen), the fluid resistance of the flow passage connecting the grooved pump portion and the discharge chamber (reference numeral 17 in FIG. 1 for example) can be minimized. Since the fluid resistance $R_P$(kgs/mm$^5$) of the flow passage along the radium direction connected to the discharge nozzle is small, the filling time can be shortened even in the case of handling high-viscosity fluids with poor flowability.

Moreover, in this dispenser, it becomes possible to effectively use electro-magnetostrictive actuators using piezoelectric elements, giant-magnetostrictive elements, or the like, having high response of 0.1 msec or lower. While a stroke of the electro-magnetostrictive actuators is limited to about 30 to 50 μm on practical level, use of the secondary squeeze pressure in the present embodiment makes it possible to develop a large pressure even with a large clearance $h_{min}$. As is clear from Equation (12), the secondary squeeze pressure does not depend on an absolute value of the clearance h, but depends only on a differential dh/dt (velocity) of the clearance h. Therefore, by utilizing the advantage of the electro-magnetostrictive actuator that is the ability of offering a higher speed dh/dt, a discharge pressure with sharpness and a higher peak of 5 to 10 MPa or higher can be easily obtained at a short period.

By using the present dispenser, intermittent discharge of fluids can be achieved on the level of msec orders or smaller orders, thereby making it possible to discharge sufficiently independent dots on a substrate even when the substrate travels on the continuous basis. In one working example in the embodiment, even when the moving speed of the stage with the substrate mounted thereon is set at $U_s$=300 to 500 mm/s, the fluid can be intermittently discharged to specified positions in an independent way. When the stage moving speed is $U_s$>100 mm/s, reliable intermittent discharge of a number of materials to be discharged, though depending on the "sharpness" of the materials to be discharged, can be conducted even during continuous traveling of the stage (e.g., see reference numeral 179 in FIG. 13C)

The reason why the item (4) is necessary in forming the phosphor layers in the direct patterning is because, as described above, it is necessary to prevent contact between the phosphor meniscus protruding from the barrier rib peak and the top end of the discharge nozzle at the step of the middle of the discharge. Moreover, the reason why the item (4) is fulfilled is because, as described above, the present dispenser can easily obtain a discharge pressure with sharpness and a higher peak of 5 to 10 MPa or higher by utilizing the fast response of the electro-magnetostrictive actuator. Use of the high peak pressure which overcomes the surface tension of the top end of the nozzle allows high-viscosity fluids to fly for a long distance.

The reason why the item (5) is necessary is because the required accuracy of a quantity of phosphor filling the independent cell is, for example, about ±5%. The reason why the item (5) is satisfied is because a discharge quantity per dot in intermittent discharge in the present dispenser basically does not depend on the stroke and the absolute position of the piston nor the viscosity of the discharge fluid but is determined only by "a flow quantity at an operating point of the pressure and flow quantity characteristics of the grooved pump portion serving as one example of the fluid supply apparatus and the fluid resistance of the discharge nozzle" and by the number of discharge operations per unit time. More specifically, in the case of using the grooved pump portion as the pump serving as one example of the fluid supply apparatus, a specified discharge quantity per dot can be set by just changing intermittent frequency and number of revolutions of the grooved shaft.

In the conventional-type dispenser, the stroke and the absolute position of the piston as well as the viscosity of the discharge fluid exert a large influence on the discharge quantity, and therefore strict management is required. For example, in the case of the air-type dispensers, the discharge quantity is in inverse proportion to the fluid viscosity.

The reason why the item (6) is necessary is because in the case of direct patterning, at least several dozen heads need to be mounted on the fluid injection apparatus. For the direct patterning method to replace the conventional methods, the maintenance equal to that of the screen printing method and the photo lithography method is required.

The reason why the item (6) is fulfilled is because in the present fluid injection apparatus, as with the item (5), a fluid discharge quantity per dot in intermittent discharge can be insensitive to the stroke and the absolute position of the piston, and therefore the structure of the piston driving portion (e.g., the piston portion 56 in FIG. 5B) can be simplified. More particularly, the process management requirements for the conventional dispensers such as high-accuracy processing of relatively-moving members in the piston driving portion (e.g., the piston 8 and the housing 4 in FIG. 1), precise positioning of the members during assembly operation, and ensuring of absolute accuracy of the piston stroke are not so strictly applied to the present dispenser. Therefore, the entire multi-head structure in which a plurality of pistons are independently driven can be considerably simplified.

Conventionally, phosphor layer formation of PDP independent cell method which had to rely on the screen printing method can now be conducted by the direct patterning with the fluid injection apparatus according to the embodiment of the present invention. As described before, in the case of the conventional screen printing method, phosphor materials are extensively put on top portions of the rib partition walls during filling of the materials, which becomes an issue leading to cross talk between the barrier ribs in the case of the "independent cell method". Eventually, it is necessary to take actions such as introducing mechanical processing means such as a polishing step for removing materials attached to the top portions of the rib partition walls. In the case of the screen printing, due to the characteristics peculiar to its method, it is highly likely that the materials are put on the top portions of the rib partition walls on almost the entire panel face, and this makes it necessary to process the top portions of all the ribs. However, when the attached materials are removed, fine powders disperse in each cell, which is a large factor of deteriorating the quality of products. Although it is possible to remove the dispersed fine powders by vacuum and electrostatic suction, it is difficult to restore all the independent cells of one million or more to the clean state. While there is a possibility that the materials are put on the top portion of the rib partition walls in the direct patterning, its rate is sufficiently smaller than that of the screen printing. Therefore, the mechanical processing for removing the materials attached to the top portion of the rib partition walls is necessary only in a part of the panel face, and 4/5 or more phosphor removal processing in all the independent cells is not necessary in the embodiment. Even with a margin of safety being allowed, 2/3 or more phosphor removal processing is not necessary.

The characteristics (1) to (6) of the present dispenser described hereinabove are apparently applicable to the processes other than the PDP phosphor discharge process to a great degree. For example, the effects thereof are largely effective for the fluid discharge process which is required for "underfill", "SMT (Surface Mounting Technology)", "die bonding," and "solder paste" in the filed of circuit formation.

[6] About Actuator Portion

The aforementioned embodiment is structured so as to drive the piston by a piezoelectric actuator (e.g., reference numeral 56 in FIG. 5B) that is a kind of electro-magnetostrictive element for use as one example of an axial driving unit.

As described before, the second squeeze pressure is usable in the present dispenser, and therefore even when the clearance $h_{min}$ in the piston end face is set to be sufficiently large, a large discharge pressure can be developed. Consequently, the drawback of the electro-magnetostrictive element that is a limited stroke size does not constitute a constraint in the present invention, so that only the advantages of the electro-magnetostrictive element having high response (high speed) are usable. Since a sufficiently large clearance $h_{min}$ can be set, a time for filling high-viscosity fluids into the end face of the piston can be shortened. Therefore, in the dispenser serving as one example of the fluid injection apparatus in the embodiment of the present invention, use of the electro-magnetostrictive element as one example of the axial driving unit largely contributes to increase the response (productivity) as the injection apparatus.

In the case of applying the present invention to the process of intermittent discharge of phosphors in the box-type cells of PDPs, by using the conditions of discharge process: (i) a constant discharge quantity per dot is acceptable; and (ii) a constant period, and by paying attention to the characteristics of the head structure that is (iii) a discharge quantity can be structured so as not to depend on the stroke and the displacement of the piston, a resonant electro-magnetostrictive element may be used as one example of the axial driving unit instead of the piezoelectric actuator. As a piezoelectric transducer, a variety of types including a disc type, a prism type, a cylinder type, and a Langevin type are available. In this case, a load of driving the piston can be drastically reduced, so that heat generation of the element can be reduced, thereby allowing considerable simplification of the actuator portion. The resonance frequency of the system may be determined by using mechanical resonance points involving mass of the piston, and rigidity of portions supporting the piston and the electro-magnetostrictive element. In the case of applying the resonant resonator to the multi head, a method for compensating a flow quantity difference among the heads may involve disposing a semi-rigid fluid throttle resistance in the middle of the flow passage as described later.

[7] Application to Continuous Discharge

Figure 27A:
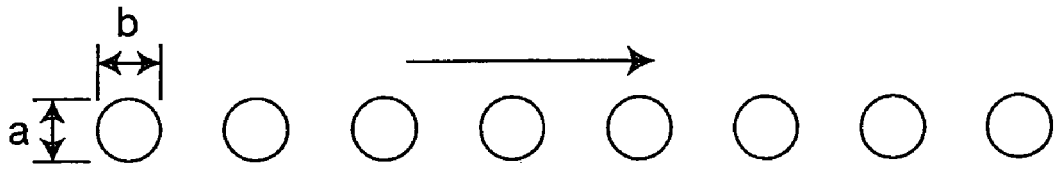
FIG. 27A is a view defining intermittent discharge in the fluid injection apparatus according to the embodiments.

In the present specification, "intermittent discharge" of a fluid or "continuous discharge" of a fluid are defined from the forms of discharge patterns of the fluid immediately after being discharged onto a substrate. As shown in FIG. 27A, the "intermittent discharge" is determined to be performed in the case where a is an approximate of b wherein a width of the pattern in an orthogonal direction to the relatively moving direction of the discharge nozzle and the substrate (an arrow in FIG. 27A) is "a", and a length along the moving direction is "b". Similarly, the "intermittent discharge is also determined to be performed in the case where a discharge pattern is formed in the shape almost proportional to the inner shape of the discharge nozzle. For example, in the case where the inner face of the discharge nozzle takes an oval shape, the pattern of the "intermittent discharge" also takes the oval shape. Basically, the knowledge and ideas obtained in the present invention are applicable to both the intermittent discharge and the continuous discharge.

Figure 27B:
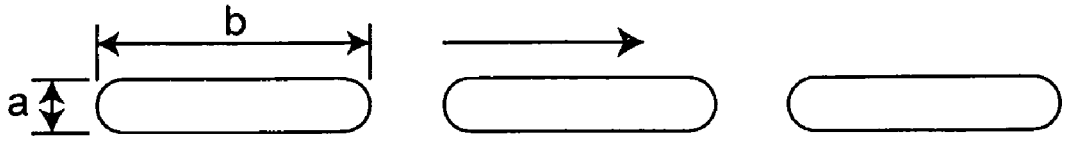
FIG. 27B is a view defining continuous discharge in the fluid injection apparatus according to the embodiments.

As shown in FIG. 27B, the "continuous discharge" is determined to be performed in the case of a<b wherein a width of the pattern in the orthogonal direction to the relative moving direction is "a" and a length along the moving direction is "b".

The present invention is applicable to continuous discharge (i.e., in the case of a<<b) in the case where phosphor screen stripes or electrode interconnection lines are formed on the display screen. The largest issue on high-speed continuous discharge is to achieve high-quality discharge at the beginning and terminal ends of a drawing line. More specifically, the following conditions needs to be satisfied:

(i) at the start of discharge operation, the start portion of a discharge line is not narrowed down nor cut off;

(ii) similarly, at the end of discharge operation, the end portion of the discharge line is not thickened nor gets a dollop.

Figure 28:
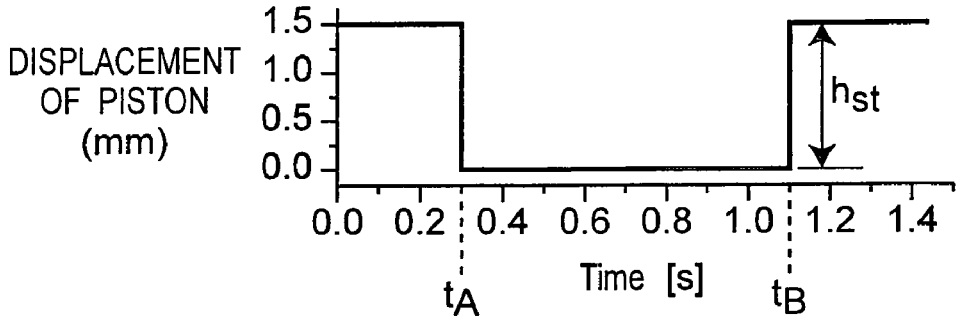
FIG. 28 is a graph view showing displacement of a piston against time in the fluid injection apparatus according to the embodiment.
Figure 29:
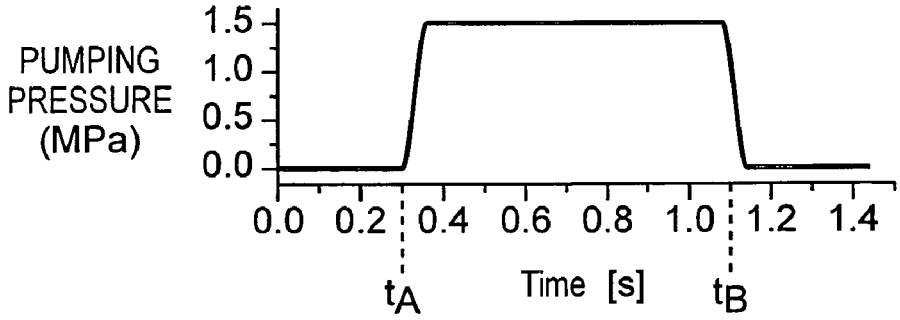
FIG. 29 is a graph view showing pumping pressure against time in the fluid injection apparatus according to the embodiment.
Figure 30:
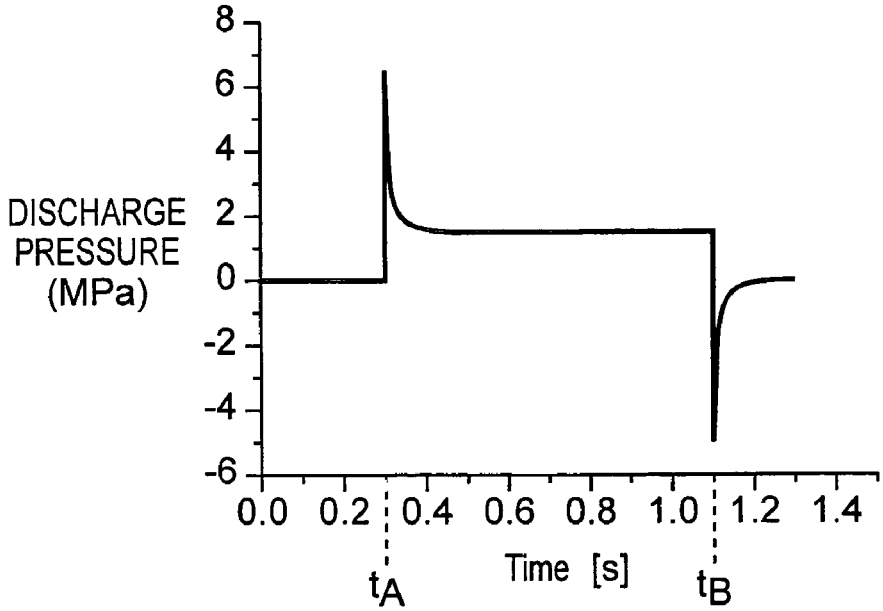
FIG. 30 is a graph view showing discharge pressure against time in the fluid injection apparatus according to the embodiment.

In order to fulfill the (i) and (ii) conditions, a start point and terminal end control method using squeeze pressure has already proposed. FIG. 28, FIG. 29, and FIG. 30 respectively show characteristics of displacement h of the piston, a pumping pressure $P_p$ of the grooved pump portion, and a discharge pressure $P_i$ thereof against time t.

By utilizing that the piston driven by the electro-magnetostrictive element can perform a high-speed linear motion, (i) at the start of discharge operation ($t=t_A$), the piston is lowered while at the same time, revolution of the motor of the grooved pump portion is started, and (ii) at the end of discharge operation ($t=t_B$), the piston is rapidly moved up while at the same time, revolution of the motor of the grooved pump portion is stopped.

In the step (ii), the conditions under which a negative pressure is generated in the discharge pressure $P_i$, i.e., the conditions to satisfy $P_{min}<0$ are obtained as shown below.

When a minimum clearance $h_{min}$ in the piston end face is set to be sufficiently large, $R_p \rightarrow 0$ with $h \rightarrow \infty$ from Equation (11), $P_{squ1} \rightarrow 0$ from Equation (17), and discharge pressure $P_i \approx P_1$ from Equation (24), so that Equation (26) leads to the following:

$$P_i + T_1 \frac{dP_i}{dt} = \frac{R_n}{R_n + R_r}\left[P_2 - R_r \pi (r_0^2 - r_i^2)\dot{h}(t)\right] = \frac{R_n}{R_n + R_r} P_2 - K_s \dot{h}(t) \tag{41}$$

wherein $K_s$ is a proportionality gain constant, and if a piston effective area (the effective area of the piston serving as one example of a relative movement face of two relatively moving members) is $S_p = \pi(r_0^2 - r_i^2)$, the following is satisfied:

$$K_s = \frac{R_n R_r}{R_n + R_r} S_p \tag{42}$$

A time constant $T_1$ on the discharge side (piston side) is as follows:

$$T_1 = \frac{c_{h1} R_r R_n}{R_n + R_r} \tag{43}$$

Figure 31:
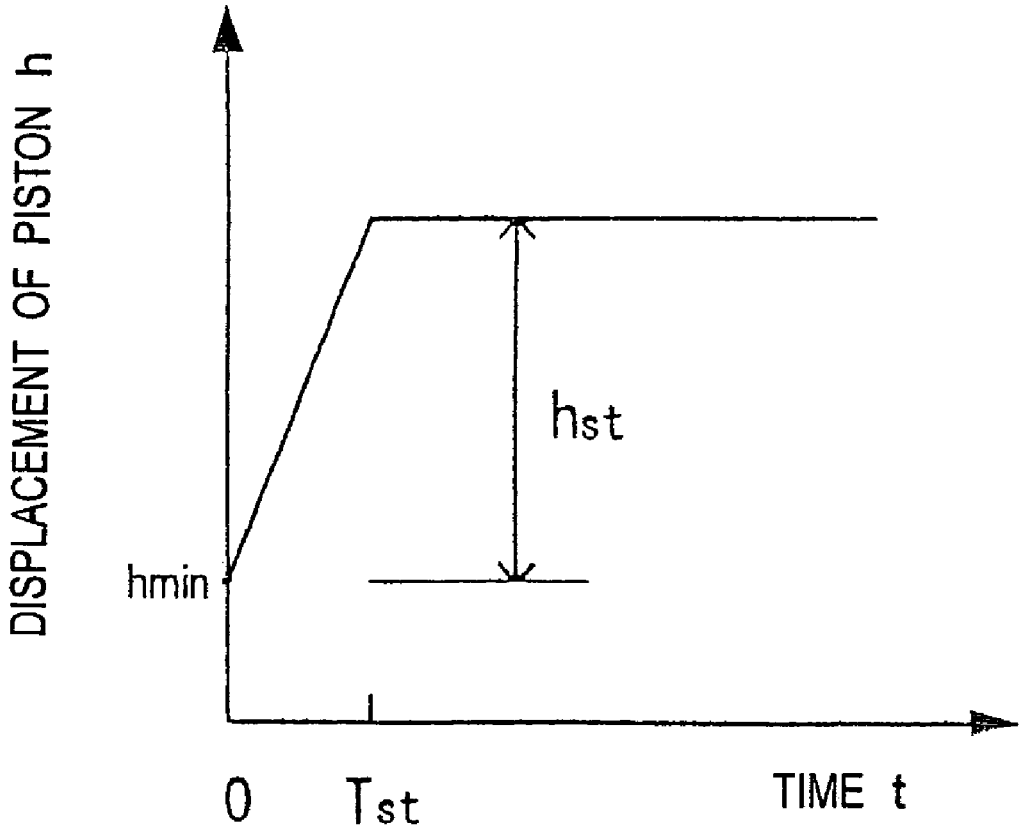
FIG. 31 is a graph view showing displacement of a piston against time in the fluid injection apparatus according to the embodiment.

FIG. 31 shows a piston displacement input waveform h(t) When a time necessary for stroke-$h_{st}$-movement by the relative movement face of two members, e.g., the piston, is $T_{st}$ (s), the piston displacement is a ramp function of $h(t) = (h_{st}/T_{st})t + h_{min}$ in the case of $0 \leqq t \leqq T_{st}$, whereas the piston displacement keeps a constant value of $h(t) = h_{st} + h_{min}$ in the case of $t > T_{st}$.

Figure 32:
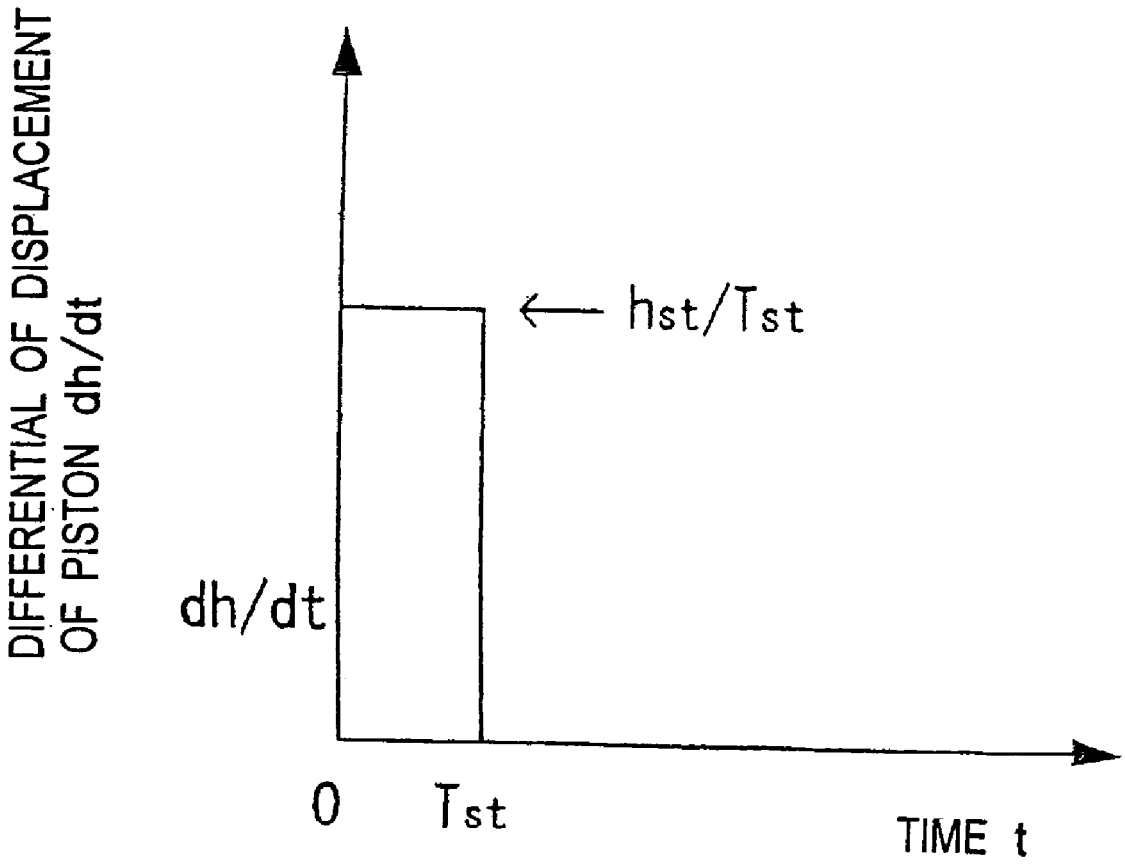
FIG. 32 is a graph view showing a differential of displacement of the piston against time in the fluid injection apparatus according to the embodiment.

As shown in FIG. 32, a differential dh/dt of the piston displacement is as follows in the case of $0 \leqq t \leqq T_{st}$:

$$\dot{h}(t) = h_{st}/T_{st} \tag{44}$$

and $$\dot{h}(t) = 0 \tag{45}$$

in the case of $t > T_{st}$.

Therefore, in the time region ($0 \leqq t \leqq T_{st}$), the second term (forced input term) on the right-hand side of Equation (41) is subject to step input, and therefore when $P_i = P_{i0}$ is an initial condition (t=0), then the following is satisfied:

$$P_i = P_{i0} - K_s \frac{h_{st}}{T_{st}}\left(1 - e^{-\frac{t}{T}}\right) \tag{46}$$

When the piston moves down (clearance decreases: $h_{st} < 0$), that is, when $h_{st} = -|h_{st}|$ in Equation (17), the discharge pressure takes a maximum value at $t = T_{st}$.

$$P_{imax} = P_{i0} + K_s \frac{|h_{st}|}{T_{st}}\left(1 - e^{-\frac{T_{st}}{T}}\right) \tag{47}$$

On the contrary, when the piston moves up (clearance increases: $h_{st} > 0$), that is, when $h_{st} = |h_{st}|$, the discharge pressure takes a minimum value at $t = T_{st}$.

$$P_{imin} = P_{i0} - K_s \frac{|h_{st}|}{T_{st}}\left(1 - e^{-\frac{T_{st}}{T}}\right) \tag{48}$$

The maximum value (Equation (47)) and the minimum value (Equation (48)) of the discharge pressure depend on the initial value $P_i = P_{i0}$ of the pressure.

Hereinbelow, in the case where a period of intermittent discharge is sufficiently large or in the case where the start point and terminal end of a continuous discharge line are closed/opened, a maximum value and a minimum value of the discharge pressure are obtained.

In this case, since the discharge pressure reaches a steady state, an operating point pressure $P_C$ shown below determined by a PQ characteristic of the grooved pump portion and throttle resistance $R_r$+discharge nozzle resistance $R_n$ becomes an initial value $P_{i0}$ both at the start of rising and at the start of falling of the piston. In the case where the flow passage resistance $R_t$ is unignorable, the operating point pressure may be obtained with $R_r \rightarrow R_r + R_t$.

$$P_{i0} = P_C = \frac{R_r + R_n}{R_S + R_r + R_n} P_{S0} \tag{49}$$

$P_C$ in Equation (49) is a value in the case where $h_{min}$ is sufficiently large. Therefore, a maximum pressure is as shown below:

$$P_{i\,max} = P_c + P_{st} \tag{50}$$

A minimum pressure is as shown below:

$$P_{i\,min} = P_c - P_{st} \tag{51}$$

provided that the following is satisfied:

$$P_{st} = K_s \frac{|h_{st}|}{T_{st}}\left(1 - e^{-\frac{T_{st}}{T_1}}\right) \tag{52}$$

Therefore, the conditions under which the terminal end of the discharge line can be closed, i.e., the conditions to fulfill $P_{imin} < 0$ are as follows:

$$\frac{P_{st}}{P_c} > 1 \tag{53}$$

Described hereinabove is about the conditions for drawing the terminal end of the discharge line with high quality. In order to draw the start point of the discharge end with high quality, a piston falling curve may be so selected that an appropriate positive pressure is developed during the falling of piston so that a fluid is smoothly discharged against the surface tension of the fluid at the top end of the nozzle.

This idea for realizing sharp intermittent discharge can be applied to continuous discharge. For example, the aforementioned ideas including the formation method for throttle (serving as one example of the fluid resistance portion), the position to form the throttle, the top end of the piston being formed into a taper shape, the grooved shaft being disposed so as to be inclined to the piston shaft, and the like are also effective for the case of continuous discharge.

Moreover, performing high-speed intermittent discharge while slowing a relative travel speed between the discharge nozzle and the substrate makes it possible to form a pseudo-continuous line. In this case, all the aforementioned ideas for realizing sharp intermittent discharge can be utilized.

[8] Conditions for Long-Distance Jumping Discharge (No. 1)

Whether or not a discharge fluid can be discharged and flown in the state that a sufficient distance between the top end of the discharge nozzle and the substrate is kept depends on the size of kinetic energy allowing the fluid to flow out against the surface tension acting upon the fluid at the top end of the discharge nozzle, i.e., a flow rate of the fluid when the fluid passes through an inner passage of the discharge nozzle. If a steep peak pressure is generated in the discharge chamber, the flow rate of the fluid passing through the discharge nozzle also has a rapid peak. With the peak value of the flow rate (maximum flow rate of the fluid) being $v_{max}$ (also stated as $V_{max}$: both $V_{max}$ and $V_{max}$ being the same), the larger the peak value $v_{max}$ of the flow rate becomes, the easier the fluid can fly. However, when the peak value $v_{max}$ of the flow rate is too large, the fluid after passing through the nozzle is in the dispersed state, and therefore the discharge of very small dots becomes difficult. Therefore, the peak value $v_{max}$ of the flow rate has an upper limit value and a lower limit value from a practical standpoint.

Herein, high-speed intermittent flying discharge is assumed and an approximate expression of the peak value $v_{max}$ of the flow rate is obtained.

Assuming the case where a minimum clearance $h_{min}$ in the piston end face is set to be sufficiently large, e.g., in the level of $h_{min}$=1 to 2 mm, $R_p \rightarrow 0$ with $h \rightarrow \infty$ from Equation (11), $P_{squ1} \rightarrow 0$ from Equation (17), and $P_i \approx P_1$ from Equation (24). Hereinbelow, as with the case of the section [7] in which the discharge pressures at the start point and terminal end during continuous discharge are obtained, a maximum peak pressure $P_{max}$ is obtained. In Equation (47), the maximum peak pressure is $P_{max} >> P_{i0}$ in the case of intermittent flying discharge, so that $P_{max}$ is an approximate of $P_{st}$. Therefore, an approximate expression $v^*_{max}$ is obtained as shown below, provided that a time constant $T_1$ on the discharge side is obtained from Equation (43). Herein, an opening portion of the discharge port has an area of $S_n$.

$$V^*_{max} = \frac{Q_{max}}{S_n} = \frac{P_{imax}}{R_n S_n} = \frac{R_r}{R_n + R_r}\frac{S_p}{S_n}\frac{|h_{st}|}{T_{st}}\left(1 - e^{-\frac{T_{st}}{T_1}}\right) \quad (54)$$

As a result of the experiment, it is found that when the peak value $v^*_{max}$ of the flow rate is set in the range of 5 m/s<$v^*_{max}$<30 m/s, the fluid, immediately after the piston falls, can fly from the discharge nozzle without staying at the top end of the discharge nozzle and can be discharged onto the substrate without being dispersed. For proving validity of Equation (54), Table 5 shows a result of comparison between a peak value $v_{max}$ of the flow rate obtained by strict numerical analysis of a system of differential equations of Equation (26) and Equation (30) under the conditions of Table 1 and Table 2, and an approximate solution $v^*_{max}$ from Equation (54), provided that $T_{st}=T_d$. From the result in Table 5, it is found out that the peak value $v_{max}$ of the flow rate can be evaluated with sufficient accuracy with use of Equation (54).

TABLE 5

| Analysis conditions | Strict solution $v_{max}$ based on numerical analysis | Approximate solution $v^*_{max}$ |
|---|---|---|
| Table 1 + Table 2 | 10.8 m/s | 9.87 m/s |

[9] Conditions for Long-Distance Flying Discharge (No. 2)

Figure 33A:
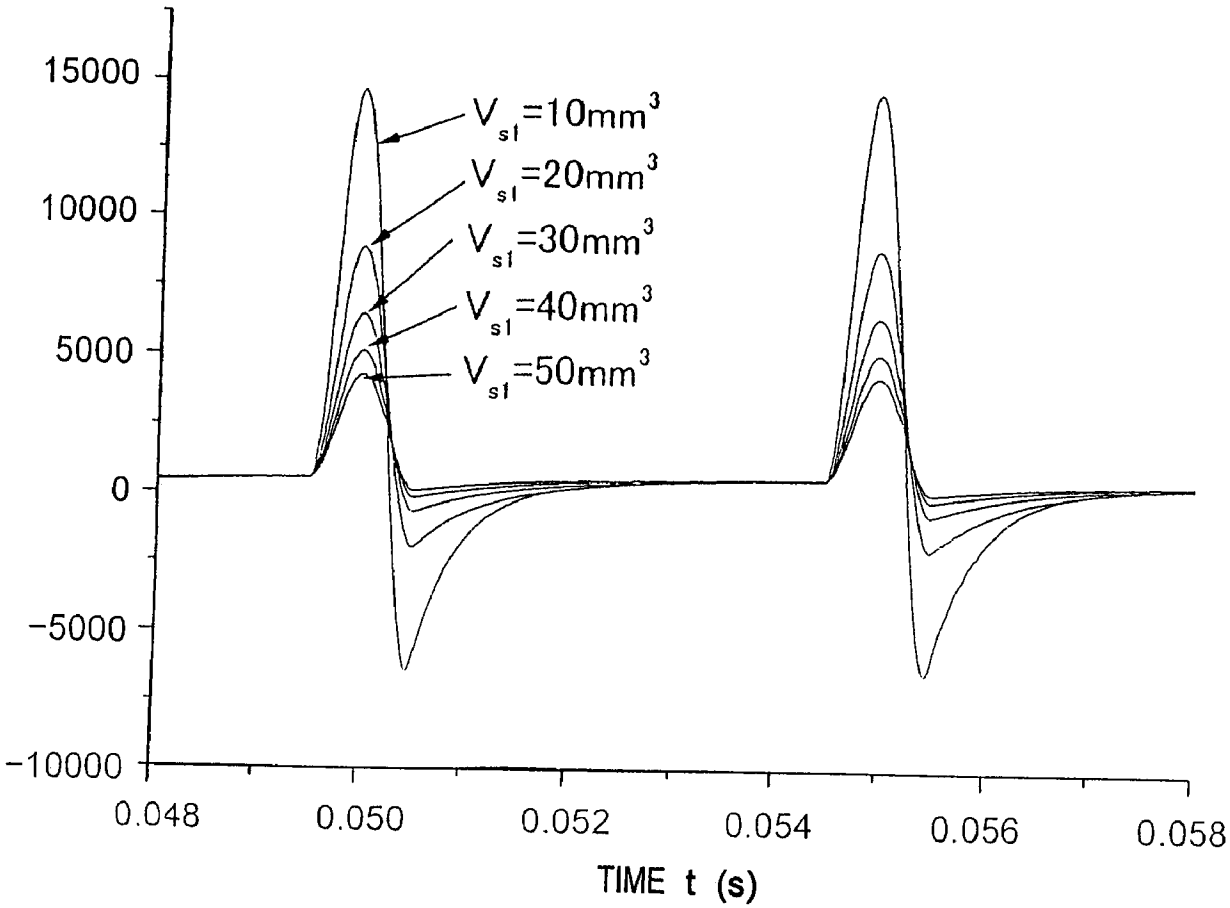
FIG. 33A is a graph view showing a flow velocity of a fluid passing the discharge nozzle against time in the fluid injection apparatus according to the embodiment.

The smaller a volume $V_{s1}$ of the piston portion side across the fluid resistance portion becomes, the smaller a time constant $T_1$ on the discharge side can become, and so a discharge nozzle passing flow rate $v_{max}$ having a high peak value can be obtained. FIG. 33A shows that, as one example, a discharge nozzle passing flow rate V against time when only a volume $V_{s1}$ of the piston portion side is obtained under the conditions stated in Table 1 and Table 2.

FIG. 33A indicates that with $V_{s1}$<40 mm$^3$, $v_{max}$>5 m/s can be obtained, by which the flying conditions can be satisfied.

The lower limit value of the volume $V_{s1}$ can be decreased by disposing the throttle resistance (the throttle 304 in the second embodiment as one example) as close to the end face of the piston (the end face 305 of the piston 300 in the second embodiment as one example) as possible. While the size of the piston diameter can be selected according to uses, the outer diameter of Φ3 mm is selected in the range of practical purposes and a piston minimum clearance is set at $h_{min}$=50 μm, by which a possible lower limit value of $V_{s1}$ becomes $V_{s1}=1.5^2\times3.14\times0.05=0.35$ mm$^3$ from a practical viewpoint.

Figure 33B:
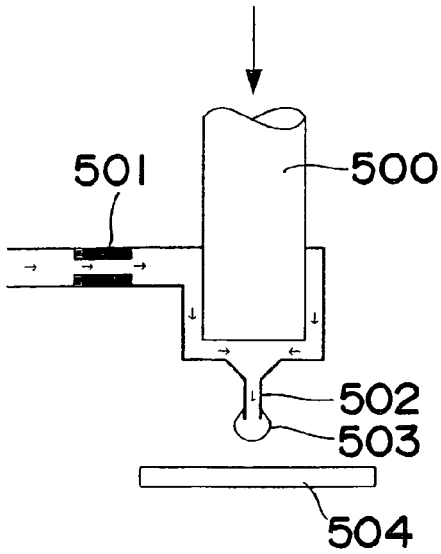
FIG. 33B is an image view showing a discharge state when a maximum flow velocity of a fluid in the range of the discharge nozzle passing flow velocity is $v_{max} \leqq 5$ m/s in the fluid injection apparatus according to the embodiment.
Figure 33C:
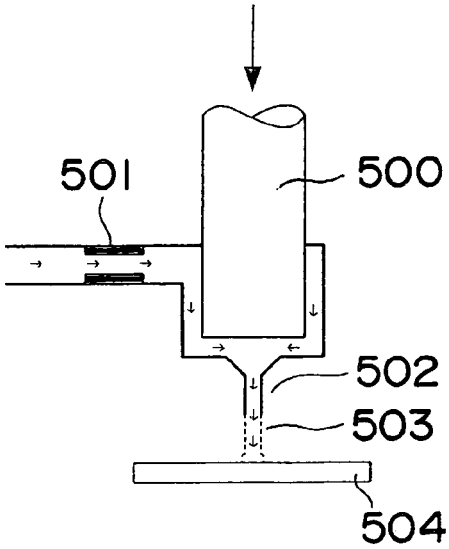
FIG. 33C is an image view showing a discharge state when a maximum flow velocity of a fluid is 5 m/s$<v_{max}<$30 m/s in the fluid injection apparatus according to the embodiment.
Figure 33D:
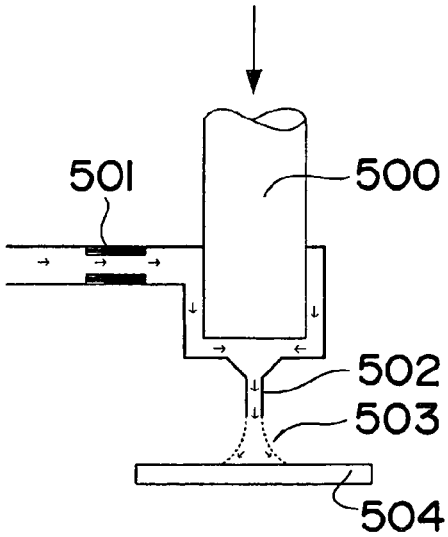
FIG. 33D is an image view showing a discharge state when a maximum flow velocity of a fluid is $v_{max}>5$ m/s in the fluid injection apparatus according to the embodiment.

FIG. 33B to FIG. 33D are image views showing how the discharge state changes depending on the range of the discharge nozzle passing flow rate $v_{max}$. Reference numeral 500 denotes a piston (corresponding to the piston 57 in FIG. 8A, for example), 501 a throttle (corresponding to the throttle 68 in FIG. 8A, for example), 502 a discharge nozzle (corresponding to the discharge nozzle 61 in FIG. 8A, for example), 503 a discharge fluid immediately after flowing out from the discharge nozzle 502 (corresponding to the fluid 70 in FIG. 8A, for example), and 504 a substrate (corresponding to the substrate 69 in FIG. 8A, for example).

FIG. 33B shows the case of $v_{max} \leqq 5$ m/s, in which the discharge fluid 503 does not fly off and a fluid dollop is generated at the top end of the discharge nozzle 502. FIG. 33C shows the case of 5 m/s<$v_{max}$<30 m/s. FIG. 33D shows the case of $v_{max} \geqq 30$ m/s in which the fluid 503 after passing through the nozzle is in the state of being dispersed.

[10] Other Supplemental Description (10-1) Process Conditions for Allowing Effective Application of Present Invention As described by showing an example in [5] "Application example to PDP phosphor discharge", the dispenser serving as one example of the fluid injection apparatus according to the embodiment of the present invention can fulfill the following process conditions, for example.

(1) High-viscosity fluids of order of several thousand to several tens of thousands mPa·s (cps) can be used.

There is no constraint regarding the lower limit value of the viscosity. In comparison between the present invention and the inkjet method for differentiating the characteristics of the present invention, the present invention can support those fluids with viscosity of 100 mPa·s or more to which the inkjet method cannot be applied.

(2) Fluids containing powders having a powder diameter of $\phi d<50$ μm can be used.

The flow passage between two relatively moving members is mechanically in a complete non-contact state. There is no constraint regarding the lower limit value of the powder diameter.

(3) A period of intermittent discharge $T_P$ is 0.1 to 30 ms.

(4) Flying discharge is possible with a gap between the discharge nozzle and the substrate being $H \geqq 0.5$ mm.

(10-2) Additional Characteristics of Fluid Injection Apparatus Employing Present Invention Hereinbelow, the characteristics of the fluid injection apparatus employing the present invention will be additionally described.

(i) A discharge quantity $Q_s$ is less susceptible to the viscosity of discharge fluids.

In Equation (16), fluid resistances $R_n$, $R_p$, $R_s$ are in proportion to a viscosity μ. Moreover, when a pressure $P_{s0}$ of the fluid supply apparatus is set to be an approximate of a maximum pressure $P_{max}$ of the grooved pump portion, the pressure $P_{s0}$ is in proportion to the viscosity μ. Since a flow quantity $Q_i=P_i/R_n$, the viscosities μ of a denominator and a numerator of the flow quantity $Q_i$ are cancelled. Consequently, the discharge quantity of the present dispenser basically does not depend on the viscosity. Generally, the viscosity of fluid logarithmically changes on a large scale against temperature. The characteristic that the discharge quantity is less susceptible to the temperature change is extremely advantageous in structuring the discharge system.

(ii) Reliability regarding clogging of powder and granular materials in flow passage is high.

If the present invention is applied, a sufficiently large opening area of the flow passage extending from the suction port of the pump to the discharge nozzle is ensured, which make the reliability regarding the powder and granular materials high particularly, a gap h between piston end faces, that is a flow passage connected to the discharge nozzle, can be sufficiently large, which is extremely advantageous in prevention of clogging of powders (e.g., particle diameter of 7 to 9 μm in the case of phosphors).

Hereinbelow, description will be given of a setting method for the gap h.

In the case of the dispenser serving as one example of the embodiment of the present invention, as described before, two pressures are developed by fluctuation of a distance of the clearance (e.g., the clearance h in FIG. 6) between relative movement faces. One of them is a primary squeeze pressure developed by a known squeeze effect in proportion to a piston velocity dh/dt and in inverse proportion to the cube of the clearance h. Another one is a second squeeze pressure developed by fluctuation of a distance of the clearance in proportion to the piston velocity dh/dt as well as a sum of a throttle resistance $R_r$ and an internal resistance $R_s$ of the fluid supply apparatus.

Herein, a minimum value or an average value of the clearance h which fluctuates is $h_0$.

When a setting range of $h_0$, in which a discharge quantity $Q_s$ per dot is largely influenced by the primary squeeze pressure, is $0<h_0<h_x$, and a setting range of $h_0$, in which the discharge quantity $Q_s$ is insensitive to change in $h_0$, is $h_0>h_x$, the clearance $h_0$ is set in the range of $h_0>h_x$, by which only the second squeeze pressure is to be used.

In the case of using only the second squeeze pressure, the following effects can be obtained.

(i) The discharge quantity is less susceptible to an influence of the amplitude and the position accuracy of the piston driven by an actuator. Moreover, even if the clearance h drifts due to thermal expansion, the discharge quantity is less susceptible to the influence. Therefore, high discharge quantity accuracy can be obtained.

(ii) Since a clearance $h_{min}$ of the flow passage in the discharge portion which is most prone to clogging can be sufficiently large, high reliability can be gained in respect of handling powder and granular materials.

Supplemental description will be hereinbelow given of the method for analytically obtaining the $h_x$. With use of the aforementioned Equation (16), a flow quantity $Q_i(=P_i/R_n)$ in a clearance $h_0$ (or $h_{min}$) is obtained. The value of $Q_i(=P_i/R_n)$ is integrated by 1 period to obtain a total flow quantity $Q_s$ per dot. In the range of $0<h_0<h_x$, the value of $Q_s$ increases proportionally, whereas in the range of $h_0>h_x$, the value of $Q_s$ converges into a constant value. More particularly, a point at the intersection of an envelope of curves in $0<h_0<h_x$ and a straight line in $h_0>h_x$ may be $h_x$. The relation between $Q_s$ and $h_0$ may be obtained experimentally.

As an alternative, when the multi-head structure is employed and fine adjustment of a flow quantity of each head is necessary, a setting method for an output flow quantity of the grooved pump portion serving as one example of the fluid supply apparatus (flow quantity is adjusted by number of revolutions) may also be performed so that a minimum clearance is set in the vicinity of $h_{min}$=approximate of $h_x$ (e.g., $h_{min}$=50 μm in FIG. 6) where inclination of the discharge quantity against the clearance is smooth.

Thus, a flow quantity being adjustable in a large clearance is the largest characteristic of the present invention. It is to be noted that in the case of discharging phosphors containing fine particles or powder and granular materials such as adhesive agents, a minimum clearance $\delta_{min}$ of the flow passage may be set larger than a maximum value $\phi d_{max}$ of the diameter of a fine particle.

$$\delta_{min}>\phi d_{max} \tag{55}$$

As a result of a number of experiments, it is found out that if a thread groove depth $h_0$ is sufficiently larger than a particle diameter $\phi d_{max}$ in the grooved pump portion, it is not necessary to form a very large clearance $\delta_r$ between a ridge portion of the thread groove and its fixed-side opposite face because powder and granular materials flow along the groove portion. When a clearance in the throttle (e.g., reference numeral 304 in FIG. 11, reference numeral 254 in FIG. 12A, and the like) which is the smallest clearance in the present dispenser is set to be $\delta_r$, clogging of powders can be almost completely prevented if the following conditions are set.

$$\delta_r>5\times\phi d_{max} \tag{56}$$

For example, if the particle sizes $\phi d$ have distribution of 1 to 10 μm, the clearance in the throttle may be set at $\delta_r>50$ μm.

Hereinabove, in the embodiments of the present invention, the grooved pump portion is used as one example of the fluid supply apparatus. While the present invention may be implemented by applying pumps other than the grooved-type pump, the grooved-type is advantageous in the point that the maximum developed pressure $P_{max}$, the maximum flow quantity $Q_{max}$, and the inner resistance $R_s(=P_{max}/Q_{max})$ can be freely selected by changing various parameters (a radial clearance, a thread groove angle, a groove depth, a ratio between groove and ridge, or the like). Moreover in the case of the grooved pump portion, the flow passage may be structured in a complete non contact state, which is an advantage in handling powder and granular materials. Moreover, in the case of the grooved pump portion, a large inner resistance $R_s$ is available and a constant flow quantity characteristic can be stably maintained.

If the flow passage connecting the grooved pump portion serving as one example of the fluid supply apparatus side and the piston portion side (e.g., reference numeral 66 in FIG. 5A and FIG. 5B) is short, the entire flow passage may be an orifice-shaped throttle (throttle resistance $R_r$).

It is to be understood that the figuration of the grooved pump portion serving as one example of the fluid supply apparatus in the fluid injection apparatuses according to the embodiments of the present invention is applicable not only to the grooved type pump but also to pumps of other types. For example, a mohno-type pump called a snake pump, a gear-type pump, a twin screw-type pump, or a syringe-type pump are within the target of application. Further, a pump for simply applying pressure to fluid with high-pressure air is also within the target.

Figure 34:
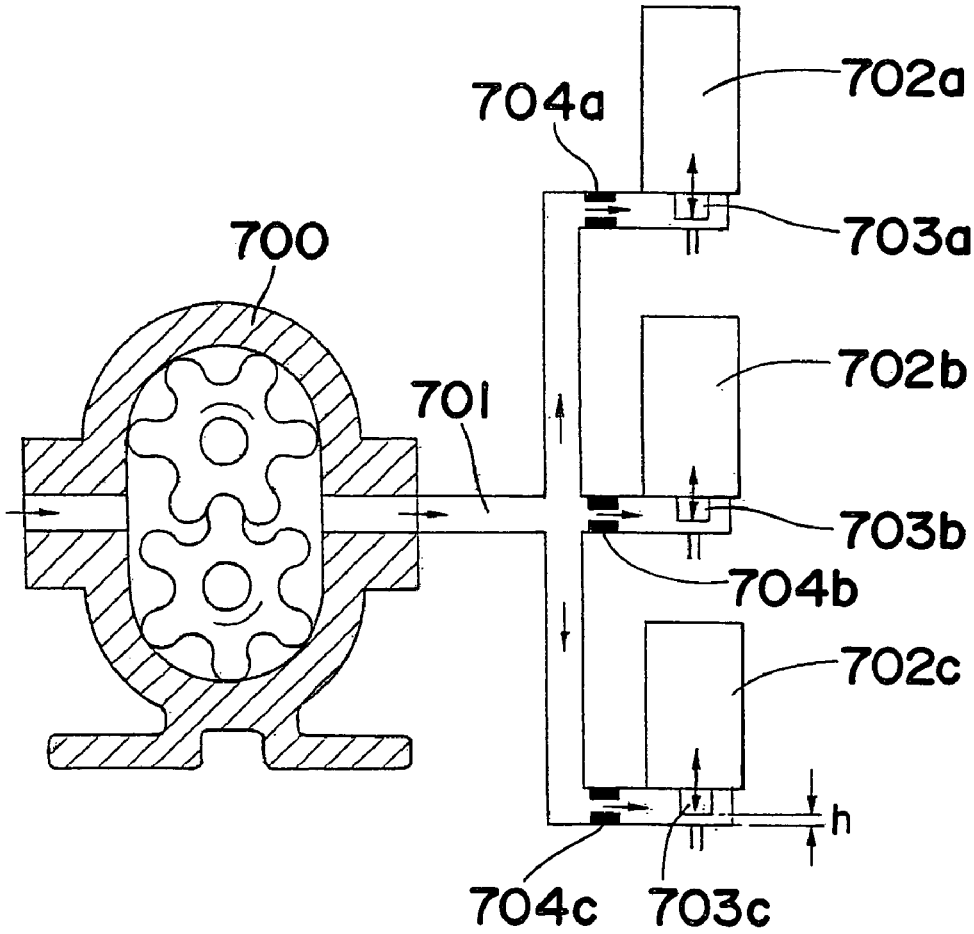
FIG. 34 is a cross sectional view showing the case of using a gear pump in the fluid injection apparatus according to the embodiment of the present invention.

FIG. 34 is a model view in the case of using the gear-type pump as the fluid supply apparatus in the fluid injection apparatus according to the embodiment of the present invention, in which reference numeral 700 denotes a gear pump, 701 a flow passage, 702*a*, 702*b*, 702*c* axial driving units composed of, for example, piezoelectric actuators, 703*a*, 703*b*, 703*c* pistons, and 704*a*, 704*b*, 704*c* throttles serving as one example of the fluid resistance portions disposed in the vicinity of the pistons.

A maximum flow quantity $Q_{max}$ and a maximum pressure $P_{max}$ of the gear pump 700 are generally obtained based on theory in most cases. However, if it is difficult, then the pressure and flow quantity characteristic (PQ characteristic in FIG. 35A) thereof may be obtained experimentally. Moreover, the relation between the pressure and the flow quantity of the pump is not necessarily a linear form, and the PQ characteristic connecting the maximum pressure $P_{max}$ and the maximum flow quantity $Q^*_{max}$ of the pump sometimes take a curve line. In this case, an internal resistance $R_s$ of the pump may be obtained by making a tangent line of the PQ characteristic at operating points $P_c$ and $Q_c$, and applying the theory of the present research to $R_s=P_{max}/Q_{max}$ wherein an intersection on x axis is $P_{max}$ and an intersection on y axis is $Q_{max}$.

Fluid resistances $R_n$, $R_p$ are generally obtained from well-known theoretical formulas (e.g., Equation (10), Equation (11)). However, if the configuration is complex, then numerical analysis may be used or the fluid resistances may be obtained experimentally. In the case of the orifice structure where the length of a throttle portion is shorter than the inner diameter, an equation of linear resistance (e.g., Equation (10)) is not satisfied. In this case, linearization is performed by centering around the operating points so as to gain apparent resistances.

It is to be noted that the viscosity of discharge fluids tends to have dependency on a shear rate. For example, the sear rate exerted on a fluid when the fluid passes the grooved pump portion is different from the sear rate when the fluid passes the discharge nozzle. In this case, the relation between the viscosity of the discharge material and the shear rate may be obtained in advance in an experiment, and the viscosity in each flow passage may be obtained from the shear rate exerted on the fluid. By this method, fluid resistances $R_n$, $R_p$, $R_s$, $R_r$, and the like may be obtained.

A throttle resistance $R_r$ disposed in the vicinity of the discharge chamber may take various configurations.

Figure 35B:
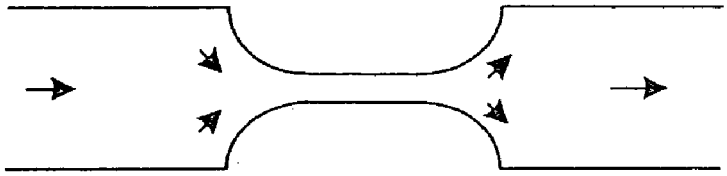
FIG. 35B is a view showing one form of throttle for use in the fluid injection apparatus according to the embodiment of the present invention.
Figure 35C:
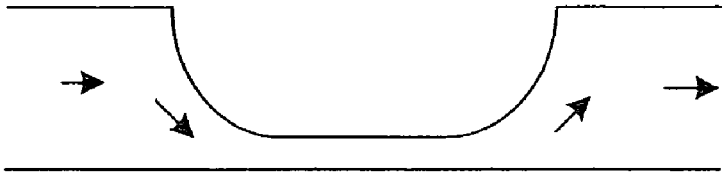
FIG. 35C is a view showing another form of throttle for use in the fluid injection apparatus according to the embodiment of the present invention.
Figure 35D:
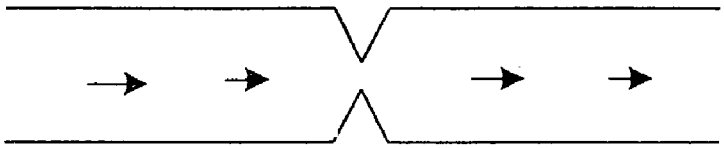
FIG. 35D is a view showing still another form of throttle for use in the fluid injection apparatus according to the embodiment of the present invention.
Figure 3:
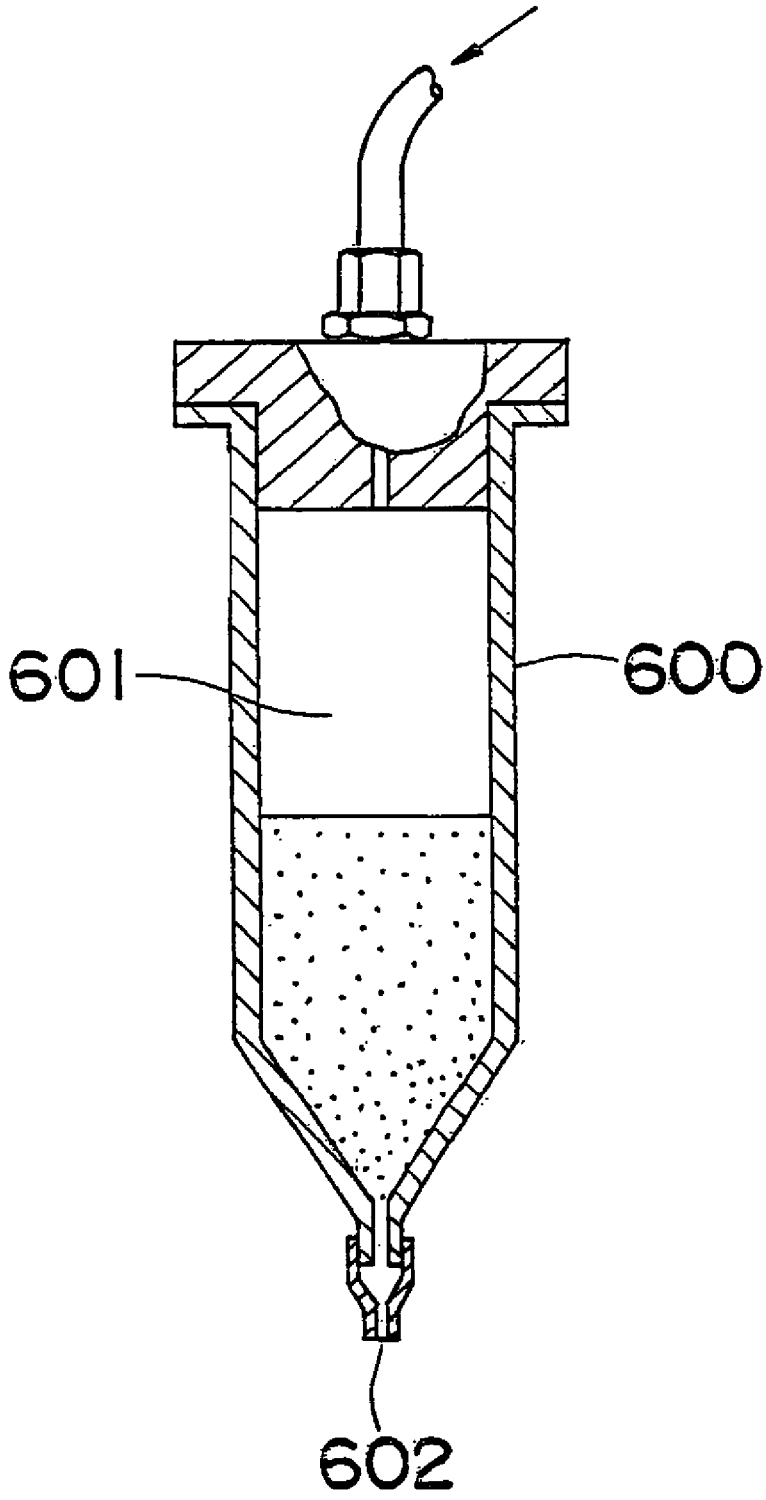
Figure 37:
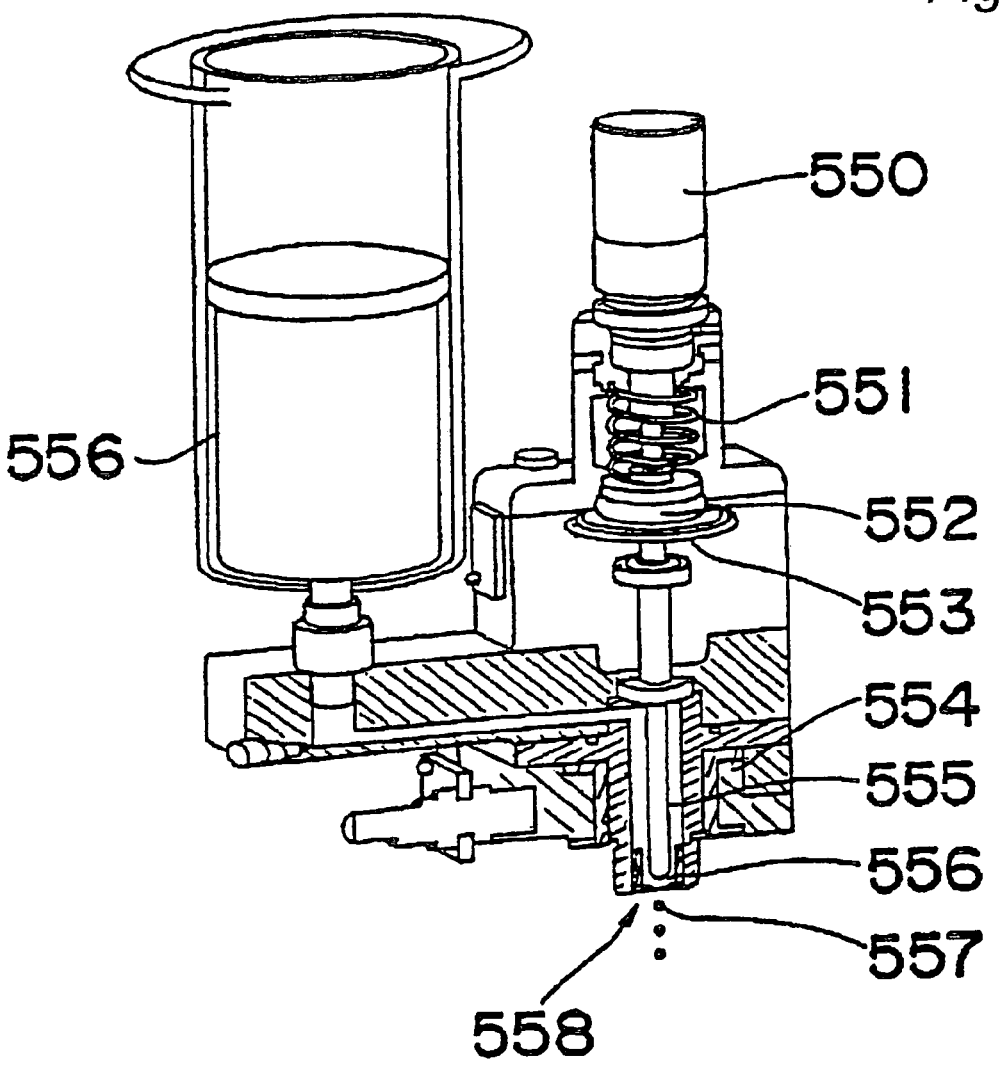
FIG. 37 is a view showing the structure of a conventional jet-type dispenser.
Figure 38A:
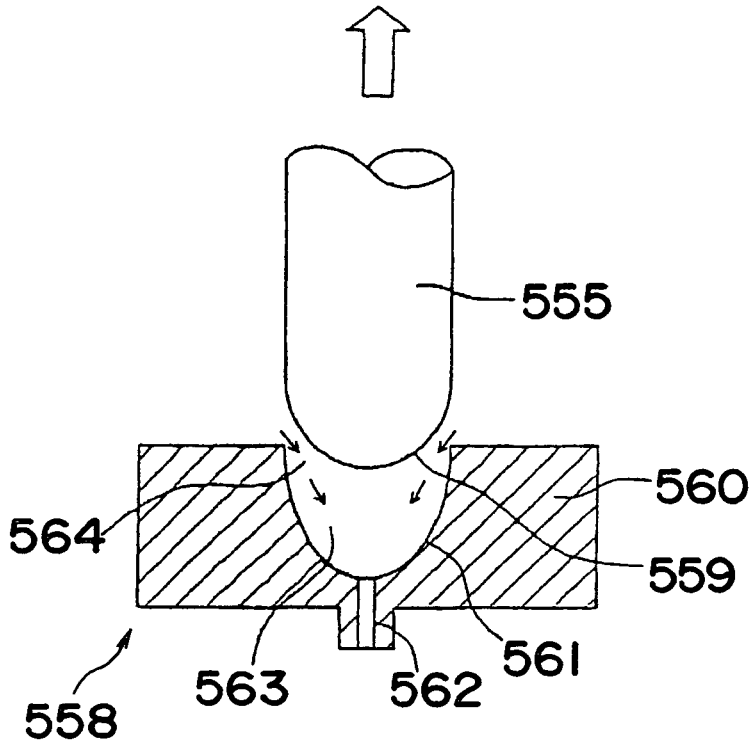
FIG. 38A is an enlarged view showing a piston portion in a suction step in the conventional jet-type dispenser.
Figure 38B:
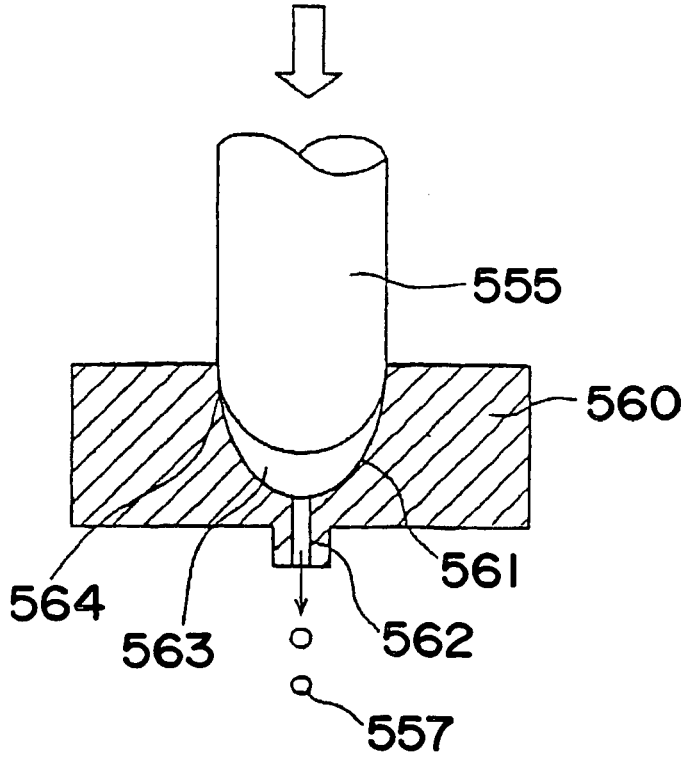
FIG. 38B is an enlarged view showing the piston portion in a discharge step in the conventional jet-type dispenser in FIG. 38A.
Figure 39:
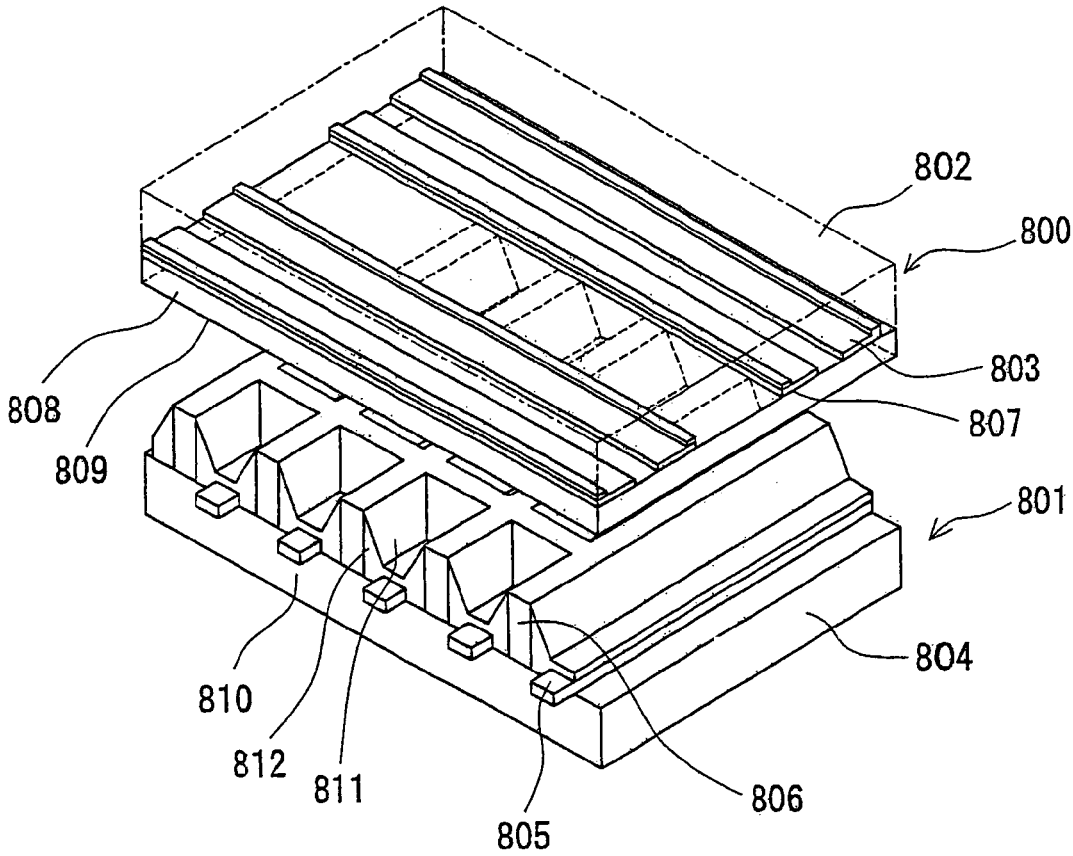
FIG. 39 is a view showing an example of the structure of plasma display panels.

FIG. 35B to FIG. 35D show a few examples of the throttle which is less likely to cause clogging. FIG. 35B is a view of a throttle formed by protruding its circumferential wall face in the form of a ring. FIG. 35C is a view of a throttle formed by largely protruding downward the upper portion of its circumferential wall face. FIG. 35D is a view of a throttle formed by protruding its circumferential wall face protruding in the form of a transverse sectional V-shape ring.

The cross sectional shape of a piston driving portion, or a piston constituting the piston portion and its opposite face does not necessarily have to be round. The piston may have a rectangular cross-sectional shape. In this case, a radius of a circle having an equivalent area is set to be a mean radius.

The hole shape of a discharge nozzle does not have to be a perfect round. For example, in the case where phosphor layers are formed in PDP independent cells, the hole shape of the discharge nozzle is preferably oval if the independent cells are rectangular.

In the pump of the present embodiment handling a ultra small flow quantity, the order of the stroke of the piston be at best several dozen microns, and therefore even with use of electro-magnetostrictive elements such as giant-magnetostrictive elements or piezoelectric elements, the limit of the stroke does not become problem.

Moreover, in the case of discharging high-viscosity fluids, development of a large discharge pressure by the squeeze action is expected. In this case, since an axial driving unit driving the piston needs large thrust against a high fluid pressure, application of electro-magnetostrictive actuators easily capable of producing several hundreds to seven thousands N power is preferable. Having several MHz or more frequency response, the electro-magnetostrictive elements can produce a linear motion of the piston with high response. Consequently, it becomes possible to control a discharge quantity of the high-viscosity fluids with high response and high accuracy.

A cylinder shape is used for the piston and the inner shape of the housing for housing the piston in the embodiment. Other than this method, such structure is also possible that bimorph type piezoelectric element used in inkjet printers or the like is used to constitute two relatively moving faces and a discharge fluid may be fed from the fluid supply apparatus to a discharge chamber formed in between these two faces.

At the cost of the response, moving magnet-type or moving coil-type linear motors, electromagnetic solenoids, or the like may be used as the axial driving unit for driving the piston. In this case, the restraint of the stroke can be resolved.

Figure 40:
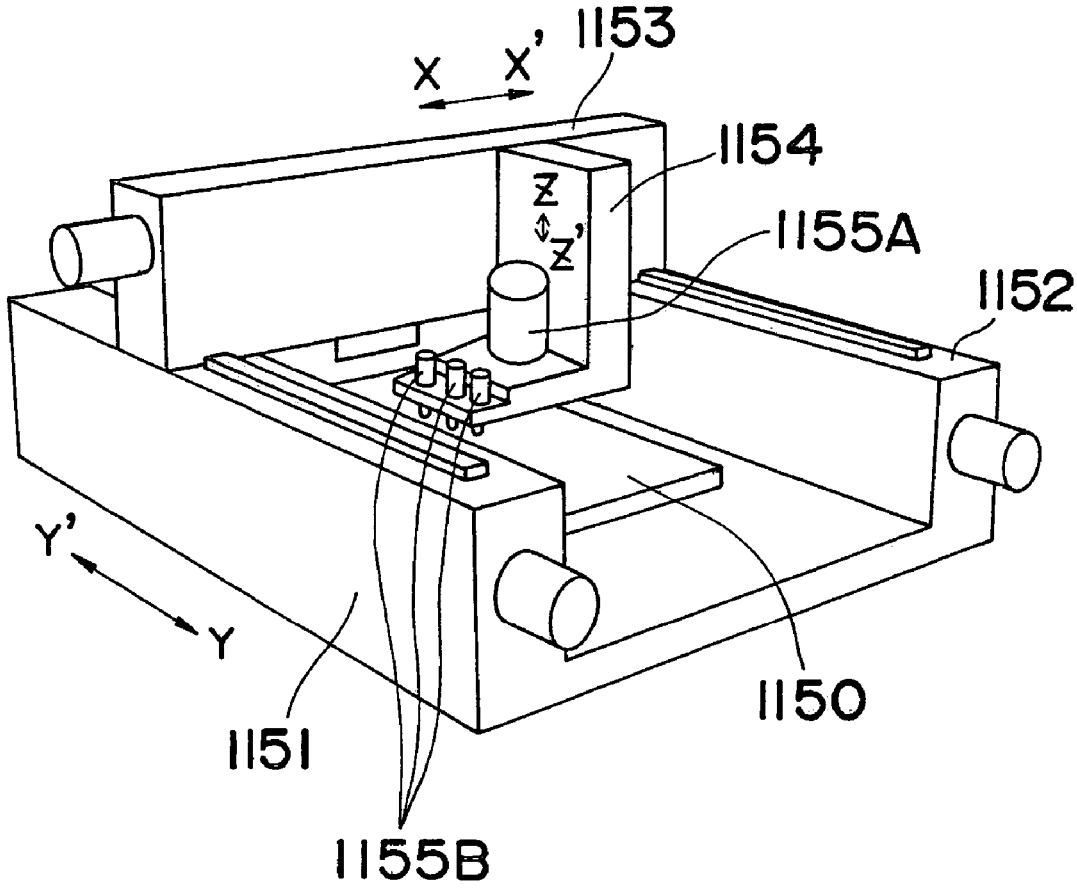
FIG. 40 is a perspective view showing the overall outlined structure of the fluid injection apparatus in the embodiment of the present invention.

The perspective view of FIG. 40 shows the overall structure to which the dispenser that is the fluid injection apparatus according to the embodiment of the present invention is applied, in which a master pump (grooved pump) 1155A (corresponding to reference numeral 153 in FIG. 13B, for example) and a piston portion 1155B constituted by a plurality of pumps (corresponding to reference numerals 156*a* to 156*f* in FIGS. 13A and 13B, for example) are mounted on an z-axis directional transportation unit.

Reference numeral 1150 denotes a PDP panel serving as one example of the substrate which is a discharge target held on a stage or a panel support member, and a pair of Y-axis directional transportation units 1151, 1152 are provided while holding both the sides of the panel 1150. Moreover, an X-axis directional transportation unit 1153 is mounted on the Y-axis directional transportation units 1151, 1152 removably in Y-Y' direction by the Y-axis directional transportation units 1151, 1152. Further, the Z-axis directional transportation unit 1154 is mounted on the X-axis directional transportation unit 1153 movably in arrow X-X' direction by the X-axis directional transportation unit 1153. The master pump (grooved pump) 1155A (corresponding to reference numeral 153 in FIG. 13B, for example) and the piston driving portion 1155B constituted by a plurality of pumps (corresponding to reference numerals 156*a* to 156*f* in FIGS. 13A and 13B, for example) are mounted on the Z-axis directional transportation unit 1154 movably in a vertical direction (Z-axis direction) by the Z-axis directional transportation unit 1154. By this, the stage or the panel support member for holding the panel 1150 is fixed, and the dispenser moves against the fixed panel 1150 so as to perform fluid discharge.

The following effects are fulfilled by the fluid revolving apparatus employing the present invention.

1. Intermittent discharge and continuous discharge with super high-speed response which are conventionally difficult in the air-type and thread groove-type can be performed.

2. The flow passage extending from the suction port to the discharge passage can be constantly put in a non-contact state, and a sufficiently large flow passage area can be secured, so that powder and granular materials containing fine particles can be used with high reliability.

3. The dispenser serving as one example of the embodiment of the present invention can further has the following characteristics:

(i) High-speed discharge of high-viscosity fluids which is difficult in the inkjet method can be performed.

(ii) An ultra small quantity of fluid can be discharged at high accuracy.

By using the present invention in phosphor discharge in PDP and CRT displays and in circuit formation of dispensers, in formation of micro lenses, and the like, its advantages can be fully utilized and immeasurable effects are expected.

The present invention is applicable to the case where a constant quantity of various liquids including adhesive agents, clean solder pastes, phosphors, electrode materials, greases, paints, hot melt adhesives, drugs, and foods are intermittently discharged and fed at high speed and at high accuracy in the production process in the fields of, for example, electronic parts, household appliances, and displays.

It is to be understood that among the aforementioned various embodiments, arbitrary embodiments may be properly combined so as to achieve the effects possessed by each embodiment.

It is to be noted that the technical contents relating the technologies in the portions quoted above are disclosed in the U.S. Patent Applications of U.S. patent application Ser. Nos. 10/673,495 and 10/776,278 and US Patent Publications of U.S. Pat. Nos. 6,558,127 and 6,679,685 which have been quoted in the present specification, the contents of which are hereby incorporated by reference.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A fluid injection apparatus comprising:

a fluid supply apparatus including a thread grooved shaft, a rotation transmission unit, and a suction port, said rotation transmission unit being operable to rotate said thread grooved shaft about a center axis of said thread grooved shaft, and said suction port being provided for introducing a fluid; and a piston portion including a piston, an axial driving unit, and a discharge port, said piston being disposed in a housing, said axial driving unit being operable to move said piston relative to said housing in an axial direction, and said discharge port being provided for discharging the fluid, wherein said fluid supply apparatus is connected to said piston portion through a flow passage, wherein a clearance is formed between said piston and a face opposing said piston, said face having a protruding portion, wherein a longitudinal axis of said thread grooved shaft is slanted with respect to a longitudinal axis of said piston, wherein said fluid supply apparatus is configured to supply a continuous flow of the fluid to said piston portion, wherein said piston portion is configured to convert the continuous flow to an intermittent flow by utilizing a pressure change caused by moving said piston in the axial direction during continuous injection, and wherein a discharge quantity of the intermittent flow is adjustable by adjusting a number of revolutions of said thread grooved shaft of said fluid supply apparatus.

2. The fluid injection apparatus of claim 1, wherein said housing includes said face opposing said piston.

3. The fluid injection apparatus of claim 1, further comprising:

a fluid resistance portion disposed in said flow passage, wherein a volume of said flow passage between said fluid resistance portion and said piston together with a volume enclosed by said fluid resistance portion is less than a volume of said flow passage between said fluid supply apparatus and said fluid resistance portion together with a volume of a portion of said fluid supply apparatus filled with the fluid, and wherein said piston portion is configured to continuously inject the fluid from said discharge port to a discharge target by utilizing a pressure change caused by moving said piston in the axial direction during continuous injection.

4. The fluid injection apparatus of claim 1, wherein said piston is disposed in a cylinder, and wherein an end of said piston nearest said discharge port is a tapered end and said cylinder includes a recess configured to receive said tapered end of said piston.

5. The fluid injection apparatus of claim 4, wherein said discharge port is disposed in said cylinder at a side of said cylinder which is opposite said tapered end of said piston.

6. The fluid injection apparatus of claim 1, wherein said piston is disposed in a cylinder, said cylinder including said face opposing said piston, and wherein said protruding portion is disposed in said clearance so as to form a fluid resistance portion.

7. The fluid injection apparatus of claim 1, wherein said piston is disposed in a cylinder, said cylinder including said face opposing said piston such that said clearance is formed between said cylinder and said piston, wherein said flow passage connects said clearance and said fluid supply apparatus, and wherein a fluid resistance portion is disposed in said flow passage and on a side of said flow passage nearest said clearance.

8. The fluid injection apparatus of claim 1, further comprising:

a fluid resistance portion, wherein a minimum clearance formed in said fluid resistance portion is more than five times greater than a diameter of particles contained in the fluid.

9. The fluid injection apparatus of claim 1, wherein said housing includes a cylinder, said piston being disposed in said cylinder, said cylinder including said face opposing said piston such that said clearance is formed between said cylinder and said piston, and wherein said protruding portion extends into said clearance in a direction toward said piston.

10. The fluid injection apparatus of claim 1, wherein said housing includes a cylinder, said piston being disposed in said cylinder, said cylinder including said face opposing said piston such that said clearance is formed between said cylinder and said piston, wherein said protruding portion extends into said clearance in a direction toward said piston, and wherein a distance between said piston and said face at a region below said protruding portion is greater than a distance between said protruding portion and said piston.

11. The fluid injection apparatus of claim 1, wherein said housing includes a cylinder, said piston being disposed in said cylinder, said cylinder including said face opposing said piston such that said clearance is formed between said cylinder and said piston, wherein said protruding portion extends into said clearance in a direction toward said piston, wherein said flow passage penetrates said cylinder at a region above said protruding portion, and wherein a distance between said piston and said face at a region below said protruding portion is greater than a distance between said protruding portion and said piston, and a distance between said piston and said face at said region above said protruding portion is greater than a distance between said protruding portion and said piston.

* * * * *

UNITED STATES PATENT AND TRADEMARK OFFICE

CERTIFICATE OF CORRECTION

PATENT NO. : 7,647,883 B2
APPLICATION NO. : 11/105516
DATED : January 19, 2010
INVENTOR(S) : Maruyama et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1177 days.

Signed and Sealed this

Sixteenth Day of November, 2010

David J. Kappos

David J. Kappos
*Director of the United States Patent and Trademark Office*